US007812510B2

(12) United States Patent
Minami

(10) Patent No.: US 7,812,510 B2
(45) Date of Patent: Oct. 12, 2010

(54) FLAT DISPLAY AND MANUFACTURING METHOD THEREOF

(75) Inventor: Masaru Minami, Kanagawa (JP)

(73) Assignee: Sony Corporation, Tokyo (JP)

( * ) Notice: Subject to any disclaimer, the term of this patent is extended or adjusted under 35 U.S.C. 154(b) by 895 days.

(21) Appl. No.: 10/531,949

(22) PCT Filed: Sep. 26, 2003

(86) PCT No.: PCT/JP03/12286

§ 371 (c)(1),
(2), (4) Date: Apr. 19, 2005

(87) PCT Pub. No.: WO2004/042768

PCT Pub. Date: May 21, 2004

(65) Prior Publication Data

US 2006/0091780 A1 May 4, 2006

(30) Foreign Application Priority Data

Nov. 7, 2002 (JP) ..... 2002-324158

(51) Int. Cl.
*H01J 1/62* (2006.01)
*H01J 19/42* (2006.01)

(52) U.S. Cl. ..... 313/292; 313/496; 313/495

(58) Field of Classification Search ..... 313/495, 313/496, 292
See application file for complete search history.

(56) References Cited

U.S. PATENT DOCUMENTS 5,811,927 A 9/1998 Anderson et al.
5,990,614 A * 11/1999 Spindt ..... 313/495
6,342,754 B1 * 1/2002 Kuroda et al. ..... 313/292
6,517,399 B1 * 2/2003 Ito et al. ..... 445/24
2002/0079802 A1 * 6/2002 Inoue et al. ..... 313/309
2002/0096992 A1 * 7/2002 Hsiao et al. ..... 313/495
2003/0141806 A1 * 7/2003 Hofmann et al. ..... 313/497
2003/0190772 A1 * 10/2003 Toyota et al. ..... 438/200
2004/0051443 A1 * 3/2004 Ueda et al. ..... 313/495
2004/0075378 A1 * 4/2004 Niibori et al. ..... 313/495

FOREIGN PATENT DOCUMENTS

JP 07-262939 10/1995
JP 10-083778 3/1998
JP 10-199451 7/1998
JP 10-279887 10/1998
JP 10-326579 12/1998

(Continued)

OTHER PUBLICATIONS

Japanese Office Action issued Mar. 24, 2009 for corresponding Japanese Application No. 2002-324158.
International Search Report mailed Jan. 13, 2004.

*Primary Examiner*—Karabi Guharay
(74) *Attorney, Agent, or Firm*—Rader, Fishman & Grauer PLLC

(57) ABSTRACT

A flat-type display comprising a first panel AP and a second panel CP which are bonded to each other in their circumferential portions and having a space between the first panel AP and the second panel CP, the space being in a vacuum state, a spacer being disposed between a first panel effective field and a second panel effective field that work as a display portion, said spacer being fixed to the first panel effective field and/or the second panel effective field with a low-melting-point metal material layers 33A and 33B.

28 Claims, 22 Drawing Sheets

FOREIGN PATENT DOCUMENTS

| | | |
|---|---|---|
| JP | 10-340688 | 12/1998 |
| JP | 2000-057979 | 2/2000 |
| JP | 2000-156181 | 6/2000 |
| JP | 2000-200543 | 7/2000 |
| JP | 2000-357479 | 12/2000 |
| JP | 2002-319346 | 10/2002 |

* cited by examiner

[STEP-100]

[STEP-110]

[STEP-120]

[STEP-130]

[STEP-140]

[STEP-150]

[STEP-150] CONTINUED

[STEP–A2]

[STEP–A3]

[STEP–A4]

[STEP–A5]

[STEP–B3]

[STEP–B5]

[STEP–B6]

[STEP–B7]

FLAT DISPLAY AND MANUFACTURING METHOD THEREOF

TECHNICAL FIELD

The present invention relates to a flat-type display such as, for example, a cold cathode field emission display, and a manufacturing method thereof.

BACKGROUND ART

In the fields of displays for use in television receivers and information terminals, studies have been made for replacing conventionally mainstream cathode ray tubes (CRT) with flat-panel displays which are to comply with demands for a decrease in thickness, a decrease in weight, a larger screen and a high fineness. Such flat panel displays include a liquid crystal display (LCD), an electroluminescence display (ELD), a plasma display panel (PDP) and a cold cathode field emission display (FED). Of these, a liquid crystal display is widely used as a display for an information terminal. For applying the liquid crystal display to a floor-type television receiver, however, it still has problems to be solved concerning a higher brightness and an increase in size. In contrast, a cold cathode field emission display uses cold cathode field emission devices (to be sometimes referred to as "field emission device" hereinafter) capable of emitting electrons from a solid into a vacuum on the basis of a quantum tunnel effect without relying on thermal excitation, and it is of great interest from the viewpoints of a high brightness and a low power consumption.

FIG. 22 shows a schematic partial end view of a cold cathode field emission display having field emission devices (to be sometimes referred to as "display" hereinafter). The field emission device shown in FIG. 22 is a so-called Spindt-type field emission device having a conical electron-emitting portion. Such a field emission device comprises a cathode electrode 11 formed on a supporting member 10 formed of a glass substrate, an insulating layer 12 formed on the supporting member 10 and the cathode electrode 11, a gate electrode 13 formed on the insulating layer 12, a first opening portion 14A formed through the gate electrode 13 and a second opening portion 14B formed through the insulating layer 12, and a conical electron-emitting portion 15 formed on the cathode electrode 11 positioned in the bottom portion of the second opening portion 14B. Generally, the cathode electrode 11 and the gate electrode 13 are formed in the form of a stripe, each stripe being oriented in directions in which the projection images of these two electrodes cross each other at right angles. Generally, a plurality of field emission devices are arranged in a region (corresponding to one pixel, and the region will be called an "overlap region" or an "electron-emitting region EA" hereinafter) where the projection images of the above two electrodes overlap. Further, generally, such electron-emitting regions EA are arranged in the form of a two-dimensional matrix within an effective field (which works as an actual display portion) of the cathode panel CP.

The anode panel AP comprises, for example, a substratum 20, a phosphor layer 23 (a phosphor layer 23R that emits light in red, a phosphor layer 23G that emits light in green and a phosphor layer 23B that emits light in blue in a case of a color display) which is formed on the substratum 20 and has a predetermined pattern, and an anode electrode 24 formed thereon. The anode electrode 24 has not only a function such as a reflecting film which reflects an emitted light from the phosphor layer 23, but also a function such as a reflecting film which reflects electrons recoiled from the phosphor layer 23 or secondary electrons emitted from the phosphor layer 23, and a function for preventing electrostatic charge of the phosphor layer 23.

Each pixel is constituted of an electron emitting region EA on the cathode panel side and a phosphor layer 23 on the anode panel side facing a group of these field emission devices. In the effective field, these pixels are arranged in the order of hundreds of thousands to several millions. A partition wall 322 is formed on the substratum 20 between one phosphor layer 23 and another phosphor layer 23. FIGS. 3 to 5 schematically show layouts of the partition wall 322, the spacer 331 and phosphor layer 23. Further, a light-absorbing layer (called "black matrix" as well) 21 is formed on the substratum 20 between one phosphor layer 23 and another phosphor layer 23. Part of the partition wall 322 works as a spacer holder 330. While FIGS. 3 to 5 show the partition wall 22, the spacer holder 30 and the spacer 31, the partition wall 22, the spacer holder 30 and the spacer 31 shall be read as the partition wall 322, the spacer holder 330 and the spacer 331.

A plurality of separation walls 322 prevent the occurrence of a so-called optical crosstalk (color mixing) that is caused when electrons recoiling from the phosphor layer 23 or secondary electrons emitted from the phosphor layer 23 enter another phosphor layer, or prevent the collision of electrons with another phosphor layer when electrons recoiling from the phosphor layer 23 or secondary electrons emitted from the phosphor layer 23 enter another phosphor layer 23 over the separation wall.

The anode panel AP and the cathode panel CP are arranged such that the electron-emitting regions and the phosphor layers 23 are opposed to each other, and the anode panel AP and the cathode panel CP are bonded to each other in their circumferential portions through a frame (not shown), whereby the display is produced. In an ineffective field which surrounds the effective field and where a peripheral circuit for selecting pixels is provided, a through-hole (not shown) for vacuuming is provided, and a tip tube (not shown) is connected to the through-hole and sealed after vacuuming. That is, a space surrounded by the anode panel AP, the cathode panel CP and the frame is in a vacuum state.

When the spacer 331 is not provided between the anode panel AP and the cathode panel CP, therefore, the display is damaged under and due to atmospheric pressure.

Therefore, in an image display or a flat-type display disclosed in JP-A-7-262939 or JP-A-2000-156181, a positioning member or a supporting member is formed on a black matrix formed on a front panel or a substrate, a brace member or a spacer is embedded between a pair of the positioning members or between the supporting members.

Further, in an image display disclosed in JP-A-2000-57979, a spacer and a cathode substrate are fixed to each other with an ultraviolet ray curing adhesive or an inorganic adhesive. Further, JP-A-10-199451 discloses a display in which a panel body and a spacer portion are integrated.

Meanwhile, the spacer 331 generally has a height of 1 to 2 mm and thickness of 0.05 to 0.1 mm. During the process of producing the display, therefore, it is difficult to keep the spacer 331 self-supported, and it is required to hold the spacer 331 between a pair of the spacer holders 330. For embedding the spacer 331 reliably between a pair of the spacer holders 330, the distance between the pair of the spacer holders 330 is required to be greater than the thickness of the spacer 331. When the distance between the pair of the spacer holders 330 is too broad as compared with the thickness of the spacer 331, however, the spacer 331 comes to tilt in the process of producing a display after the spacer 331 is embedded between the pair of spacers 330, and when the anode panel AP and the cathode panel CP are assembled, there is caused a problem that the spacer 331 and the spacer holder 330 are broken. Particularly, when the display is increased in size, the number of the spacers increases, and it is more difficult to hold the spacers perpendicularly.

In the image display disclosed in JP-A-2000-57979, the spacer and the cathode substrate are fixed to each other with an ultraviolet ray curable adhesive or an inorganic adhesive, so that the tilting of the spacer 331 can be prevented. However, there are remaining problems on the release of a gas from the adhesive and thermal deterioration of the adhesive. When a gas is released from the adhesive, the vacuum degree inside the image display may be degraded. When some gas is present inside the image display, for example, a cold cathode field emission display has problem that since fine electron emitting portions are sputtered with ions generated by the gas, the electron emission efficiency is changed, or that since electron emitting portions are damaged, the lifetime of the image display is decreased.

In the display disclosed in JP-A-10-199451, there is caused a problem wherein because the process for producing an integrated structure of a panel body and a spacer portion is difficult, the production cost is increased.

JP-A-2000-200543 discloses a technique of bonding circumferential portions of an anode panel and a cathode panel to each other with a low-melting metal. However, it describes nothing concerning the fixing of any spacer.

It is therefore an object of the present invention to provide a flat-type display having a structure that can avoid the occurrence of the problem in which the spacer tilts in the process of producing the flat-type display and that is free of the problems of the release of a gas from a material fixing the spacer and the thermal deterioration of a material fixing the spacer, and a method for producing the same.

DISCLOSURE OF THE INVENTION

The flat-type display of the present invention for achieving the above object is a flat-type display comprising a first panel and a second panel which are bonded to each other in their circumferential portions and having a space between the first panel and the second panel, the space being in a vacuum state, a spacer being disposed between a first panel effective field and a second panel effective field that work as a display portion, said spacer being fixed to the first panel effective field and/or the second panel effective field with a low-melting-point metal material layer.

That is, the flat-type display of the present invention specifically includes (1) a constitution in which the low-melting-point metal material layer is present between the spacer and that portion of the first panel which constitutes the first panel effective field (to be referred to as "flat-type display according to a first-A constitution" for convenience), (2) a constitution in which the low-melting-point metal material layer is present between the spacer and that portion of the second panel which constitutes the second panel effective field (to be referred to as "flat-type display according to a first-B constitution" for convenience), and (3) a constitution in which the low-melting-point metal material layer is present between the spacer and that portion of the first panel which constitutes the first panel effective field and the low-melting-point metal material layer (second low-melting-point metal material layer) is also present between the spacer and that portion of the second panel which constitutes the second panel effective field (to be referred to as "flat-type display according to a first-C constitution" for convenience).

The first panel effective field and the second panel effective field represent a field that works as the actual display portion of the first panel and a field that works as the actual display portion of the second panel, as will be used in this sense hereinafter. Ineffective fields are positioned outside the first panel effective field and the second panel effective field. That is, the ineffective fields surround the first panel effective field and the second panel effective field.

The flat-type display of the present invention may have a constitution in which a plurality of spacer holders for temporarily holding the spacer are formed in the first panel effective field and/or the second panel effective field. The above constitution will be referred to as "flat-type display according to the second constitution" for convenience. It is required to arrange the spacer on the first panel effective field and/or the second panel effective field before the spacer is fixed to the first panel effective field and/or the second panel effective field. When the above spacer holders are provided, the falling or tilting of the spacer can be reliably prevented in a step following the arrangement (temporarily holding) of the spacer on the first panel effective field and/or the second panel effective field. A more specific layout, etc., of the spacer holders will be described later.

Table 1 shows portions where the spacer holders are to be formed when the second constitution is applied to the first-A, first-B and first-C constitutions. In Table 1 and Table 2 to be described later, "○" means that a spacer holder is provided, and "X" means that no spacer holder is provided.

TABLE 1

| | | position of low-melting-point metal material layer | | position of spacer holder to be formed in Second Constitution | |
|---|---|---|---|---|---|
| Case | | between first panel and spacer | between second panel and spacer | first panel | second panel |
| 1 | First-A | ○ | X | X | X |
| 2 | Constitution | | | ○ | X |
| 3 | | | | ○ | ○ |
| 4 | | | | X | ○ |
| 11 | First-B | X | ○ | X | X |
| 12 | Constitution | | | ○ | X |
| 13 | | | | ○ | ○ |
| 14 | | | | X | ○ |
| 21 | First-C | ○ | ○ | X | X |
| 22 | Constitution | | | ○ | X |
| 23 | | | | ○ | ○ |
| 24 | | | | X | ○ |

The method for manufacturing a flat-type display, provided according to a first aspect of the present invention for achieving the above object, is a method for manufacturing a flat-type display comprising a first panel and a second panel which are bonded to each other in their circumferential portions and having a space between the first panel and the second panel, the space being in a vacuum state, a spacer being disposed between a first panel effective field and a second panel effective field that work as a display portion, the method comprising;

(A) arranging a spacer with a low-melting-point metal material layer formed on one top surface thereof, on the first panel effective field, then, (B) heating the low-melting-point metal material layer to melt the same and thereby fixing said spacer to the first panel effective field, and then, (C) placing the second panel on the other top surface of the spacer, bonding the first panel and the second panel to each other in their circumferential portions, and vacuuming the space sandwiched between the first panel and the second panel.

The method for manufacturing a flat-type display, provided according to the first aspect of the present invention, may have a constitution in which a second low-melting-point metal material layer is formed on the other top surface of the above spacer, the second low-melting-point metal material layer is melted together when the first panel and the second panel are bonded to each other in their circumferential portions in the above step (C), and the above spacer is thereby fixed to the second panel effective field. This constitution will be referred to as "method for manufacturing a flat-type display, provided according to the first-A aspect of the present invention" for convenience.

The method for manufacturing a flat-type display, provided according to the first aspect of the present invention including the first-A aspect of the present invention, may also have a constitution in which a plurality of spacer holders for temporarily holding the spacer are formed in the first panel effective field and/or the second panel effective field. This constitution will be referred to as "method for manufacturing a flat-type display, provided according to the first-B aspect of the present invention" for convenience. More specific arrangements of the spacer holders will be described later.

The method for manufacturing a flat-type display, provided according to a second aspect of the present invention, is a method for manufacturing a flat-type display comprising a first panel and a second panel which are bonded to each other in their circumferential portions and having a space between the first panel and the second panel, the space being in a vacuum state, a spacer being disposed between a first panel effective field and a second panel effective field that work as a display portion, the method comprising;

(A) providing the first panel in which a low-melting-point metal material layer is formed in a portion where the spacer is to be fixed in the first panel effective field, (B) arranging the spacer on said low-melting-point metal material layer, heating the low-melting-point metal material layer to melt the same, and thereby fixing said spacer to the first panel effective field, and then, (C) placing the second panel on the other top surface of the spacer, bonding the first panel and the second panel in their circumferential portions and vacuuming the space sandwiched between the first panel and the second panel.

The method for manufacturing a flat-type display, provided according to the second aspect of the present invention, may have a constitution in which a second low-melting-point metal material layer is formed on a portion where the spacer is to be fixed in the second panel effective field, the second low-melting-point metal material layer is melted when the first panel and the second panel are bonded in their circumferential portions in the above step (C), and thereby the spacer is fixed to the second panel effective field. This constitution will be referred to as "method for manufacturing a flat-type display, provided according to the second-A aspect of the present invention" for convenience.

The method for manufacturing a flat-type display, provided according to the second aspect of the present invention including the second-A aspect of the present invention, may also have a constitution in which a plurality of spacer holders for temporarily holding the spacer are formed in the first panel effective field and/or the second panel effective field. This constitution will be referred to as "method for manufacturing a flat-type display, provided according to the second-B aspect of the present invention" for convenience. More specific arrangements of the spacer holders will be described later.

Table 2 shows portions where the spacer holders are to be formed when the method for manufacturing a flat-type display, provided according to the first-B aspect of the present invention, is applied to the method for manufacturing a flat-type display, provided according to the first aspect and the first-A aspect of the present invention and when the method for manufacturing a flat-type display, provided according to the second-B aspect of the present invention, is applied to the method for manufacturing a flat-type display, provided according to the second aspect and the second-A aspect of the present invention.

TABLE 2

[Method for manufacturing A-flat-type display]

| Case | | position of low-melting-point metal material layer: between first panel and spacer | position of low-melting-point metal material layer: between second panel and spacer | position of spacer holder to be formed: first panel | position of spacer holder to be formed: second panel | |
|---|---|---|---|---|---|---|
| 31 | First Aspect | ○ | X | X | X | |
| 32 | | | | ○ | X | First-B Aspect |
| 33 | | | | ○ | ○ | First-B Aspect |
| 34 | | | | X | ○ | First-B Aspect |
| 41 | First-A Aspect | ○ | ○ | X | X | |
| 42 | | | | ○ | X | First-B Aspect |
| 43 | | | | ○ | ○ | First-B Aspect |
| 44 | | | | X | ○ | First-B Aspect |
| 51 | Second Aspect | ○ | X | X | X | |
| 52 | | | | ○ | X | Second-B Aspect |
| 53 | | | | ○ | ○ | Second-B Aspect |
| 54 | | | | X | ○ | Second-B Aspect |
| 61 | Second-A | ○ | ○ | X | X | |
| 62 | Aspect | | | ○ | X | Second-B Aspect |
| 63 | | | | ○ | ○ | Second-B Aspect |
| 64 | | | | X | ○ | Second-B Aspect |

In the flat-type display of the present invention including the flat-type display according to any one of the first-A to first-C constitutions and the second constitutions, the method for manufacturing a flat-type display according to the first aspect of the present invention including the first-A and first-B aspects of the present invention, or the method for manufacturing a flat-type display according to the second aspect of the present invention including the second-A and second-B aspects of the present invention (these will be sometimes referred to as "the present invention" hereinafter), the spacer is preferably formed of ceramics. Specific examples of the ceramics include alumina, mullite, barium titanate, lead titanate zirconate, zirconia, cordierite, barium borosilicate, iron silicate, glass ceramic material, and a mixture of any one these with titanium oxide, chromium oxide, iron oxide, vanadium oxide or nickel oxide. When these are used, a so-called green sheet is formed, the green sheet is fired and the thus-obtained green sheet fired product is cut, whereby the spacer can be produced. Alternatively, the spacer can be formed of glass such as alkali glass containing 25% of iron oxide. A metal layer, a metal alloy layer or a resistance layer may be formed on part of the side surfaces of the spacer. A conductive material layer made of a metal or a metal alloy may be formed so as to cover the top surface of the spacer. When the above constitution is employed, there is removed a voltage difference between the spacer constituted of an insulating material and elements constituting the first or second panel, and there can be inhibited the occurrence of a discharge between the spacer constituted of an insulating material and elements constituting the first or second panel. When the spacer is cut with an imaginary plane perpendicular to the longitudinal direction thereof, the spacer generally has a cross-sectional form of a long and narrow rectangle.

The height, thickness and length of the spacer can be determined on the basis of the specification, etc., of the flat-type display, and for example, the thickness of the spacer is 20 μm to 200 μm, for example, 50 μm, and the height is 1 mm to 2 mm. The size of the spacer holders and the distance between the spacer holders can be determined on the basis of the specification, etc., of the flat-type display as well, and for example, the height of the spacer holders is 20 to 100 μm, and the thickness thereof is 10 to 50 μm. The distance between a pair of the spacer holders for holding the spacer can be determined on the basis of the thickness, formation accuracy and processing accuracy of the spacer and the processing accuracy and formation accuracy of the spacer holders.

In the present invention, the first panel and the second panel are bonded to each other in their circumferential portions through a bonding layer made of frit glass, or there can be employed a constitution in which the first panel and the second panel are bonded to each other in their circumferential portions through a bonding layer made of frit glass. The above frit glass is a high-viscosity paste-like material obtained by dispersing glass fine particles in an organic binder, and the high-viscosity paste-like material is applied in a predetermined pattern and then fired to remove the organic binder, whereby a solid bonding layer is formed.

Alternatively, in the present invention, the first panel and the second panel are bonded to each other in their circumferential portions through a bonding layer made of a low-melting-point metal material, or there can be employed a constitution in which the first panel and the second panel are bonded to each other in their circumferential portions through a bonding layer made of a low-melting-point metal material.

In the flat-type display of the present invention including the flat-type display according to the second constitution, there can be employed a constitution in which the flat-type display is a cold cathode field emission display, the first panel is an anode panel in which an anode electrode and a phosphor layer are formed, and the second panel is a cathode panel in which a plurality of cold cathode field emission devices are formed.

In the method for manufacturing a flat-type display, provided according to the first aspect of the present invention including the first-A and first-B aspects of the present invention, or the method for manufacturing a flat-type display, provided according to the second aspect of the present invention including the second-A and second-B aspects of the present invention, there can be employed a constitution in which (a) the flat-type display is a cold cathode field emission display, the first panel is an anode panel in which an anode electrode and a phosphor layer are formed, and the second panel is a cathode panel in which a plurality of cold cathode field emission devices are formed, or (b) the flat-type display is a cold cathode field emission display, the first panel is a cathode panel in which a plurality of cold cathode field emission devices are formed, and the second panel is an anode panel in which an anode electrode and a phosphor layer are formed.

In the present invention, the temperature range represented by the term "low-melting point" refers to a range including and below about 400° C. A general frit glass has a softening temperature of about 600° C., and the firing temperature is 350° C. to about 500° C., so that the melting point of the low-melting-point metal material constituting the low-melting-point metal material layer or the low-melting-point metal material for constituting the bonding layer for bonding the first panel and the second panel to each other in their circumferential portions is about the same as, or lower than, the temperature employed for firing the frit glass. There is no special limitation to be imposed on the lower limit of the melting point of the low-melting-point metal material. However, when the above lower limit is too low, there may be posed a problem on the reliability of the low-melting-point metal material layer and the bonding layer, so that the lower limit the above melting point is preferably 120° C. by taking account of the reliability of the flat-type display under general environments in which flat-type displays are used. That is, the melting point of the low-melting-point metal material for constituting the low-melting-point metal material layer or the bonding layer is 120° C. to 400° C., preferably 120° C. to 300° C. In the present specification, the term "low-melting-point metal material layer" includes a low-melting-point alloy material layer, and the term "low-melting-point metal material" includes a low-melting-point alloy material. The low-melting-point metal material constituting the low-melting-point metal material layer and the low-melting-point metal material constituting the bonding layer may be the same low-melting-point metal material, may be low-melting-point metal materials of the same kinds, or may be low-melting-point metal materials of different kinds. Further, the low-melting-point metal material constituting the low-melting-point metal material layer and the low-melting-point metal material constituting the second low-melting-point metal material layer may be the same low-melting-point metal material, may be low-melting-point metal materials of the same kinds, or may be low-melting-point metal materials of different kinds.

The low-melting-point metal material includes In (indium; melting point 157° C.); an indium-gold low-melting-point alloy; tin (Sn)-containing high-temperature solders such as $Sn_{80}Ag_{20}$ (melting point 220 to 370° C.) and $Sn_{95}Cu_5$ (melting point 227 to 370° C.); tin (Sn)-containing solders such as $Sn_{60}Zn_{40}$ (melting point 200 to 250° C.); lead (Pb)-containing high-temperature solders such as $Pb_{97.5}Ag_{2.5}$ (melting point 304° C.), $Pb_{94.5}Ag_{5.5}$ (melting point 304 to 365° C.) and $Pb_{97.5}Ag_{1.5}Sn_{1.0}$ (melting point 309° C.); zinc (Zn)-containing high-temperature solders such as $Zn_{95}Al_5$ (melting point 380° C.); tin-lead-containing standard solders such as $Sn_5Pb_{95}$ (melting point 300 to 314° C.) and $Sn_2Pb_{98}$ (melting point 316 to 322° C.); and brazing materials such as $Au_{88}Ga_{12}$ (melting point 381° C.) (all of the above parenthesized values show atomic %). When the low-melting-point metal material layer is heated to be melted, it is preferred to select a low-melting-point metal material such that the low-melting-point metal material is melted at a temperature at which a substrate constituting the first panel such as a glass substrate is not damaged. Heating method for the low-melting-point metal material layer can be carried out by heating using a lump, a heater, a laser or a hot air furnace.

It is required to form the low-melting-point metal material layer on the top surface of the spacer, in a portion where the spacer is to be fixed in the first panel effective field or in a portion where the spacer is to be fixed in the second panel effective field. In the following explanation, the top surface of the spacer, the portion where the spacer is to be fixed in the first panel effective field and the portion where the spacer is to be fixed in the second panel effective field will be sometimes generally referred to as "bonding region" hereinafter. The low-melting-point metal material layer may be formed on the entire surface of the bonding region, that is, in a continuous state on the bonding region, or may be formed in the form of spots (discontinuous form) on the bonding region. When it is formed in the form of spots (discontinuous form), it may be formed on at least one spot (for example, a low-melting-point metal material layer having a diameter of approximately 30 μm is formed on only one spot along the entire length of the bonding) or it may be formed on a plurality of spots (for example, low-melting-point metal material layers having a width of 60 μm and a length of 100 μm each are formed in the form of a broken line at intervals of approximately 0.5 mm).

The "forming" of the low-melting-point metal material layer refers to a state where the low-melting-point metal material layer is tightly bonded to the surface of the bonding region due to interatomic forces or a state where the low-melting-point metal material is diffused to form an alloy layer in the bonding region. The forming of the above low-melting-point metal material layer can be accomplished, for example, by a vacuum thin film forming technique such as a vacuum vapor deposition method, a sputtering method, an ion plating method, or the like, or can be accomplished by once melting the low-melting-point metal material layer on the bonding region. The low-melting-point metal material layer may be formed both on the top surface of the spacer and on the portion where the spacer is to be fixed in the first panel effective field, or it may be formed both on the top surface of the spacer and on the portion where the spacer is to be fixed in the second panel effective field.

The "forming" of the low-melting-point metal material layer includes a state where the low-melting-point metal material layer is held on the surface of the bonding region with gravitational force or friction force. This state will be referred to as "arrangement" of the low-melting-point metal material layer for convenience. The arrangement of the low-melting-point metal material layer is accomplished by placing or attaching a wire or foil made of the low-melting-point metal material on/to the surface of the bonding region. When the low-melting-point metal material layer can be held on the surface of the bonding region due to some adhesiveness that a foil has and when the bonding region has some adhesiveness that prevents the low-melting-point metal material layer from coming off even when the holding surface is turned downward, the low-melting-point metal material layer can be also arranged both on the top surface of the spacer and the portion where the spacer is to be fixed in the first panel effective field or the second panel effective field. However, when the low-melting-point metal material layer such as a wire material that is simply held on the surface of the bonding region due to gravitational force is used, then preferably, the low-melting-point metal material layer is arranged on one of the surfaces of the spacer and the portion where the spacer is to be fixed in the first panel effective field or the second panel effective field.

When a natural oxidation film tends to grow on the surface of the low-melting-point metal material layer, then suitably, the natural oxidation film is removed from the low-melting-point metal material layer immediately before the low-melting-point metal material layer is heated. The natural oxidation film can be removed by a known method such as a wet etching method using diluted hydrochloric acid, a dry etching method using a chlorine-containing gas, an ultrasonic wave application method, or the like.

In the following explanation, the substrate for constituting the first panel or the substrate for constituting the second panel will be referred to as "substrate for a panel", and when the flat-type display is a cold cathode field emission display, the substrate for constituting a cathode panel will be sometimes referred to as "supporting member", and the substrate for constituting an anode panel will be sometimes referred to as "substratum". Further, when there are employed expressions that a constituent element for the first panel or the second panel is formed "on the substrate for panel", that a constituent element for the cathode panel is formed "on the supporting member" and that a constituent element is formed "on the substratum" hereinafter, the expressions include both the formation of such a constituent element directly on the substrate for panel, the supporting member or the substratum and the formation of such a component above the substrate for the panel, the supporting member or the substratum.

Preferably, an electrically conductive layer is formed on that portion/those portions of the first panel effective field and/or the second panel effective field which is/are in contact with the top surface(s) of the spacer. When the flat-type display is a cold cathode field emission display and when the top surface of the spacer comes in contact with the anode electrode formed in the anode panel, the formation of the above electrically conductive layer can be omitted. Preferably, the electrically conductive layer has excellent wettability to the low-melting-point metal material. The electrically conductive layer can be constituted, for example, of a titanium (Ti) layer or a nickel layer, or can be also constituted of a material for constituting a gate electrode to be described later. When the flat-type display is a cold cathode field emission display, for example, a stripe-shaped electrically conductive layer extending in parallel with a stripe-shaped gate electrode is desirably formed on an insulating layer constituting the cathode panel, and the above electrically conductive layer is preferably grounded for example. The formation of the above electrically conductive layer can remove a voltage difference between the spacer constituted of an insulating material and constituent elements of the first panel or the second panel, so that there can be suppressed the occurrence of a discharge between the spacer and the constituent elements of the first panel or the second panel.

The spacer before fixed to the first panel effective field and/or the second panel effective field may have the form of a straight line along its longitudinal direction or may be in the state of being curved along its longitudinal direction. In these cases, there may be employed a constitution in which a plurality of groups of spacer holders are provided in the first panel effective field and/or the second panel effective field, each group of spacer holders is constituted of a plurality of spacer holders, and the plurality of spacer holders constituting each group of spacer holders are positioned on a straight line. When the spacer in a state where it is fixed in the first panel effective field and/or the second panel effective field is curved in its longitudinal direction, and when the spacer is temporarily held in the spacer holders, a kind of counter force restoring the original shape of the spacer occurs in the spacer, and as a result, the spacer can be reliably held temporarily in the spacer holders.

When the spacer is curved along its longitudinal direction, it can be in a state where the form thereof is part of a circle, part of an ellipse, part of a parabola or part of any other curved line. The direction of curve of a certain portion of the spacer and the direction of a certain other portion thereof may be opposite. In other words, the spacer may be curved, for example, in the form of an "S" letter or may be curved in the form of a plurality of "S" letters continued. Further, that a plurality of spacer holders constituting each group of spacer holders are positioned on a straight line means that it is sufficient that they should be positioned on a straight line as the forming accuracy permits, and in a strict sense, they may not be positioned on a straight line. When the spacer is cut with an imaginary plane perpendicular to the longitudinal direction thereof, the spacer has a cross-sectional form of a long and narrow rectangle.

For reliably curving the spacer along its longitudinal direction, preferably, the surface roughness of one side surface of the spacer and the surface roughness of the other side surface thereof are made different. When the surface roughness of one side surface of the spacer and the surface roughness of the other side surface thereof are made different, the amount of a strain generated on one side surface of the spacer and the amount of a strain generated on the other side surface differ from each other, so that the spacer can be reliably curved in its longitudinal direction. Alternatively, for reliably curving the spacer along its longitudinal direction, preferably, a strain-generating layer is formed on one side surface of the spacer. When the above strain-generating layer is formed on one side surface of the spacer, the spacer can be reliably curved along its longitudinal direction on the basis of a strain generated in one side surface of the spacer due to the strain-generating layer. Examples of the strain-generating layer include layers constituted of $Si_3N_4$, $SiO_2$, SiC, SiCN, $Al_2O_3$, $TiO_2$, TiN, $Cr_2O_3$, $Ta_2O_5$, AlN and TaN.

In these cases, a so-called green sheet is formed, the green sheet is fired and the thus-obtained green sheet fired product is cut, whereby the spacer can be produced. The green sheet fired product before or after it is cut is polished, whereby the surface roughness of one side surface of the spacer and the surface roughness of the other side surface thereof can be made different from each other. Alternatively, the strain-generating layer can be formed on one surface of the green sheet fired product after or before it is cut. The method of forming the strain-generating layer includes a physical vapor deposition method (PVD method), a chemical vapor deposition method (CVD method), plating methods including an electric plating method and an electroless plating method, and a screen printing method. The physical vapor deposition method includes (1) vacuum deposition methods such as an electron beam heating method, a resistance heating method and a flash deposition method, (2) a plasma deposition method, (3) sputtering methods such as a bipolar sputtering method, a DC sputtering method, a DC magnetron sputtering method, a high-frequency sputtering method, a magnetron sputtering method, an ion beam sputtering method and a bias sputtering method, and (4) ion plating methods such as a DC (direct current) method, an RF method, a multi-cathode method, an activating reaction method, an electric field deposition method, a high-frequency ion plating method and a reactive ion-plating method.

Alternatively, there may be also employed a constitution in which a plurality of groups of the spacer holders are formed in the first panel effective field and/or the second panel effective field, each group of the spacer holders is constituted of a plurality of the spacer holders, and the plurality of the spacer holders constituting each group of the spacer holders are not positioned on a straight line. When a plurality of the spacer holders constituting each group of the spacer holders are not positioned on a straight line as described above, and when the spacer is temporarily held in the spacer holders, a kind of counter force restoring the original shape of the spacer occurs in the spacer, and as a result, the spacer can be reliably held temporarily in the spacer holders. That a plurality of the spacer holders constituting each group of the spacer holders are not positioned on a straight line means that an imaginary line connecting the plurality of the spacer holders constituting the group of the spacer holder is part of a circle, part of an ellipse, part of a parabola, part of any other curved line excluding a straight line or a set of segments. The direction of curve of a certain portion of the imaginary line and the direction of curve of other portions thereof may be opposite to each other. In other words, the imaginary line may be curved, for example, in the form of an "S" letter, or may be curved in the form of a plurality of "S" letters. Alternatively, the differential coefficient of the second order in a certain portion of the imaginary line may have a positive value, and the differential coefficient of the second order in other portion may have a negative value. That a plurality of the spacer holders constituting each group of the spacer holders are not positioned on a straight line (that is, positioned on an imaginary line) means that it is sufficient that they should be positioned on an imaginary line as the accuracy of forming the spacer holders permits, and they may not be strictly positioned on the imaginary line. When the spacer is cut with an imaginary plane at right angles with the longitudinal direction thereof, the spacer has a cross-sectional form of a long and narrow rectangle. The spacer before it is temporarily held on the spacer holders may have a constitution in which it has the form of a straight line along its longitudinal direction, or may have a constitution in which it does not have the form of a straight line (constitution in which the spacer before it is temporarily held on a group of the spacer holders has a curved state facing opposedly to the curved state of an imaginary line connecting a plurality of the spacer holders constituting the group of the spacer holders).

The spacer holders can be constituted, for example, from at least one metal selected from the group consisting of nickel (Ni), cobalt (Co), iron (Fe), gold (Au), silver (Ag), rhodium (Rh), palladium (Pd), platinum (Pt) and zinc (Zn), or any one of alloys constituted of these metals; indium oxide-tin (ITO); indium oxide-zinc (IXO); tin oxide ($SnO_2$), antimony-doped tin oxide; indium- or antimony-doped titanium oxide ($TiO_2$); ruthenium oxide ($RuO_2$), indium- or antimony-doped zirconium oxide ($ZrO_2$); a polyimide resin; or a low-melting glass. It can be formed by a plating method including an electric plating method and an electroless plating method, a thermal spraying method, a screen printing method, a method using a dispenser, a sand blasting method, a dry film method or a photo-sensitive method.

The above dry film method refers to a method in which a photosensitive film is laminated on a substrate for the panel, photosensitive film on a portion where the spacer holders are to be formed is removed by exposure and development, a material for forming the spacer holder is embedded in an opening generated by the removal, and the material for the spacer holders is fired. The photosensitive film is combusted and removed by the firing, or removed with a chemical, and the material for forming the spacer holders, embedded in the opening, remains to constitute the spacer holders. The photosensitive method refers to a method in which a photosensitive material layer for forming the spacer holders is formed on a substrate for the panel, the material layer is patterned by exposure and development and the material layer is fired. The sand blasting method refers to a method in which a material layer for forming the spacer holders is formed on a substrate for the panel, for example, by screen printing or with a roll coater, a doctor blade, a nozzle-ejection type coater, or the like, the material layer is dried and/or fired, then, a portion where the spacer holders are to be formed in the material layer for forming the spacer holders is covered with a mask, and then, an exposed portion is removed by a sand blast method.

When the spacer holders are formed by a thermal spraying method, a mask may be used so that no spacer holder is formed in an unnecessary portion. The mask can be constituted from a so-called photosensitive material (e.g., photosensitive liquid resist material or a photosensitive dry film). In this case, a photosensitive material layer formed of a photosensitive dry film is laminated on the substrate for the panel. Alternatively, when the photosensitive material is constituted from a photosensitive liquid resist material, a photosensitive liquid resist-material layer is formed on the substrate for the panel. And, the photosensitive material layer is exposed and developed, whereby a mask, which is formed of the photosensitive layer and has openings, can be formed on the substrate for the panel. After the spacer holders are formed, the mask layer is removed from the substrate for the panel by a method that is selected as required depending upon the constitution of the mask. That is, for example, the mask layer is chemically removed, (for example, peeled off with a chemical or fired), or removed mechanically. Alternatively, the mask can be constituted from a plate-shaped material (sheet-shaped material) prepared from a metal, glass, ceramics, a heat-resistant resin, or the like. When the mask layer is constituted from a plate-shaped material (sheet-shaped material), openings can be made through such a plate-shaped material (sheet-shaped material) beforehand by machining, or the like, and the mask is placed on the substrate for the panel. After the spacer holders are formed, the mask is mechanically removed.

When the spacer holders are formed by a thermal spraying method, they can be constituted from the following materials. That is, as a material for use in the thermal spraying method, it is preferred to use a heat-resistant material that is not altered, denatured or decomposed at a heat-treatment temperature in the step of producing the first panel or the second panel (e.g., an anode electrode and a cathode electrode) or producing the flat-type display (e.g., a cold cathode field emission display). Specific examples of the above material include ceramics, for example, titanium oxides such as titania ($TiO_2$), chromium oxides such as chromia ($Cr_2O_3$), aluminum oxides such as alumina ($Al_2O_3$) and gray alumina ($Al_2O_3.TiO_2$), magnesium oxides such as magnesia (MgO) and magnesia spinel ($MgO.Al_2O_3$), zirconium oxides such as zirconia ($ZrO_2$) and zircon ($ZrO_2.SiO_2$), silicon oxide, aluminum nitride, silicon nitride, zirconium nitride, magnesium nitride, tungsten carbide (WC), titanium carbide (TiC), silicon carbide (SiC) and chromium carbide ($Cr_3C_2$). Further, specific examples of the above material include metal materials such as aluminum (Al), copper (Cu), nickel (Ni), molybdenum (Mo), chromium (Cr), tungsten (W), titanium (Ti), rhenium (Re), vanadium (V) and niobium (Nb), and metal alloys such as nickel-chromium alloy, iron-nickel alloy, Kovar and ferrite. Further, glass can be used as well, and there may be also used a mixture of at least two members of ceramics, metals, metal alloys and glasses. When the spacer holders are constituted from an electrically conductive, thermally sprayable material, such a material can be selected from materials having electrical conductivity among the above-described various materials as required. For example, it is preferred to select such a material that the spacer holders have a volume resistivity of 1Ω·m or less. When the spacer holders are constituted from such a thermally sprayable material, the spacer holders and a partition wall to be described later work as a kind of a wiring, so that, for example, the potential of an anode electrode can be reliably maintained at a predetermined value. Further, when a light-absorbing layer (which is also called black matrix) to be described later is constituted from a thermally sprayable material that absorbs light from a phosphor layer, or when the spacer holders are constituted from a thermal-sprayable material that absorbs light from a phosphor layer, it is sufficient to select such a thermally sprayable material among the above various materials as required, and it is preferred to select, for example, a material that absorbs 99% or more of light from a phosphor layer. The above material includes titanium oxide, chromium oxide and a mixture of titanium oxide and aluminum oxide. In some cases, those portions of the spacer holders which are in contact with the substrate for panel for constituting the first panel, or the substrate for panel for constituting the second panel, may be constituted from an insulating thermally sprayable material, and portions above the above portions may be constituted from an electrically conductive thermally sprayable material. The thermal spraying method or the thermal spraying method for forming the light-absorbing layer from a thermally sprayable material that absorbs light, by a known thermal spraying method, include a plasma spraying method, a flame spraying method, a laser spraying method and an arc spraying method.

When the spacer holders are formed by an electroless plating method, it is sufficient to use, as a catalyst, a water soluble salt or complex of a chloride or nitrate of palladium, gold, silver, platinum, copper, and the like.

For suppressing a thermal strain between the substrates for panel constituting the first panel and second panel and the spacer holders, the spacer holders can be formed by a dispersion plating method using a plating solution prepared by dispersing an inorganic material such as a metal having a low thermal expansion coefficient or an organic material having heat resistance. For example, when nickel is a parent phase, iron, $SiO_2$, SiN, polytetrafluoroethylene, or the like can be used as a dispersion phase. The spacer holders may be coated with an electrically conductive layer formed of a metal or an alloy. The electrically conductive layer can be constituted from any material so long as it has electrical conductivity. The method for forming the electrically conductive layer includes various vacuum vapor deposition methods including an electron beam vapor deposition method and a hot filament vapor deposition method, a sputtering method, a CVD method, an ion plating method, a screen printing method, a plating method, and the like.

For improving a thermal expansion coefficient deifference and adhesion between the spacer holders and the substrate for panel for constituting the first panel or the second panel (improving adhesion between the spacer holders and a light-absorbing layer when a light-absorbing layer to be described later is formed), or as a kind of cathode for plating when the spacer holders are formed by an electric plating method, an intermediate layer may be formed between them. The intermediate layer preferably has a thermal expansion coefficient that is a value between the thermal expansion coefficient of a material constituting the spacer holders and a material constituting the substrate for panel for constituting the first panel or the second panel. Alternatively, the intermediate layer is preferably constituted from a material having a greater ductility than the substrate for the panel and having a smaller Young's modulus than the substrate for the panel. For example, when the spacer holders are constituted of nickel, the material for constituting the intermediate layer can be selected from gold, silver or copper. The thickness of the intermediate layer can be approximately 1 μm to 5 μm. The intermediate layer may have a layer-stacked structure.

In the present invention, after the spacer holders are formed, top surfaces of the spacer holders may be polished to flatten the top surfaces of the spacer holders.

In the present invention, when the flat-type display is a cold cathode field emission display, a plurality of cold cathode field emission devices are formed in a cathode panel, and a phosphor layer and an anode electrode are formed in an anode panel. The anode panel is preferably provided with a plurality of separation walls for preventing the occurrence of a so-called optical crosstalk (color mixing) that is caused when electrons recoiling from the phosphor layer or secondary electrons emitted from the phosphor layer enter another phosphor layer, or for preventing the collision of electrons with another phosphor layer when electrons recoiling from the phosphor layer or secondary electrons emitted from the phosphor layer enter another phosphor layer over the separation wall.

As will be described in detail with regard to some of them, examples of the cold cathode field emission device (to be abbreviated as "field emission device" hereinafter) include (a) a Spindt type field emission device (field emission device in which a conical electron emitting portion is formed on a cathode electrode positioned in a bottom of a hole portion), (b) a crown type field emission device (field emission device in which a crown-shaped electron emitting portion is formed on a cathode electrode positioned in a bottom of a hole portion), (c) a plane type field emission device (field emission device in which a nearly plane-surface-shaped electron emitting portion is formed on a cathode electrode positioned in a bottom of a hole portion), (d) a flat type field emission device that emits electrons from the surface of a flat cathode electrode, (e) a crater type field emission device that emits electrons from convex portions of surface of a cathode electrode having a convexoconcave shape formed on the surface, and (f) an edge type field emission device that emits electrons from an edge portion of a cathode electrode.

In the anode panel, the portion with which electrons emitted from the field emission device collide first is an anode electrode or a phosphor layer although it is dependent upon the structure of the anode panel.

The surface form (pattern) of the phosphor layer may be the form of dots or may be the form of a stripe depending upon pixels. When the phosphor layer is formed between partition walls, the phosphor layer is formed on that portion of the substratum constituting the anode panel which is surrounded with the partition walls.

The phosphor layer can be formed from a luminescence crystal particle composition prepared from luminescence crystal particles (e.g., phosphor particles having a particle diameter of approximately 5 to 10 nm), for example, by a method in which a red photosensitive luminescence crystal particle composition (red phosphor slurry) is applied to the entire surface, followed by exposure and development, to form a phosphor layer that emits light in red, then, a green photosensitive luminescence crystal particle composition (green phosphor slurry) is applied to the entire surface, followed by exposure and development, to form a phosphor layer that emits light in green, and further a blue photosensitive luminescence crystal particle composition (blue phosphor slurry) is applied to the entire surface, followed by exposure and development, to form a phosphor layer that emits light in blue, although it shall not be limited thereto.

The phosphor material for constituting the luminescence crystal particles can be selected from conventionally known phosphor materials as required. In the case of displaying in color, it is preferred to combine phosphor materials whose color purities are close to three primary colors defined in NTSC, which attains a white balance when three primary colors are mixed, whose afterglow time period is small and which attains nearly equal afterglow time periods of the three primary colors. Examples of the phosphor material for constituting the phosphor layer that emits light in red include ($Y_2O_3$:Eu), ($Y_2O_2S$:Eu), ($Y_3Al_5O_{12}$:Eu), ($YBO_3$:Eu), ($YVO_4$:Eu), ($Y_2SiO_5$:Eu), ($Y_{0.96}P_{0.60}V_{0.40}O_4$:$Eu_{0.04}$), [(Y, Gd)$BO_3$:Eu], ($GdBO_3$:Eu), ($ScBO_3$:Eu), (3.5MgO.0.5$MgF_2$.$GeO_2$:Mn), ($Zn_3(PO_4)_2$:Mn), ($LuBO_3$:Eu) and ($SnO_2$:Eu). Examples of the phosphor material for constituting the phosphor layer that emits light in green include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb), ($Sr_4Si_3O_8Cl_4$:Eu), (ZnS:Cu,Al), (ZnS:Cu,Au,Al), ($ZnBaO_4$:Mn), ($GbBO_3$:Tb), ($Sr_6SiO_3Cl_3$:Eu), ($BaMgAl_{14}O_{23}$:Mn), ($ScBO_3$:Tb), ($Zn_2SiO_4$:Mn), (ZnO:Zn), ($Gd_2O_2S$:Tb) and ($ZnGa_2O_4$:Mn). Examples of the phosphor material for constituting the phosphor layer that emits light in blue include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu), ($Sr_2P_2O_7$:Sn), (ZnS:Ag, Al), (ZnS:Ag), ZnMgO and $ZnGaO_4$.

The material for constituting the anode electrode can be selected depending upon the constitution of the cold cathode field emission display. That is, when the cold cathode field emission display is a transmission type (the anode panel corresponds to a display screen), and when the anode electrode and the phosphor layer are stacked on the substrate in this order, not only the substrate on which the anode electrode is to be formed but also the anode electrode itself is required to be transparent, and a transparent electrically conductive material such as indium-tin oxide (ITO) is used. When the cold cathode field emission display is a reflection type (the cathode panel corresponds to a display screen), or when the cold cathode field emission display is a transmission type and the phosphor layer and the anode electrode are stacked on the substrate in this order, ITO can be used, and besides ITO, aluminum (Al) or chromium (Cr) is used for constituting the anode electrode. When the anode electrode is made of aluminum (Al) or chromium (Cr), for example, the specific thickness of the anode electrode is $3\times10^{-8}$ m (30 nm) to $1.5\times10^{-7}$ m (150 nm), preferably $5\times10^{-8}$ m (50 nm) to $1\times10^{-7}$ m (100 nm). The anode electrode can be formed by a vacuum vapor deposition method or a sputtering method.

Examples of the constitution of the anode electrode and the phosphor layer include (1) a constitution in which the anode electrode is formed on the substratum and the phosphor layer is formed on the anode electrode, and (2) a constitution in which the phosphor layer is formed on the substratum and the anode electrode is formed on the phosphor layer.

In the above constitution (1), a so-called metal back film which is in contact with the anode electrode may be formed on the phosphor layer, and in the above constitution (2), a metal back film may be formed on the anode electrode. Preferably, the partition wall is formed on the substratum. In the case of (1), the spacer holders or the partition wall are/is sometimes formed on the anode electrode. This case is also included in the concept that the spacer holders or the partition wall are/is formed on the substratum.

When a plurality of the partition walls are provided, there can be employed a constitution in which part of the plurality of the partition walls work as spacer holders, and in this case, the partition walls can be formed simultaneously (together) with the spacer holders. The spacer holders and the partition wall(s) can be also formed separately, and in this case, the plane form of the spacer holders can include the form of a circle as an example.

The plane form of the partition wall can include the form of a lattice (grid), that is, a form that surrounds a phosphor layer corresponding to one pixel and having a plane form of a nearly rectangle (in the form of a dot). The plane form of the partition wall can also include a band-shaped or stripe-shaped form that extends in parallel with two opposite sides of a nearly rectangular or stripe-shaped phosphor layer. When the partition wall has the form of a lattice, the form may be that which continuously encompasses the four sides of one phosphor layer region or that which discontinuously encompasses the four sides of one phosphor layer region. When the partition wall has a band-shaped form or a stripe-shaped form, the form may be a continuous form or may be a discontinuous form. After the partition wall is formed, the partition wall may be polished to flatten the top surface of the partition wall. The partition wall can be formed, for example, by the same method as the above-explained method of forming the spacer holders.

In the method for manufacturing a flat-type display, provided by the present invention including various aspects, when the flat-type display is a cold cathode field emission display, it is preferred from the viewpoint of an improvement in contrast of display images to include the step of a light-absorbing layer, which absorbs light from the phosphor layer, on the substratum in a region between phosphor layer and phosphor layer constituting the anode panel (in this region, for example, the spacer holders or the partition wall are/is formed). The above light-absorbing layer works as a so-called black matrix. As a material for constituting the light-absorbing layer, it is preferred to select a material that absorbs 99% or more of light from the phosphor layer. The above material includes carbon, a metal thin film (such as chromium, nickel, aluminum, molybdenum, etc., or alloys of these), and metal oxides (such as chromium oxide), metal nitrides (such as chromium nitride), a heat-resistant organic resin, glass paste and a glass paste containing electrically conductive particles of a black pigment, silver, or the like. Specific examples thereof include a photosensitive polyimide resin, chromium oxide and a chromium oxide/chromium stacked film. In the chromium oxide/chromium stacked film, the chromium film is in contact with the substratum. The light-absorbing layer can be formed, for example, by a combination of a vacuum vapor deposition method or a sputtering method with an etching method, a combination of a vacuum vapor deposition method, a sputtering method or a spin coating method with a lift-off method, a screen printing method, or a lithography technique, which are properly selected depending upon a material used. In the above case (1) and when the spacer holder or the partition wall are/is formed on the anode electrode, the light-absorbing layer may be formed between the substratum and the anode electrode, or it may be formed between the anode electrode and the spacer holders.

When the first panel and the second panel are bonded to each other in their circumferential portions, they may be bonded to each other using a bonding layer, or they may be bonded to each other using a combination of a frame formed of an insulating rigid material such as glass, ceramics, or the like with a bonding layer. When the frame and the bonding layer are used in combination, the facing distance of the first panel and the second panel can be increased so that the distance is longer than that attained when the bonding layer alone is used. As a material for constituting the bonding layer, a frit glass may be used or a low-melting-point metal material having a melting point of approximately 120 to 400° C. may be used as already described. Differing from a frit glass used in the state of a high-viscosity paste, the low-melting-point metal material does not trap gas foams in a layer when constituted as a bonding layer, and it is also excellent in dimensional accuracy with regard to the width and thickness of the bonding layer. When the bonding layer formed of the low-melting-point metal material is used, therefore, there can be prevented the vacuum-degree deterioration that is caused on the flat-type display with the passage of time by degassing or a bonding failure, and the flat-type display can be remarkably improved in performance and long-term reliability.

When the bonding layer is constituted from the low-melting-point metal material layer, it is required to form or arrange the bonding layer in a substrate for constituting the first panel (to be referred to as "substrate for the first panel"), a substrate for constituting the second panel (to be referred to as "substrate for the second panel") or the frame in advance. The above "forming" of the bonding layer refers to a state where the bonding layer adheres tightly to the surface of the substrate for the first panel, the substrate for the second panel or the frame due to interatomic forces. The above forming of the bonding layer can be accomplished, for example, by a vacuum thin film forming technique such as a vacuum vapor deposition method, a sputtering method, an ion plating method, or the like, or by once melting the bonding layer on the surface of the substrate for the first panel, the substrate for the second panel or the frame. Alternatively, the "arranging" of the bonding layer refers to a state where the bonding layer is held on the surface of the substrate for the first panel, the substrate for the second panel or the frame due to gravitational force or frictional force. The "arranging" of the bonding layer can be accomplished by placing or attaching a wire material or foil formed of the low-melting-point metal material on/to the surface of the substrate for the first panel, the substrate for the second panel or the frame. When there is used a bonding layer that can be held on the surface of the substrate for the first panel, the substrate for the second panel or the frame, since it has adhesiveness like a foil and that does not come off even if the holding surface is turned downward in some cases, then the bonding layers can be also arranged both on the substrate for the first panel and the substrate for the second panel, both on the substrate for the first panel and the frame, or both on the substrate for the second panel and the frame. However, when there is used a bonding layer that is held on the surface of the substrate for the first panel, the substrate for the second panel or the frame like a wire material, then preferably, the bonding layer is arranged on one of the substrate for the first panel and the substrate for the second panel, on one of the substrate for the first panel and the frame, or on one of the substrate for the second panel and the frame.

When the three members such as the first panel, the second panel and the frame are bonded, these three members may be bonded at the same time, or one of the first panel and the second panel and the frame may be bonded to each other in a first stage, and the other of the first panel and the second panel and the frame may be bonded to each other in a second stage. As a material for constituting the bonding layer for use in the first stage and a material for constituting the bonding layer in the second stage, the same material may be used, materials of the same kinds may be used, or materials of different kinds may be used. That is, there may be employed a constitution in which the bonding layer for use in the first stage (to be referred to as "first bonding layer") is formed of a low-melting-point metal material, and the melting point of the low-melting-point metal material for constituting the first bonding layer and the melting point of the low-melting-point metal material for constituting the bonding layer for use in the second stage (to be referred to as "second bonding layer") are about the same (for example, these melting points are different by approximately 0° C. to 100° C.). When the above constitution is employed, bonding of the first panel and the frame and bonding of the second panel and the frame can be carried out simultaneously, so that a residual thermal strain in the flat-type display produced can be decreased. Alternatively, there may be also employed a constitution in which the first bonding layer is formed of a low-melting-point metal material, and the melting point of the low-melting-point metal material for constituting the first bonding layer is higher than the melting point of a low-melting-point metal material for constituting the second bonding layer. When the above constitution is employed, bonding of the first panel and the frame and bonding of the second panel and the frame can be carried out in independent heating processes, so that a flat-type display produced can be improved in assembly accuracy. Further, there may be employed a constitution in which the first bonding layer is formed from a frit glass (also called "glass paste"). The frit glass has a high insulation property that the low-melting-point metal material cannot be expected to have. Therefore, when the flat-type display is, for example, in accordance with a high-voltage specification and when a thin insulating film such as a passivation film or the like formed on the first panel or the second panel is hence not sufficient for an adequate insulation property, the constitution using a frit glass is remarkably effective. Alternatively, there may be also employed a constitution in which part of the first bonding layer is formed from a frit glass, and the remaining portion of the first bonding layer is formed of a low-melting-point metal material. In the first bonding layer, the portion formed of a frit glass and the remaining portion formed of a low-melting-point metal material may have any arrangement in a region where the first bonding layer is to be formed. For example, a plurality of "part"s may scattered in the remaining portion.

For example, when the first panel includes an electrode that is led out of the flat-type display, there can be employed a constitution in which only the circumferential portion of the electrode is coated with a frit glass. Further, when the first panel or the second panel includes an electrode that is led out of the flat-type display, an insulating film can be formed on the electrode, and the first bonding layer and the second bonding layer can be formed or arranged on the insulating film. In the above constitution, the first panel or the second panel includes the above insulating film. Alternatively, an insulating film (e.g., an oxide film of a material constituting the electrode) may be formed on that portion (surface) of the electrode which is in contact with the first bonding layer or the second bonding layer.

When bonding of the three members or bonding at the second stage is carried out in a high-vacuum atmosphere, a space surrounded by the first panel, the second panel, the frame and the adhesive layer comes to be a vacuum space upon bonding. Otherwise, after the three members are bonded, the space surrounded by the first panel, the second panel, the frame and the adhesive layer may be vacuumed to obtain a vacuum space. When the vacuuming is carried out after the bonding, the pressure in an atmosphere during the bonding may be any one of atmospheric pressure and reduced pressure, and the gas constituting the atmosphere may be ambient atmosphere or an inert gas containing nitrogen gas or a gas (for example, Ar gas) coming under the group 0 of the periodic table.

The bonding is usually carried out by heating, and the heating can be carried out by a known heating method such as heating using a lump, a heater, a laser or a hot air furnace.

When the bonding is followed by discharging of a gas, the discharging can be carried out through a chip tube pre-connected to the first panel and/or the second panel. The chip tube is, typically, constituted from a glass tube, it is bonded to a circumferential portion of a perforated portion provided in the ineffective field of the first panel and/or the second panel with a frit glass or the above low-melting-point metal material, and after the space reaches a predetermined vacuum degree, it is sealed off by heat fusion. Before the above sealing off, preferably, the entire flat-type display is once heated and temperature-decreased, since a residual gas can be released into the space and the residual gas can be discharged out of the space. When a cold cathode field emission display is intended as a flat-type display, the vacuum degree required is in the order of approximately $10^{-2}$ Pa or higher (that is, a lower pressure).

When the three members, the first panel, the second panel and the frame, are bonded, or when the first panel and the second panel are bonded without the frame, the low-melting-point metal material layer fixing the spacer in the first panel effective field may be re-melted. However, the spacer is already arranged between the first panel effective field and the second panel effective field which work as a display portion, and the spacer is no longer in any freely movable state, so that there is caused no substantial problem.

When the bonding layer is constituted from a low-melting-point metal material, then desirably, the low-melting-point metal material is excellent in wettability to the substrate for the first panel, the substrate for the second panel or the frame. When the above condition of wettability is not satisfied, then preferably, a wettability-improving layer is formed on the substrate for the first panel, the substrate for the second panel or the frame. When the low-melting-point metal material has poor wettability to the surface of the substrate for the first panel, the surface of the substrate for the second panel or the surface of the frame, the above wettability-improving layer may be formed. As a result, the low-melting-point metal material is constricting on the wettability-improving layer in a self-aligning manner upon completion of the final bonding after heating due to the surface tension of the low-melting-point metal material, so that even if the accuracy of positioning the wettability-improving layer and the bonding layer is not so high before the heating, there can nevertheless be obtained the merit of the wettability-improving layer and the bonding layer being finally positioned accurately. As a material for constituting the wettability-improving layer, examples of the material include titanium (Ti), nickel (Ni) and copper oxide (CuO). It is sufficient that the wettability-improving layer should have a thickness of about 0.1 μm. When a natural oxide film tends to grow on the surface of the wettability-improving layer, then suitably, the natural oxide film is removed from the surface of the wettability-improving layer immediately before the bonding layer, the first bonding layer or the second bonding layer is formed. The natural oxide film can be removed by a known method such as an etching method, an ultrasonic wave application method, or the like. As a method for forming the wettability-improving layer, examples of the method include vacuum thin film forming techniques such as a vacuum vapor method, a sputtering method, an ion plating method, etc., and a plating method.

When the bonding layer is constituted from a low-melting-point metal material, and when a natural oxide film tends to grow on the surface of the bonding layer, the first bonding layer or the second bonding layer, it is preferable to remove the natural oxide film from the bonding layer surface immediately before the heating-applied bonding. The natural oxide film can be removed by a known method such as a wet etching method using diluted hydrochloric acid, a dry etching method using a chlorine-containing gas, an ultrasonic wave application method, or the like.

Each of the substrate for the first panel, the substrate for the second panel, the substrate (supporting member) for constituting the cathode panel and the substrate (substratum) for constituting the anode panel can be any substrate so long as the surface thereof is constituted at least from an insulating member, and they include a glass substrate, a glass substrate having an insulating film formed on its surface, a quartz substrate, a quartz substrate having an insulating film formed on its surface and a semiconductor substrate having an insulating film formed on its surface. From the viewpoint of decreasing a production cost, it is preferred to use a glass substrate or a glass substrate having an insulating film formed on its surface.

In the present invention, since the spacer is fixed to the first panel effective field and/or the second panel effective field with the low-melting-point metal material layer, the tilting or falling of the spacer in the process of producing a flat-type display can be reliably prevented, and the present invention is free from the problems wherein a gas is released from a material fixing the spacer in various heat-treatment steps in the process of producing a flat-type display and wherein the material fixing the spacer is thermally deteriorated.

BRIEF DESCRIPTION OF DRAWINGS

Following FIG. 7(D), FIGS. 8(A) to 8(C) are schematic partial end views of the substratum, etc., for explaining the method for producing the anode panel in Example 1.

Following FIG. 13(B), FIGS. 14(A) and 14(B) are schematic partial end views of the supporting member, etc., for explaining the method for manufacturing the Spindt type cold cathode field emission device.

Following FIG. 15(B), FIGS. 16(A) and 16(B) are schematic partial end views of the supporting member, etc., for explaining the method for manufacturing the plane type cold cathode field emission device (No. 1).

BEST MODE FOR CARRYING OUT THE INVENTION

The present invention will be explained on the basis of Examples and with reference to the drawings.

Example 1

Example 1 is directed to the flat-type display of the present invention, and more specifically, to the flat-type display according to the first-C aspect ("case 22" in Table 1). Further, it is directed to the method for manufacturing a flat-type display, provided according to the first aspect of the present invention, and more specifically, to the method for manufacturing a flat-type display, provided according to each of the first-A and first-B aspects of the present invention ("case 42" in Table 2). In Example 1, the flat-type display is a cold cathode field emission display (to be simply abbreviated as "display" hereinafter).

Figure 1:
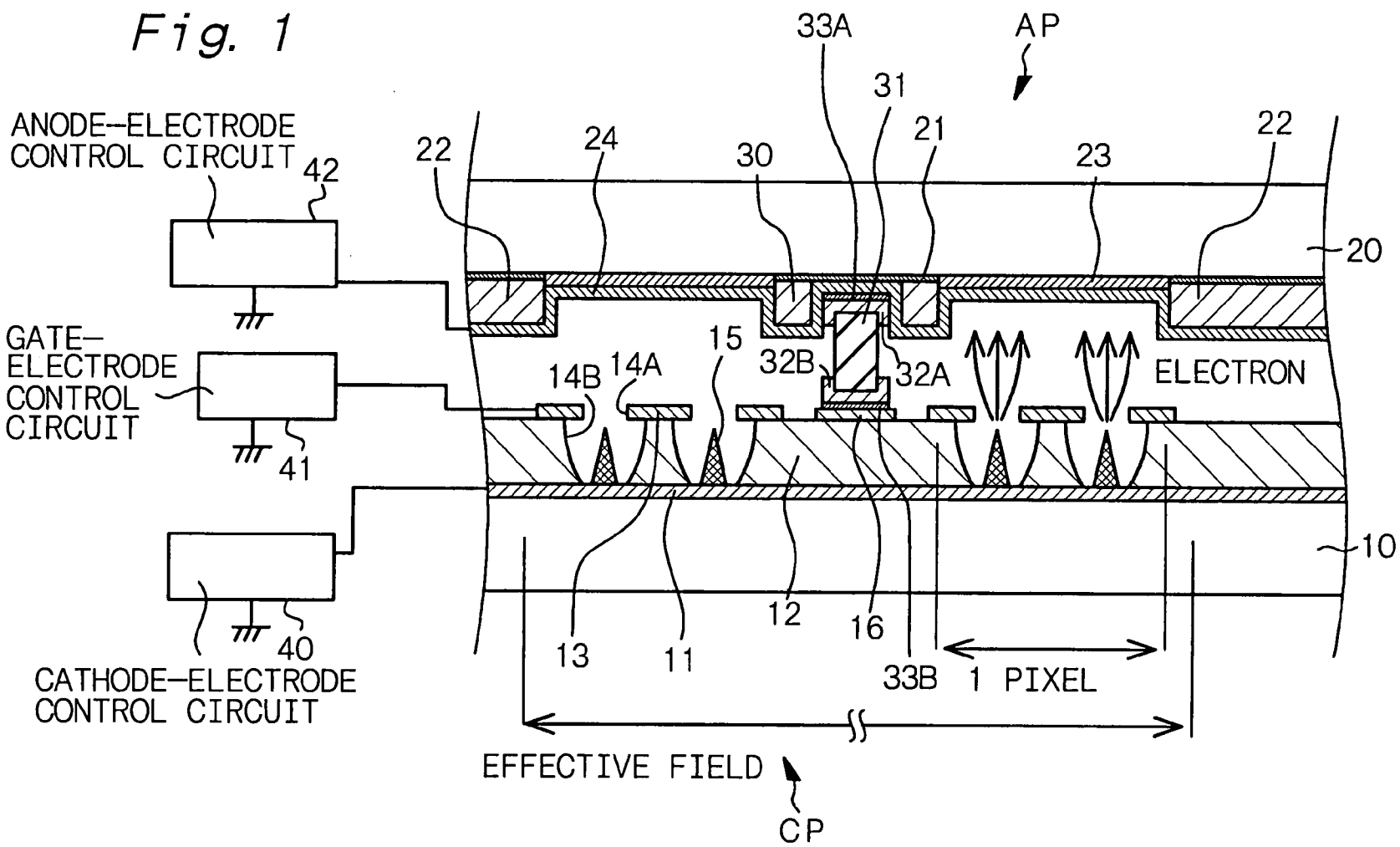
FIG. 1 is a schematic partial end view of a cold cathode field emission display that is a flat-type display in Example 1.
Figure 2:
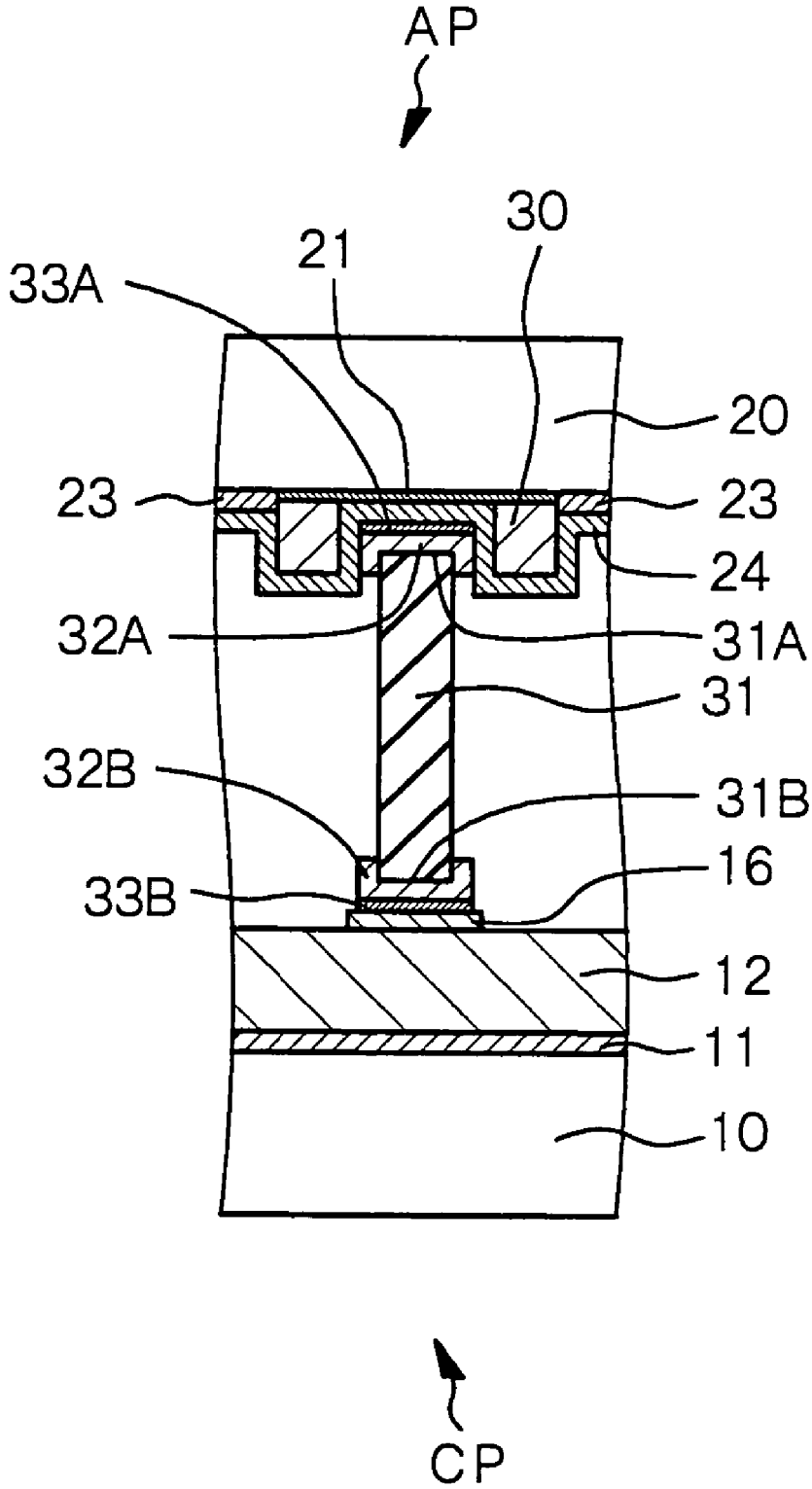
FIG. 2 is an enlarged schematic end view of part of the cold cathode field emission display that is the flat-type display in Example 1.
Figure 3:
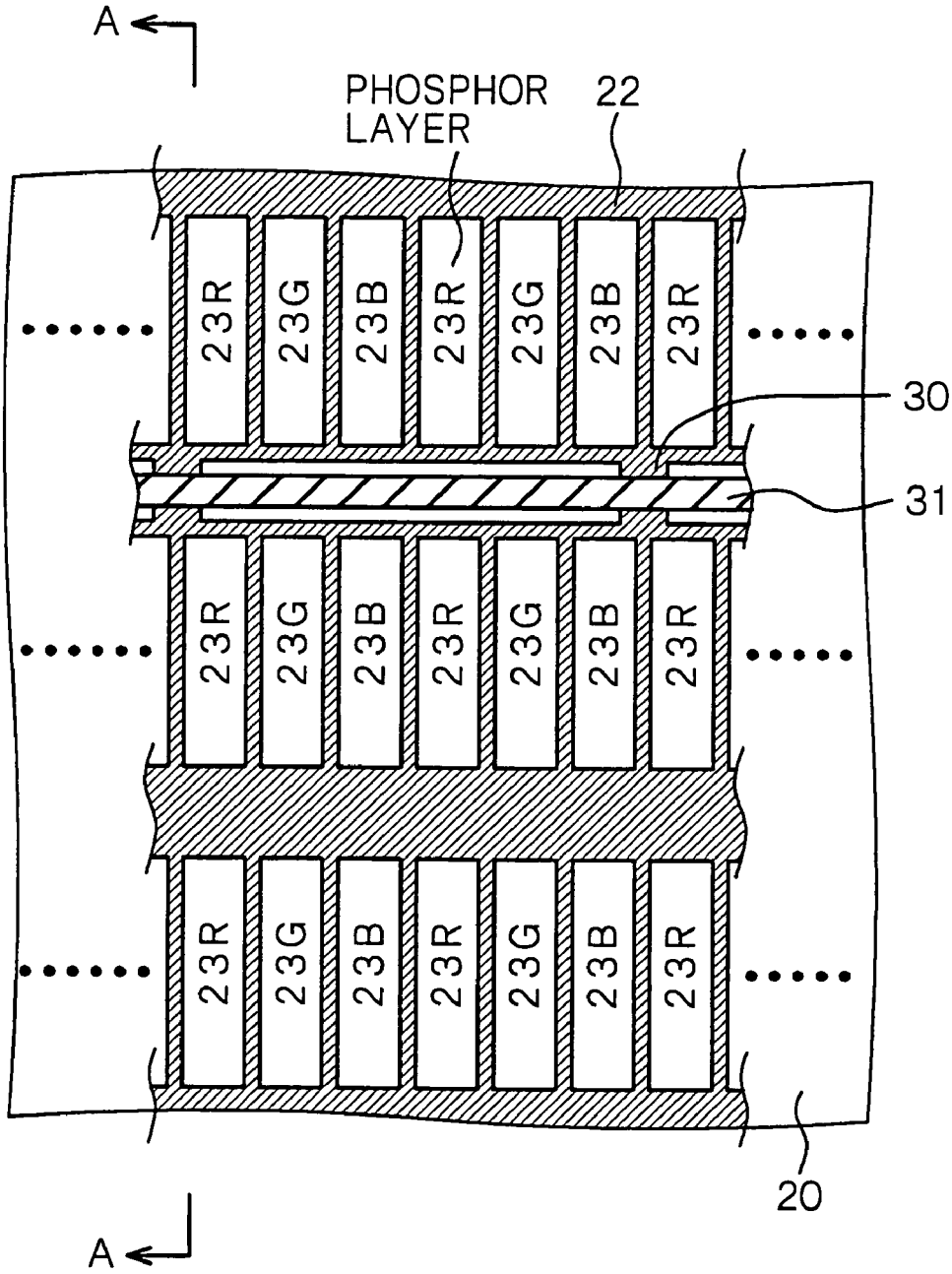
FIG. 3 is a schematic layout drawing of layout of a partition wall, spacer holders, a spacer and a phosphor layer in an anode panel constituting the cold cathode field emission display that is the flat-type display in Example 1.
Figure 4:
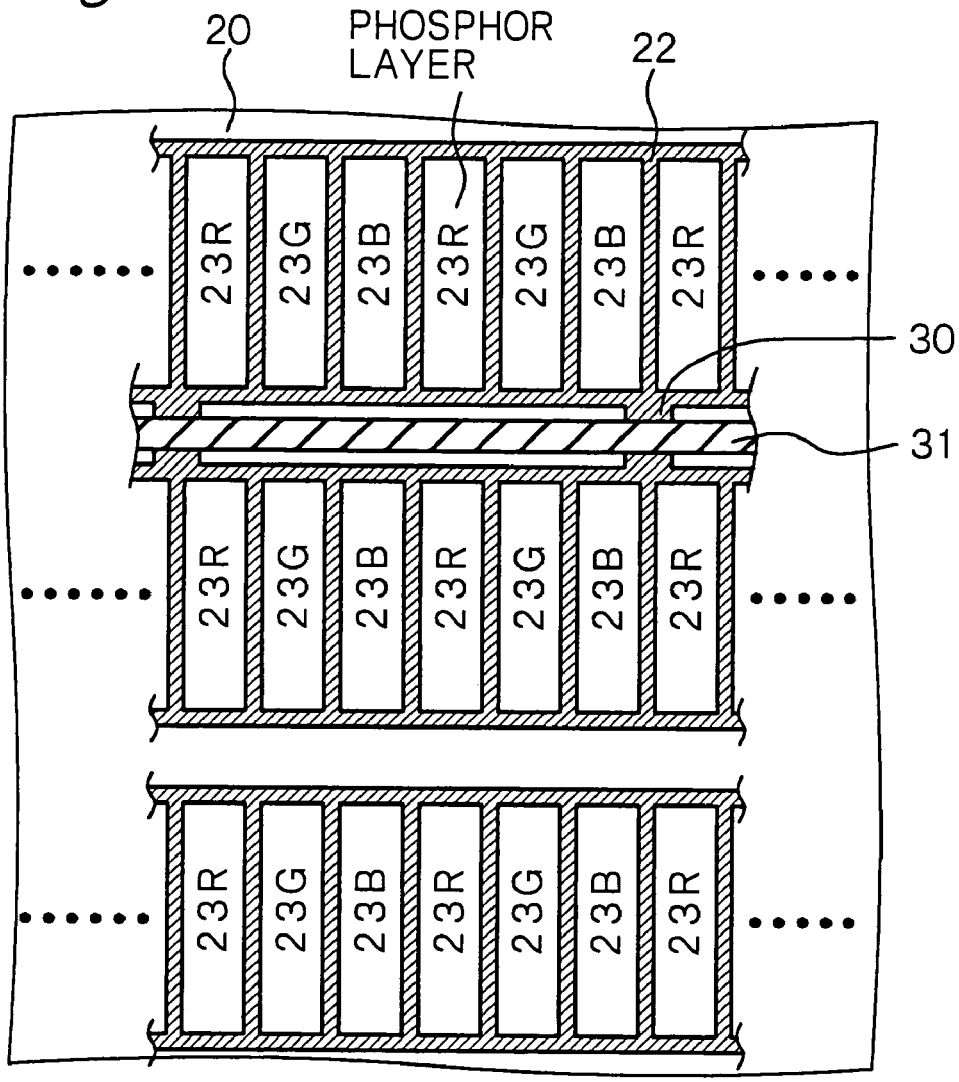
FIG. 4 is a schematic layout drawing of variant of the layout of a partition wall, spacer holders, a spacer and a phosphor layer in an anode panel constituting the cold cathode field emission display that is the flat-type display in Example 1.
Figure 5:
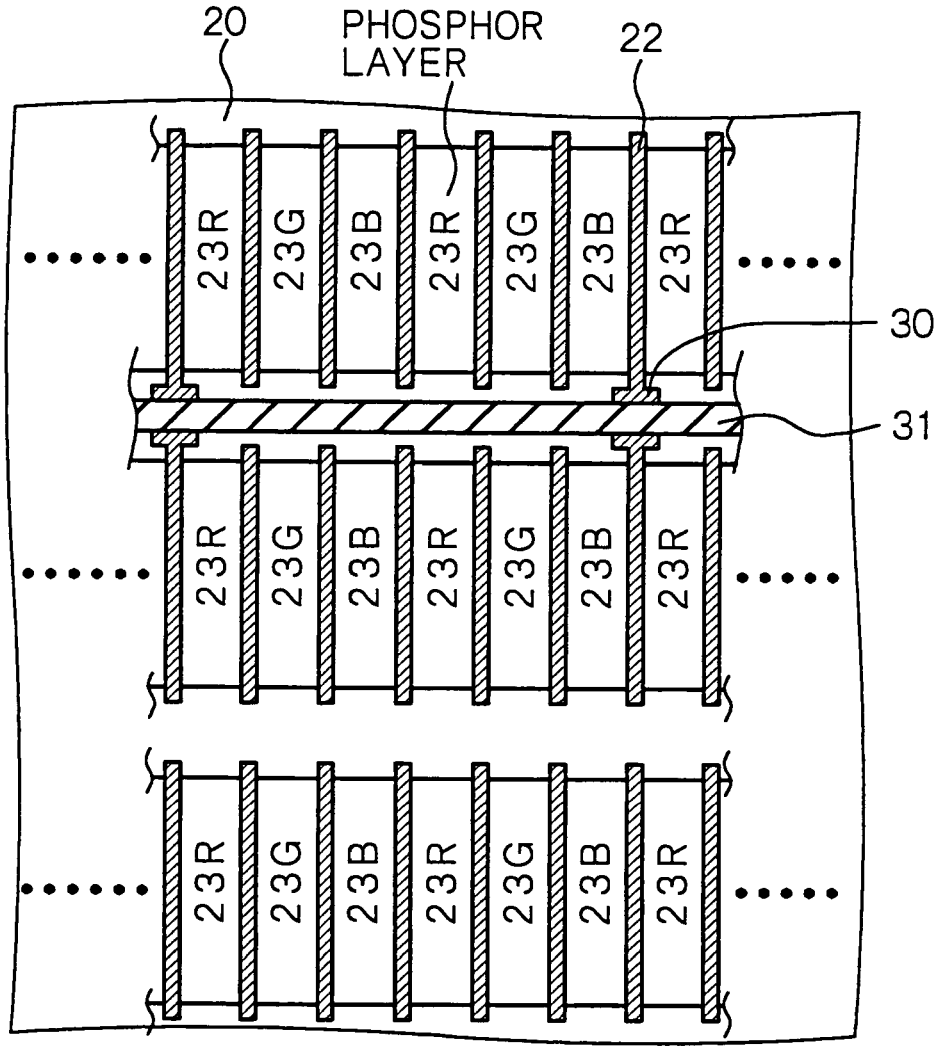
FIG. 5 is a schematic layout drawing of another variant of the layout of a partition wall, spacer holders, a spacer and a phosphor layer in an anode panel constituting the cold cathode field emission display that is the flat-type display in Example 1.
Figure 6:
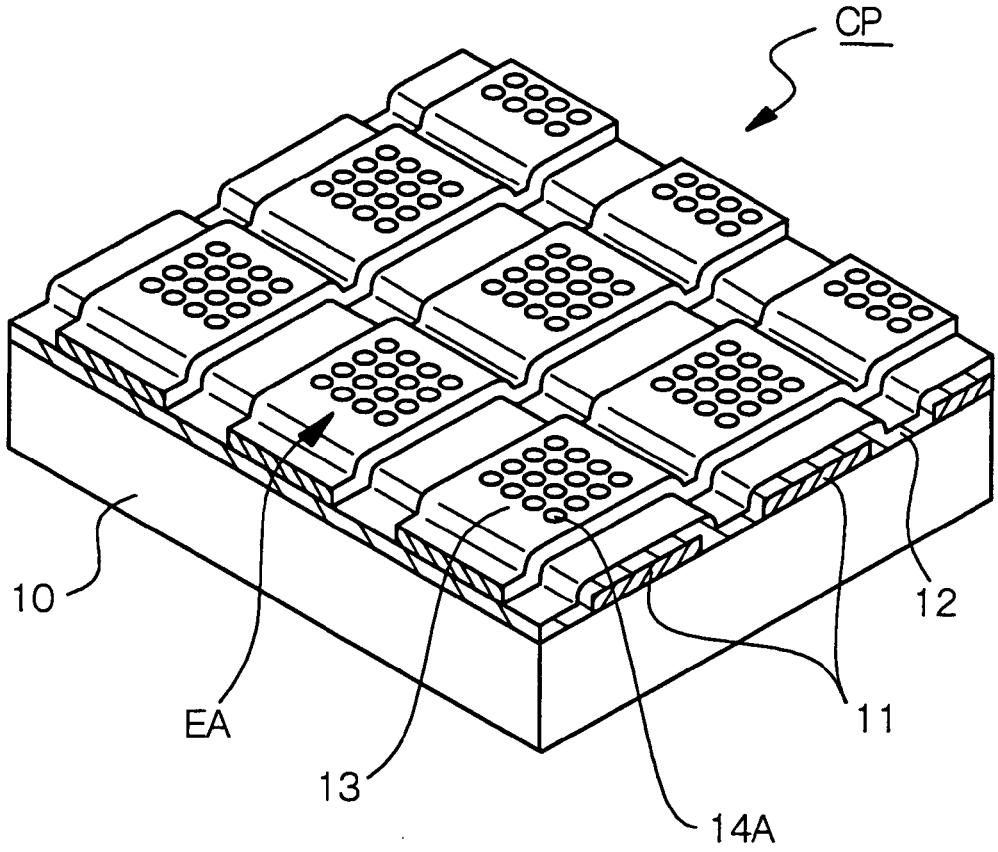
FIG. 6 is a partial perspective view of a cathode panel constituting the cold cathode field emission display that is the flat-type display in Example 1.

FIG. 1 shows a schematic partial end view of the display (so-called three-electrode type display) of Example 1, FIG. 2 shows an enlarged schematic end view of part of the display, FIGS. 3 to 5 show layout drawings schematically showing layouts of partition walls 22 and phosphor layers 23 in an anode panel AP constituting the display, and FIG. 6 shows a schematic partial perspective view of a cathode panel CP. FIG. 1 corresponds to an end view, for example, which is taken along line A-A in FIG. 3.

In the display of Example 1, the first panel (anode panel AP) and the second panel (cathode panel CP) are bonded to each other in their circumferential portions, and a space interposed between the first panel (anode panel AP) and the second panel (cathode panel CP) is in a vacuum state. In the anode panel AP, an anode electrode and a phosphor layer are formed, and in the cathode panel CP, a plurality of cold cathode field emission devices (to be abbreviated as "field emission devices" hereinafter) are formed.

The anode panel AP is constituted, for example, of a substratum 20 formed of a glass substrate, a phosphor layer 23 (in a color display, a phosphor layer 23R that emits light in red, a phosphor layer 23G that emits light in green and a phosphor layer 23B that emits light in blue) that is formed on the substratum 20 and has a predetermined pattern, and an anode electrode 24 that is formed thereon, works as a reflection film and is formed of an aluminum thin film. Partition walls 22 are formed on the substratum 20, and the phosphor layer 23 is formed on that portion of the substratum which is between partition wall 22 and partition wall 22. The anode electrode 24 is formed on the entire first panel effective field while ranging from a portion on the phosphor layer 23 to portions on the partition walls 22. In the anode panel AP shown in FIG. 1, a light-absorbing layer (black matrix) 21 for absorbing light from the phosphor layer 23 is formed between the partition wall 22 and the substratum 20. The light-absorbing layer 21 is formed of a chromium oxide/chromium stacked film.

A field emission device formed in the cathode panel CP of the display shown in FIG. 1 is a so-called Spindt type field emission device having a conical electron emitting portion 15. The field emission device is constituted of a cathode electrode 11 formed on a supporting member 10, an insulating layer 12 formed on the supporting member 10 and the cathode electrode 11, a gate electrode 13 formed on the insulating layer 12, an opening portion 14 made through the gate electrode 13 and the insulating layer 12 (a first opening portion 14A made through the gate electrode 13 and a second opening portion 14B made through the insulating layer 12), and a conical electron emitting portion 15 formed on the cathode electrode 11 positioned in the bottom of the opening portion 14. Generally, the cathode electrode 11 and the gate electrode 13 are formed in the form of stripes in the directions in which projection images of these two electrodes cross each other at right angles, and generally, a plurality of field emission devices are formed in a region corresponding to a portion where the projection images of these two electrodes overlap (the region corresponding to a region occupying one pixel and being an electron emitting region EA). Further, such electron emitting regions EA are generally arranged in a two-dimensional matrix in the effective field of the cathode panel CP.

Each pixel is constituted of the electron emitting region EA on the cathode panel side and the phosphor layer 23 that faces the electron emitting region EA and is on the anode panel side. In the effective field, such pixels are arranged in the order of hundreds of thousands to several millions.

A spacer 31 formed of alumina ($Al_2O_3$) is disposed between the first panel effective field and the second panel effective field which work as a display portion, and the spacer 31 is fixed to the first panel effective field and the second panel effective field with a low-melting-point metal material layer 33A and a low-melting-point metal material layer 33B formed of $Sn_{60}$—$Zn_{40}$ (melting point 200 to 250° C.). More specifically, one surface 31A of the spacer 31 is fixed onto the anode electrode 24 with the low-melting-point metal material layer 33A. The other surface 31B of the spacer 31 is fixed onto the electrically conductive layer 16 having the form of a stripe with a low-melting-point metal material layer 33B. The above electrically conductive layer 16 having the form of a stripe is formed on the insulating layer 12 and extends in parallel with the gate electrode 13 having the form of a stripe. Conductive material layers 32A and 32B made of titanium are formed so as to coat both the surfaces 31A and 31B of the spacer 31. FIG. 6 omits showing of the electrically conductive layer 16.

When the spacer 31 is cut with an imaginary plane at right angles with its longitudinal direction, the spacer 31 has a cross-sectional form of a long and narrow rectangle. Further, the spacer 31 has the form of a straight line along its longitudinal direction before it is fixed to the first panel effective field and the second panel effective field. The spacer 31 has a length of approximately 100 mm, a thickness of approximately 50 μm and a height of approximately 1 mm.

The spacer 31 can be produced by forming a so-called green sheet, firing the green sheet and cutting the thus-obtained green sheet fired product. Conductive material layers 32A and 32B made of Ti are formed so as to cover both surfaces 31A and 31B of the spacer 31, for example, by a sputtering method, and further, low-melting-point metal material layers 33A and 33B are formed on the conductive material layers 32A and 32B by a vacuum vapor deposition method.

A plurality of spacer holders for temporarily holding the spacer are formed in the first panel effective field that works as a display portion, and each group of the spacer holders is constituted of a plurality of spacer holders 30. That is, the plurality of the spacer holders 30 are provided to the anode panel AP that is the first panel. The plurality of spacer holders 30 constituting each group of the spacer holders are positioned on a nearly straight line. The spacer 31 is arranged (temporarily held) between the first panel effective field and the second panel effective field which work as a display portion with a plurality of the spacer holders 30 constituting the groups of the spacer holders. Specifically, the bottom portion of the spacer 31 is inserted between spacer holder 30 and spacer holder 30.

End portions of some of partition walls 22 have the form of letter "T", and a horizontal bar portion of the letter "T" corresponds to a spacer holder 30. The spacer holders 30 were formed at intervals of 1 mm. Further, each pair of the spacer holders 30 had a distance of 55 μm between them and a height of approximately 50 μm. Projection portions may be formed on end portions of some of the partition walls 22, and the spacer holders may be constituted of the projection portions. Further, separately from the partition walls 22, for example, bump-shaped spacer holders 30 may be formed, and this is also applicable to Examples to be described hereinafter.

FIGS. 3 to 5 schematically show arrangement states of the partition walls 22, the spacer holders 30, the spacer 31 and the phosphor layer 23 (23R, 23G, 23B). In FIGS. 3 to 5, the partition walls 22, the spacer holders 30 and the spacer 31 are provided with slanting lines for clearly showing them. In an example shown in FIG. 3 or FIG. 4, each partition wall 22 has the plane form of a lattice (grid). That is, it has a form in which it surrounds the phosphor layer 23 corresponding to one pixel and having a plane form, for example, of a substantial rectangle (dot form). On the other hand, in an example shown in FIG. 5, the partition wall 22 has the plane form of a band or stripe extending along two opposed sides of a substantially rectangular phosphor layer 23. In the example shown in FIG. 5, the partition wall 22 has a length of approximately 200 μm, a width (thickness) of approximately 25 μm and a height of approximately 50 μm. Further, the gap between partition wall 22 and partition wall 22 along the length direction thereof is approximately 100 μm, and the forming pitch of the partition walls 22 along the width (thickness) direction is approximately 110 μm. The horizontal bar portion of the letter "T" portion of the partition wall constituting the spacer holder 30 has a length of approximately 40 μm.

A relatively negative voltage is applied to the cathode electrode 11 from a cathode-electrode control circuit 40, a relatively positive voltage is applied to the gate electrode 13 from a gate-electrode control circuit 41, and a voltage far higher than the voltage to be applied to the gate electrode 13 is applied to the anode electrode 24 from an anode-electrode control circuit 42. When this display is used for display, for example, scanning signals are inputted to the cathode electrode 11 from the cathode-electrode control circuit 40, and video signals are inputted to the gate electrode 13 from the gate-electrode control circuit 41. Reversely thereto, video signals may be inputted to the cathode electrode 11 from the cathode-electrode control circuit 40, and scanning signals may be inputted to the gate electrode 13 from the gate-electrode control circuit 41. Due to an electric field generated when a voltage is applied between the cathode electrode 11 and the gate electrode 13, electrons are emitted from the electron emitting portion 15 on the basis of the quantum tunnel effect, and the electrons are drawn toward the anode electrode 24, pass the anode electrode 24 and collide with the phosphor layer 23. That is, the operation and brightness of this display are basically controlled by the voltage applied to the gate electrode 13 and the voltage applied to the electron emitting portion 15 through the cathode electrode 11.

One surface 31A of the spacer 31 is electrically connected to the anode electrode 24 through a conductive material layer 32A and a low-melting-point metal material layer 33A, so that a discharge between the one surface 31A of the spacer 31 and the anode electrode 24 can be prevented. On the other hand, the other surface 31B of the spacer 31 is electrically connected to an electrically conductive layer 16 through a low-melting-point metal material layer 33B and a conductive material layer 32B, so that a discharge between the other surface 31B of the spacer 31 and the electrically conductive layer 16 can be prevented. The electrically conductive layer 16 is grounded.

The method for manufacturing the display of Example 1 shown in FIGS. 1 and 3 will be explained below with reference to FIGS. 7(A) to 7(D) and FIGS. 8(A) to 8(C) showing schematic partial end views of a substratum constituting the anode panel AP or the substratum 20, and the like.

[Step-100]

First, the partition walls 22 and the spacer holders 30 are formed on the substratum 20 made of a glass substrate. Specifically, first, a resist layer is formed on the entire surface of the substratum 20, followed by exposure and development, to remove the resist layer on portions where the partition walls 22 and the spacer holders 30 are to be formed in the substratum 20. Then, a chromium film and a chromium oxide film are consecutively formed on the entire surface by a vacuum vapor deposition method, and then the resist layer and the chromium film and chromium oxide film on the resist layer are removed, In this manner, a light-absorbing layer 21 that works as a black matrix can be formed on the portion where the partition wall 22 and the spacer holders 30 are to be formed in the substratum 20 (see FIG. 7(A)).

[Step-110]

Figure 7A:
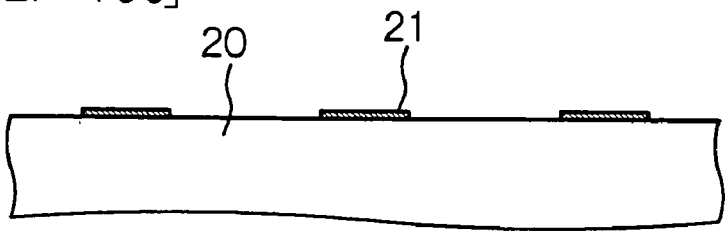
FIGS. 7(A) to 7(D) are schematic partial end views of a substratum, etc., for explaining the method for producing an anode panel in Example 1.
Figure 7B:
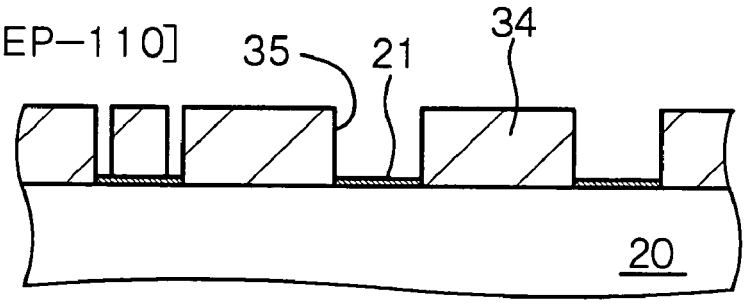
Figure 7C:
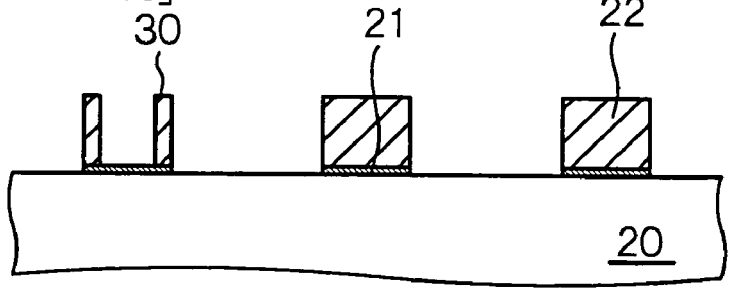
Figure 7D:
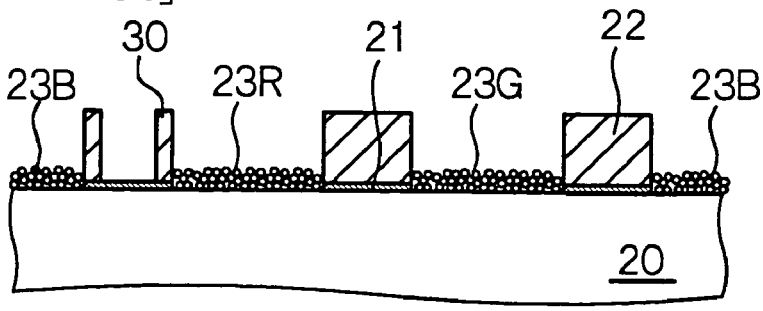

Then, an alkali-soluble photosensitive dry film having a thickness of 50 μm is stacked on the entire surface, specifically, on the substratum 20 and the light-absorbing layer 21, followed by exposure and development, to arrange a mask (photosensitive dry film 34) having an opening 35 on the substratum 20, so that portions (the light-absorbing layer 21) where the partition walls 22 and the spacer holders 30 are to be formed in the substratum 20 can be exposed (see FIG. 7(B)).

[Step-120]

Then, a thermally sprayable material made of chromium (Cr) (which is an electrically conductive thermally sprayable material) is thermally sprayed on the basis of a plasma spraying method, whereby the partition walls 22 and the spacer holders 30 formed of a thermal spray layer can be formed on the exposed portions of the substratum 20. Almost no thermally sprayable material is deposited on the photosensitive dry film 34. Then, before the photosensitive dry film 34 is removed, preferably, the partition walls 22 and the spacer holders 30 are polished to flatten the top surfaces of the partition walls 22 and the spacer holders 30. The polishing can be carried out by wet polishing using a polishing paper. Then, the photosensitive dry film 34 is removed, whereby a structure shown in FIG. 7(C) can be obtained. When the partition walls 22 are constituted from an electrically conductive thermally sprayable material, the partition walls 22 work as a kind of network-shaped or stripe-shaped wiring, and the anode electrode 24 can be easily isoelectrically controlled.

[Step-130]

Then, for forming a phosphor layer that emits light in red, phosphor particles that emit light in red are dispersed, for example, in polyvinyl alcohol (PVA) and water, ammonium bichromate is further added, and the thus-obtained phosphor slurry for emitting light in red is applied to the entire surface. Then, the above phosphor slurry for emitting light in red is dried, exposed and developed, to form phosphor layers 23R that emit light in red between predetermined partition walls 22. The above procedures are carried out with regard to a phosphor slurry for emitting light in green and a phosphor slurry for emitting light in blue, whereby the phosphor layers 23R that emit light in red, the phosphor layers 23G that emit light in green and phosphor layers 23B that emit light in blue are finally formed between predetermined partition walls 22 (see FIG. 7(D) and schematic partial layout drawings of FIGS. 3 to 5).

[Step-140]

Figure 8A:
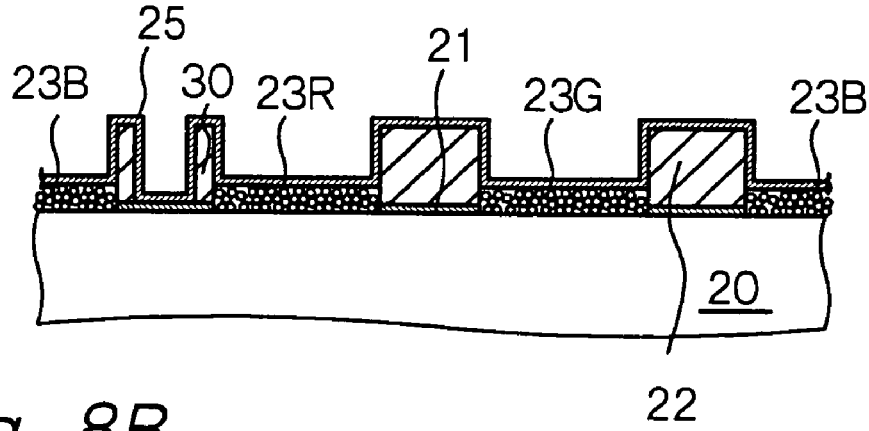

Then, on each phosphor layer 23 (phosphor layers 23R, 23G, 23B) is formed an intermediate film 25 formed of a lacquer constituted mainly from an acrylic resin (see FIG. 8(A)). Specifically, the substratum 20 having the phosphor layers 23 formed thereon is immersed in a water tank, a lacquer film is formed on the water surface, and the water in the tank is withdrawn, whereby the intermediate layer 25 formed of the lacquer can be formed all over on the phosphor layer 23, the partition walls 22 and the spacer holders 30. The hardness and elongation ratio of the lacquer film can be modified depending upon the amount of a plasticizer to be added to the lacquer and conditions to be employed when the lacquer film is formed on the water surface, and these are optimized, whereby the intermediate layer 25 can be formed all over on the phosphor layer 23, the partition walls 22 and the spacer holders 30. The lacquer for constituting the intermediate layer 25 includes a solution of a cellulose derivative, generally a formulated material containing nitrocellulose as a main component in a volatile solvent such as a lower fatty acid ester, which is a kind of varnish in a broad sense, a urethane lacquer containing a synthetic polymer and an acryl lacquer.

[Step-150]

Figure 8B:
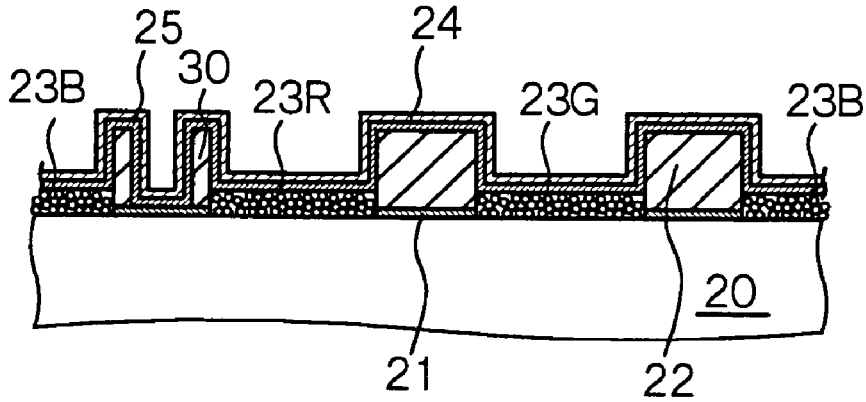
Figure 8C:
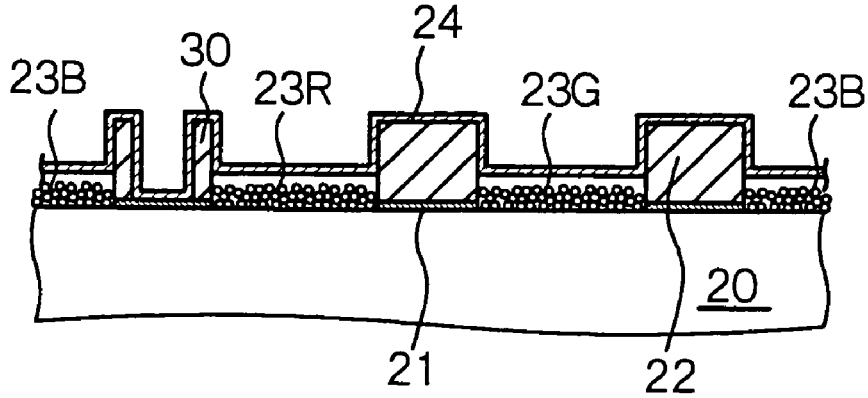

Then, the anode electrode 24 made of aluminum is formed on the entire surface by a vacuum vapor deposition method (see FIG. 8(B)). Finally, the intermediate layer 25 is fired by heat treatment at approximately 400° C., whereby an anode panel AP having a structure shown in FIG. 8(C) can be obtained.

[Step-160]

On the other hand, there is prepared a cathode panel CP having electron emitting regions EA constituted from a plurality of field emission devices. On an insulating layer 12 is formed an electrically conductive layer 16 having the form of a stripe and extending in parallel with the gate electrode 13 having the form of a stripe. The field emission device will be described in detail later. Then, the display is assembled.

[Step-160A]

That is, the spacer 31 having a low-melting-point metal material layer 33A formed on the other surface 31A thereof is arranged in the first panel effective field. Specifically, the bottom portion (portion of the surface 31A) of the spacer 31 is inserted between the spacer holders 30 formed in the anode electrode AP and temporarily held.

[Step-160B]

Then, the low-melting-point metal material layer 33A is heated to melt it, whereby the spacer 31 is fixed to the first panel effective field. Specifically, the substratum 20 is heated to approximately 200 to 250° C. in a hot air furnace. In this manner, the low-melting-point metal material layer 33A is melted, and after cooling, the spacer 31 can be fixed to the first panel effective field.

[Step-160C]

Then, the second panel (cathode panel CP) is placed on the other top surface 31B of the spacer 31, and then the first panel (anode panel AP) and the second panel (cathode panel CP) are bonded to each other in their circumferential portions. Specifically, a frit glass for a bonding layer is applied to bonding portions of the frame and cathode panel CP (more specifically, the supporting member 10) in advance, the cathode panel CP (more specifically, the supporting substrate 10) and the frame (not shown) are attached and the frit glass is dried by preliminary firing, and then regular firing is carried out at approximately 390° C. for 10 to 30 minutes beforehand. And, a frit glass for a bonding layer is applied to bonding portions of the frame and the anode panel AP (more specifically, the substratum 20), and the second panel (cathode panel CP) is placed on the other surface 31B of the spacer 31. In this case, the electrically conductive layer 16 formed in the cathode panel CP and the low-melting-point metal material layer 33B are brought into contact with each other, and the anode panel AP and the cathode panel CP are arranged such that the phosphor layer 23 and the electron emitting region EA face each other. Then, the frit glass is dried by preliminary firing, and regular firing is carried out at approximately 390° C. for 10 to 30 minutes. The low-melting-point metal material layer 33B is melted, and the other top surface 31B of the spacer 31 is fixed to the cathode panel CP (more specifically, the electrically conductive layer 16). On the other hand, the low-melting-point metal material layer 33A is re-melted. After it is cooled, however, it substantially retains the state it had before its re-melting. The state of the spacer 31 changes from a state where it is bonded to the first panel (anode panel AP) to a state where it is held with the spacer holders.

[Step-160D]

Then, the space surrounded by the anode panel AP, the cathode panel CP, the frame and the bonding layer is discharged through a through hole (not shown) and a chip tube (not shown), and when the pressure in the space reaches approximately $10^{-4}$ Pa, the chip tube is sealed off by heat-melting. In this manner, the space surrounded by the anode panel AP, the cathode panel CP and the frame can be vacuumed. Then, necessary wiring to external circuits is carried out, to complete a so-called three-electrode type display.

In [Step-120], the partition walls 22 and the spacer holders 30 may be formed by an electric plating method instead of forming the partition walls 22 and the spacer holders 30 by the thermal spraying method. In this case, the partition walls 22 and the spacer holders 30 made, for example, of nickel can be formed by an electric plating method using the light-absorbing layer 21 as a cathode for plating and using, for example, a nickel sulfamate solution. Further, an intermediate layer made of gold, silver or copper may be formed between the light-absorbing layer 21 and the partition walls 22 and between the light-absorbing layer 21 and the spacer holders 30. Alternatively, the partition walls 22 and the spacer holders 30 can be also formed by a screen printing method, a method using a dispenser, a sand blasting method, a dry film method or a photo-sensitive method.

Further, in [Step-160C], the frit glass can be replaced with a bonding layer made from a low-melting-point metal material to bond the first panel (anode panel AP) and the second panel (cathode panel CP) in their circumferential portions. Specifically, the circumferential portion of the second panel (cathode panel CP) and the frame are bonded in advance with a second bonding layer made from a low-melting-point metal material. And, the second panel (cathode panel CP) is placed on the other top surface 31B of the spacer 31, and the circumferential portion of the first panel (anode panel AP) and the frame are bonded with a first bonding layer made from a low-melting-point metal material. In Examples to be described hereinafter, similarly, a first panel and a second panel can be bonded to each other in their circumferential portions with a bonding layer made from a low-melting-point metal material in place of a frit glass. The low-melting-point metal material for constituting the low-melting-point metal material layer 33B and the first bonding layer is selected from low-melting-point metal materials having a lower melting point than any low-melting-point metal materials constituting the low-melting-point metal material layer 33A and the second bonding layer, and in this case, the re-melting of the low-melting-point metal material 33A and the second bonding layer can be suppressed when the circumferential portion of the first panel (anode panel AP) and the frame are bonded to each other.

The anode panel AP, the cathode panel CP and the frame are bonded together in a high vacuum atmosphere, or the anode panel AP and the frame are bonded together in a high vacuum atmosphere, and in this case, the space surrounded by the first panel (anode panel AP), the second panel (cathode panel CP), the frame and the bonding layer can be brought into a vacuum state at the same time. The same constitution may be employed in Examples to be described hereinafter.

When the anode panel AP is read as a second panel, and when the cathode panel CP is read as a first panel, a constitution corresponding to "Case 24" in Table 1 is obtained, and a constitution corresponding to "Case 44" in Table 2 is obtained.

The low-melting-point metal material layer 33B may not be formed on the other surface 31B of the spacer 31 which surface is opposed to the second panel (cathode panel CP). In this case, there are obtained a constitution corresponding to "Case 2" in Table 1 and a constitution corresponding to "Case 32" in Table 2. Further, when the anode panel AP is read as a second panel and when the cathode panel CP is read as a first panel, there is obtained a constitution corresponding to "Case 14" in Table 1.

Example 2

Figure 9:
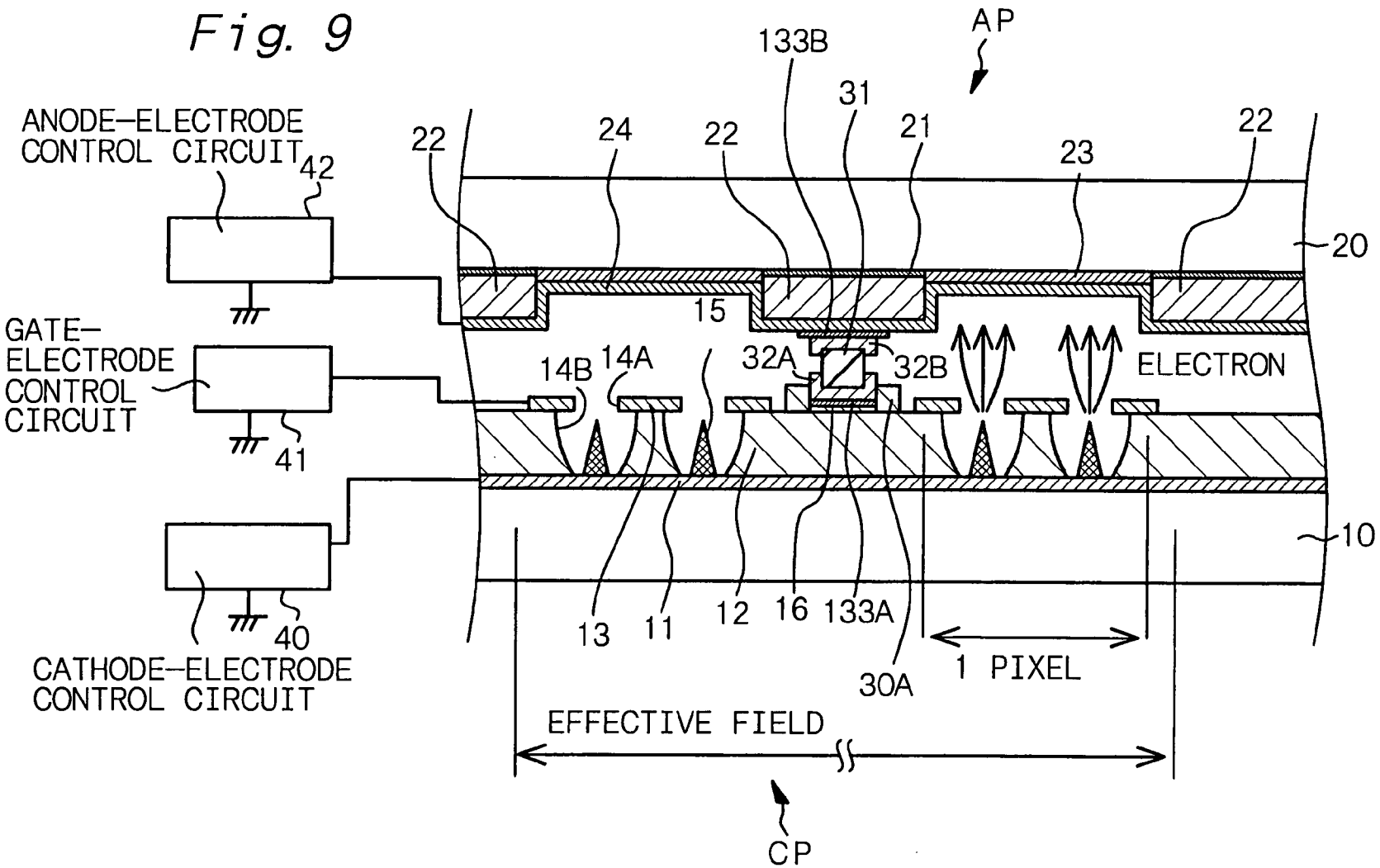
FIG. 9 is a schematic partial end view of a variant of a cold cathode field emission display that is a flat-type display in Example 2.
Figure 10:
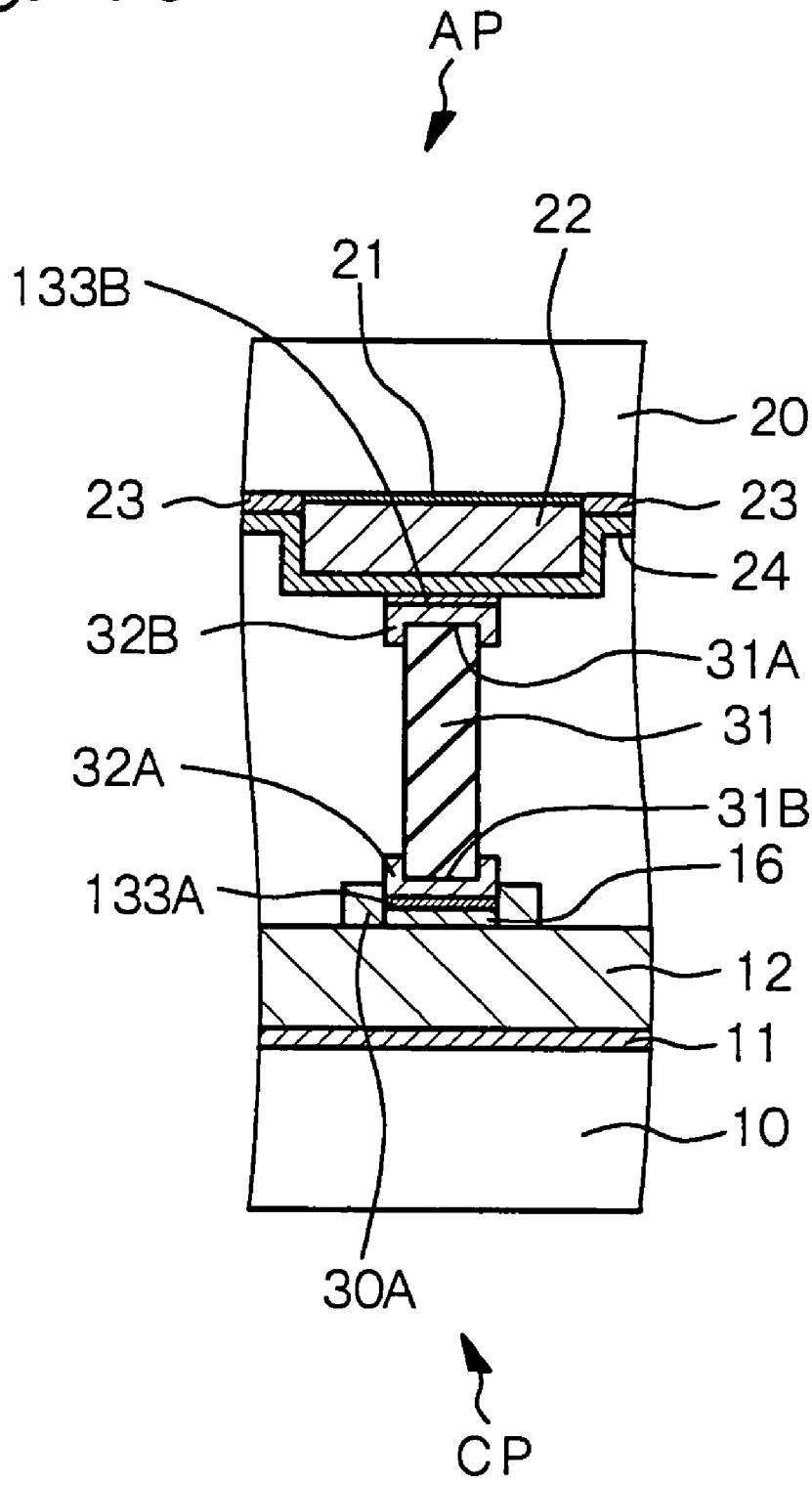
FIG. 10 is an enlarged schematic end view of part of the cold cathode field emission display that is the flat-type display in Example 2.

Example 2 is a variant of Example 1 and corresponds to "Case 22" in Table 1 and "Case 42" in Table 2 like Example 1. In Example 2, the spacer holders 30A for temporarily holding the spacer are formed on the cathode panel side. That is, the first panel is a cathode panel CP having a plurality of field emission devices formed thereon, and the second panel is an anode panel AP having the anode electrode 24 and the phosphor layer 23 formed thereon. FIG. 9 shows a schematic partial end view of a display having the above constitution in Example 2, and FIG. 10 shows an enlarged schematic end view of part of the display. FIG. 9 corresponds to an end view taken along arrows A-A in FIG. 3.

The cathode panel CP having the above structure can be manufactured by the following method.

That is, the field emission devices are formed on a supporting member 10 corresponding to the substratum. The method for manufacturing the field emission devices will be described in detail later. In addition thereto, an electrically conductive layer 16 having the form of a stripe and extending in parallel with the gate electrode 13 having the form of a stripe is formed on an insulating layer 12 in advance. The electrically conductive layer 16 having the form of a stripe is formed such that it is positioned between a pair of spacer holders 30A to be formed thereafter.

Then, an alkali-soluble photosensitive dry film having a thickness of 50 μm is stacked on the entire surface, followed by exposure and development, whereby a mask (photosensitive dry film) having an opening is placed on the insulating layer 12, and portions where the spacer holders 30A are to be formed in the insulating layer 12 are exposed. Then, a thermally sprayable material made of chromium (Cr) (which is an electrically conductive thermally sprayable material) is sprayed on the basis of a plasma spraying method, whereby the spacer holders 30A formed of a thermally sprayed layer can be formed in exposed portions of the insulating layer 12. Almost no thermally sprayable material is deposited on the photosensitive dry film. Before the photosensitive dry film is removed, preferably, the spacer holders 30A are polished to flatten the top surfaces of the space holders 30A. The polishing can be carried out by wet polishing using a polishing paper. Then, the photosensitive dry film is removed, and a structure shown in Tables 9 and 10 can be thereby obtained. Alternatively, the spacer holders 30A can be formed by a plating method in place of forming the spacer holders 30A by the thermal spraying method. In this case, the spacer holders 30A made, for example, of nickel can be formed by an electroless plating method or an electric plating method. Alternatively, the spacer holders 30A can be also formed by a screen printing method, a method using a dispenser, a dry film method or a photo-sensitive method.

In Example 2, a step similar to [Step-160A] in Example 1 is employed, and in the step, a spacer 31 having a low-melting-point metal material layer 33A formed on the surface 31A thereof is arranged on the first panel effective field. Specifically, a bottom portion (part of the surface 31A) of the spacer 31 is inserted between the spacer holders 30A formed in the cathode panel CP and temporarily held. The low-melting-point metal material layer 33A comes into a state where it is in contact with the electrically conductive layer 16.

Then, in the same manner as in [Step-160B] of Example 1, the low-melting-point metal material layer 33A is melted under heat to fix the spacer 31 to the first panel effective field. Then, in the same manner as in [Step-160C] of Example 1, the second panel (anode panel AP) is placed on the other surface 31B of the spacer 31, and then the first panel (cathode panel CP) and the second panel (anode panel AP) are bonded to each other in their circumferential portions. When the second panel (anode panel AP) is placed on the other surface 31B of the spacer 31, the anode electrode 24 formed on the anode panel AP and the low-melting-point metal material layer 33B are brought into contact with each other, and the anode panel AP and the cathode panel CP are arranged such that the phosphor layer 23 and the electron emitting region EA are opposed to each other. And, the anode panel AP and the cathode panel CP (more specifically, a substratum 20 and a supporting member 10) are bonded to each other in their circumferential portions through a frame (not shown).

Then, in the same manner as in [Step-160D] of Example 1, the space surrounded by the anode panel AP, the cathode panel CP, the frame and the bonding layer is discharged through a through hole (not shown) and a chip tube (not shown), and when the pressure in the space reaches approximately $10^{-4}$ Pa, the chip tube is sealed off by heat-melting. In this manner, the space surrounded by the anode panel AP, the cathode panel CP and the frame can be vacuumed. Then, necessary wiring to external circuits is carried out, to complete a so-called three-electrode type display.

When the cathode panel CP is read as a second panel, and when the anode panel AP is read as a first panel, there is obtained a constitution corresponding to "Case 24" in Table 1 and there is obtained a constitution corresponding to "Case 44" in Table 2.

The low-melting-point metal material layer 33B may not be formed on the other surface 31B of the spacer 31 which surface is opposed to the second panel (anode panel AP). In this case, there are obtained a constitution corresponding to "Case 2" in Table 1 and a constitution corresponding to "Case 32" in Table 2. Further, when the cathode panel CP is read as a second panel and when the anode panel AP is read as a first panel, there is obtained a constitution corresponding to "Case 14" in Table 1.

The spacer holders 30 shown in FIG. 1 and the spacer holders 30A shown in FIG. 9 may be combined. That is, the spacer holders 30 are formed in the first panel (anode panel AP), the spacer holders 30A are formed in the second panel (cathode panel CP) and the low-melting-point metal material layers 33A and 33B are formed on both surfaces 31A and 31B of the spacer 31, and in this case, there are obtained a constitution corresponding to "Case 23" in Table 1 and a constitution corresponding to "Case 43" in Table 2. Alternatively, the spacer holders 30A are formed in the first panel (cathode panel CP), the spacer holders 30 are formed in the second panel (anode panel AP) and the low-melting-point metal material layers 33A and 33B are formed on both surfaces 31A and 31B of the spacer 31, and in this case, there are obtained a constitution corresponding to "Case 23" in Table 1 and a constitution corresponding to "Case 43" in Table 2. In these cases, further, the low-melting-point metal material layer 33B may not be formed on the other surface 31B of the spacer 31 which surface is opposed to the second panel (cathode panel CP or anode panel AP), and in this case, there are obtained constitutions corresponding to "Case 3" in Table 1 and "Case 33" in Table 2. Further, when the cathode panel CP is read as a second panel, and when the anode panel AP is read as a first panel, there is obtained a constitution corresponding to "Case 13" in Table 1.

Example 3

Example 3 is also a variant of Example 1, and more specifically, it is directed to a flat-type display according to the first constitution ("Case 1" in Table 1) and is also directed to the method for manufacturing a flat-type display, provided according to the first aspect of the present invention ("Case 31" in Table 2).

In Example 3, a low-melting-point metal material layer 33A is formed on one surface 31A of the spacer 31 which surface is opposed to the first panel (anode panel AP), but no low-melting-point metal material layer 33B is formed on the other surface 31B of the spacer 31 which surface is opposed to the second panel (cathode panel CP). In Example 3, further, neither partition walls nor spacer holders for temporarily holding the spacer are formed in the first panel (anode panel AP). Except for these points, the display in Example 3 can be structured so as to be the same as that of the display in Example 1, so that detailed explanations thereof will be omitted. Further, the method for manufacturing the anode panel AP can be the same as the method for manufacturing the anode panel AP, explained in Example 1, except that neither partition walls nor spacer holders are formed, so that detailed explanations thereof will be omitted.

In Example 3, in a step similar to [Step-160] of Example 1, first, the spacer 31 is caused to stand in a predetermined position of the first panel (anode panel AP) by means of a positioning unit such as a microscope and a robot, a vacuum adsorption apparatus, or the like. In a state where the spacer 31 is held with the robot, vacuum adsorption apparatus, or the like, the low-melting-point metal material layer 33A formed on the surface 31A of the spacer 31 is melted by a heating method using a laser, a lump, a hot air heater, or the like, to fix the spacer 31 to the anode electrode 24 formed in the anode panel AP. This operation may be carried out one by one or altogether simultaneously with regard to the spacers. Then, steps similar to [Step-160C] and [Step-160D] of Example 1 are carried out, whereby a display can be obtained.

In the step similar to [Step-160C] of Example 1, the second panel (cathode panel CP) is placed on the other surface 31B of the spacer 31, and then the first panel (anode panel AP) and the second panel (cathode panel CP) are bonded to each other in their circumferential portions. In this case, the low-melting-point metal material layer 33A is re-melted, and the spacer 31 comes into a self-standing state from a state where it is bonded to the first panel (cathode panel AP). When an external force is exerted laterally, the spacer may fall down. However, there can be employed a method in which the first panel and the second panel do not move during the process, such as a method using a batch type oven, and no spacer 31 falls down.

When the cathode panel CP is read as a first panel, and when the anode panel AP is read as a second panel, there is obtained a constitution corresponding to "Case 11" in Table 1.

Further, the low-melting-point metal material layers 33A and 33B may be formed on both the surfaces 31A and 31B of the spacer 31 beforehand. In this case, there are obtained a constitution corresponding to "Case 21" in Table 1 and a constitution corresponding to "Case 41" in Table 2.

The anode panel AP (having no spacer holders) explained in Example 3 is employed as a first panel, the cathode panel CP (having spacer holders) explained in Example 2 is employed as a second panel, the low-melting-point metal material layer 33A is formed on one surface 31A of the spacer 31 which surface is opposed to the first panel (anode panel AP), and no low-melting-point metal material layer 33B is formed on the other surface 31B of the spacer 31 which surface is opposed to the second panel (cathode panel CP). In this case, there are obtained a constitution corresponding to "Case 4" in Table 1 and a constitution corresponding to "Case 34" in Table 2.

Further, the cathode panel CP (having no spacer holders) explained in Example 1 is employed as a first panel, the anode panel AP (having spacer holders) explained in Example 1 is employed as a second panel, the low-melting-point metal material layer 33A is formed on one surface 31A of the spacer 31 which surface is opposed to the first panel (cathode panel CP), and no low-melting-point metal material layer 33B is formed on the other surface 31B of the spacer 31 which surface is opposed to the second panel (anode panel AP). In this case, there are obtained a constitution corresponding to "Case 4" in Table 1 and a constitution corresponding to "Case 34" in Table 2.

On the other hand, the cathode panel CP (having spacer holders) explained in Example 2 is employed as a first panel, the anode panel AP (having no spacer holders) explained in Example 3 is employed as a second panel, no low-melting-point metal material layer is formed on one surface 31A of the spacer 31 which surface is opposed to the first panel (anode panel AP), and the low-melting-point metal material layer 33B is formed beforehand on the other surface 31B of the spacer 31 which surface is opposed to the second panel (cathode panel CP). In this case, there is obtained a constitution corresponding to "Case 12" in Table 1.

Further, the anode panel AP (having spacer holders) explained in Example 1 is employed as a first panel, the cathode panel CP (having no spacer holders) explained in Example 1 is employed as a second panel, no low-melting-point metal material layer is formed on one surface 31A of the spacer 31 which surface is opposed to the first panel (anode panel AP), and the low-melting-point metal material layer 33B is formed on the other top surface 31B of the spacer 31 which top surface is opposed to the second panel (cathode panel CP). In this case, there is obtained a constitution corresponding to "Case 12" in Table 1.

Example 4

Example 4 is concerned with the flat-type display of the present invention, more specifically to the flat-type display according to the first-C constitution ("Case 22" in Table 1), and it is further directed to the method for manufacturing a flat-type display, provided according to the second aspect of the present invention, more specifically to the method for manufacturing a flat-type display according to the first 2A and first 2B aspects of the present invention ("Case 62" in Table 2). In Example 4, the flat-type display is a cold cathode field emission display (display) as well.

The display of Example 4 (so-called three-electrode type display) is substantially structurally the same as that of the display explained in Example 1, so that detailed explanations thereof will be omitted.

Like Example 1, a spacer 31 made of alumina ($Al_2O_3$) is arranged between the first panel effective field and the second panel effective field which work as a display portion, and the spacer 31 is fixed to the first panel effective field and the second panel effective field with a low-melting-point metal material layer 133A and a low-melting-point metal material layer 133B made of $Sn_{60}$—$Zn_{40}$ (melting point 200 to 250° C.). More specifically, one surface 31A of the spacer 31 is fixed onto an anode electrode 24 with the low-melting-point metal material layer 133A, and the other surface 31B of the spacer 31 is fixed onto an electrically conductive layer 16 having the form of a stripe with the low-melting-point metal material layer 133B. The above electrically conductive layer 16 having the form of a stripe is formed on an insulating layer 12 and extends in parallel with a gate electrode 13 having the form of a stripe. Conductive material layers 32A and 32B made of titanium (Ti) are formed so as to coat both of the surfaces 31A and 31B of the spacer 31.

The spacer 31 can be produced by forming a so-called green sheet, firing the green sheet and cutting the thus-obtained green sheet fired product. The conductive material layers 32A and 32B made of Ti are formed so as to coat both the surfaces 31A and 31B of the spacer 31, for example, by a sputtering method.

The method for manufacturing a display in Example 4 shown in FIGS. 1 and 3 will be explained below.

[Step-400]

First, steps similar to [Step-100] to [Step-150] are carried out.

[Step-410]

Then, a low-melting-point metal material layer 133A is formed in a portion where the spacer 31 is to be fixed in the first panel effective field. Specifically, the low-melting-point metal material layer 133A can be formed in a portion where the spacer 31 is to be fixed in an anode electrode 24 by a vacuum vapor deposition method.

[Step-420]

On the other hand, there is prepared a cathode panel CP having electron emitting regions EA constituted of a plurality of field emission devices. On the insulating layer 12 is formed an electrically conductive layer 16 having the form of a stripe and extending in parallel with a gate electrode 13 having the form of a stripe. Further, the electrically conductive layer 16 has a low-melting-point metal material layer 133B formed thereon by a vacuum vapor deposition method. The field emission devices will be described in detail later. And, the display is assembled.

[Step-420A]

That is, the spacer 31 is arranged on the low-melting-point metal material layer 133A. Specifically, the bottom portion of the spacer 31 (part of the surface 31A) is inserted between spacer holders 30 for temporarily holding the spacer which spacer holders are formed in the anode panel AP, and temporarily held. The low-melting-point metal material layer 133A is formed between spacer holders 30, and the low-melting-point metal material layer 133A and the conductive material layer 32A are in a state where they are in contact with each other.

[Step-420B]

Then, the low-melting-point metal material layer 133A is melted under heat to fix the spacer 31 to the first panel effective field. Specifically, a substratum 20 is heated to approximately 200 to 250° C. with a hot air furnace. By the above procedures, the low-melting-point metal material layer 133A is melted, and then, the low-melting-point metal material layer 133A is cooled, whereby the spacer 31 can be fixed to the first panel effective field.

[Step-430]

Then, a step similar to [Step-160C] of Example 1 is carried out to place the second panel (cathode panel CP) on the other surface 31B of the spacer 31, and then the first panel (anode panel AP) and the second panel (cathode panel CP) are bonded to each other in their circumferential portions. Then, a step similar to [Step-160D] of Example 1 is carried out, to discharge the space surrounded by the anode panel AP, the cathode panel CP, the frame and the bonding layer through a through hole (not shown) and a chip tube (not shown), and when the pressure in the space reaches approximately $10^{-4}$ Pa, the chip tube is sealed off by heat-melting. In this manner, the space surrounded by the anode panel AP, the cathode panel CP and the frame can be vacuumed. Then, necessary wiring to external circuits is carried out, to complete a so-called three-electrode type display.

When the anode panel AP is read as a second panel and when the cathode panel CP is read as a first panel, there are obtained a constitution corresponding to "Case 24" in Table 1 and a constitution corresponding to "Case 64" in Table 2.

The low-melting-point metal material layer 133B may not be formed on that portion of the second panel (cathode panel CP) which is opposed to the other surface 31B of the spacer 31. In this case, there are obtained a constitution corresponding to "Case 2" in Table 1 and a constitution corresponding to "Case 52" in Table 2. Further, when the anode panel AP is read as a second panel and when the cathode panel CP is read as a first panel, there is obtained a constitution corresponding to "Case 14" in Table 1.

Example 5

Example 5 is a variant of Example 4, and like Example 4, Example 5 comes under "Case 22" in Table 1 and "Case 62" in Table 2. In Example 5, spacer holders 30A for temporarily holding the spacer are formed on the cathode panel side. That is, the first panel is a cathode panel CP having a plurality of field emission devices formed therein, and the second panel is an anode panel AP having an anode electrode 24 and a phosphor layer 23 formed therein. The thus-constituted display of Example 5 has substantially the same structure as the structure of the display of Example 2 shown in FIGS. 9 and 10.

The cathode panel CP having the above structure can be manufactured by the following method.

That is, first, field emission devices are formed on a supporting member 10 corresponding to the substratum. The method for manufacturing the field emission devices will be described in detail later. An electrically conductive layer 16 having the form of a stripe and extending in parallel with a gate electrode 13 having the form of a stripe is formed on the insulating layer 12 beforehand. The electrically conductive layer 16 having the form of a stripe is formed such that it is positioned between a pair of spacer holders 30A to be formed thereafter. Further, a low-melting-point metal material layer 133A is formed on the electrically conductive layer 16 beforehand by a vacuum vapor deposition method.

Then, an alkali-soluble photosensitive dry film having a thickness of 50 μm is stacked on the entire surface, followed by exposure and development, to arrange a mask (photosensitive dry film) having an opening on the insulating layer 12, and a portion where the spacer holders 30A are to be formed on the insulating layer 12 is exposed. Then, a thermally sprayable material made of chromium (Cr) (that is an electrically conductive thermally sprayable material) is thermally sprayed, for example, on the basis of a plasma spraying method, whereby the spacer holders 30A formed of the thermally sprayed layer can be formed on the exposed portion of the insulating layer 12. Almost no thermally sprayable material is deposited on the photosensitive dry film. Then, before the photosensitive dry film is removed, preferably, the spacer holders 30A are polished to flatten the top surfaces of the spacer holders 30A. The polishing can be carried out by wet polishing using a polishing paper. Then, the photosensitive dry film is removed. Alternatively, the spacer holders 30A can be also formed by a plating method instead of forming the spacer holders 30A by a thermal spraying method. In this case, the spacer holders 30A made, for example, of nickel can be formed by an electroless plating method and an electric plating method. Alternatively, the spacer holders 30A can be also formed by a screen printing method, a method using a dispenser, a dry film method or a photo-sensitive method.

In Example 5, in a step similar to [Step-420A] of Example 4, a spacer 31 is arranged on the first panel effective field. Specifically, the bottom portion of the spacer 31 (part of surface 31A) is inserted between the spacer holders 30A formed in the cathode panel CP and temporarily held. The low-melting-point metal material layer 133A and a conductive material layer 32A are in a state where they are in contact with each other.

Then, in the same manner as in [Step-420B] of Example 4, the low-melting-point metal material layer 133A is melted under heat to fix the spacer 31 to the first panel effective field.

Then, in the same manner as in [Step-430] of Example 4, the second panel (anode panel AP) is placed on the other surface 31B of the spacer 31, and then the first panel (cathode panel CP) and the second panel (anode panel AP) are bonded to each other in their circumferential portions. When the second panel (anode panel AP) is placed on the other surface 31B of the spacer 31, the anode electrode 24 formed in the anode panel AP and the low-melting-point metal material layer 133B are brought into contact with each other, and the anode panel AP and the cathode panel CP are arranged such that the phosphor layer 23 and the electron emitting region EA are opposed to each other. And, the anode panel AP and the cathode panel CP (more specifically, the substratum 20 and the supporting member 10) are bonded to each other through a frame (not shown) in their circumferential portions.

Then, in the same manner as in [Step-430] of Example 4, the space surrounded by the anode panel AP, the cathode panel CP, the frame and the bonding layer is discharged through a through hole (not shown) and a chip tube (not shown), and when the pressure in the space reaches approximately $10^{-4}$ Pa, the chip tube is sealed off by heat-melting. In this manner, the space surrounded by the anode panel AP, the cathode panel CP and the frame can be vacuumed. Then, necessary wiring to external circuits is carried out, to complete a so-called three-electrode type display.

When the cathode panel CP is read as a second panel, and when the anode panel AP is read as a first panel, there are obtained a constitution corresponding to "Case 24" in Table 1 and a constitution corresponding to "Case 64" in Table 2.

The low-melting-point metal material layer 133B may not be formed on that portion of the second panel (anode panel AP) which is opposed to the other surface 31B of the spacer 31. In this case, there are obtained a constitution corresponding to "Case 2" in Table 1 and a constitution corresponding to "Case 52" in Table 2. In this case, further, when the cathode panel CP is read as a second panel and when the anode panel AP is read as a first panel, there is obtained a constitution corresponding to "Case 14" in Table 1.

The spacer holders 30 shown in FIG. 1 and the spacer holders 30A shown in FIG. 9 may be combined. That is, the spacer holders 30 are formed in the first panel (anode panel AP), the spacer holders 30A are formed in the second panel (cathode panel CP), and the low-melting-point metal material layers 133A and 133B are formed in portions where the spacer 31 is to be fixed in the first panel effective field and the second panel effective field. In this case, there are obtained a constitution corresponding to "Case 23" in Table 1 and a constitution corresponding to "Case 63" in Table 2. Alternatively, the spacer holders 30A are formed in the first panel (cathode panel CP), the spacer holders 30 are formed in the second panel (anode panel AP) and the low-melting-point metal material layers 133A and 133B are formed in portions where the spacer 31 is to be fixed in the first panel effective field and the second panel effective field. In this case, there is obtained a constitution corresponding to "Case 23" in Table 1 and a constitution corresponding to "Case 63" in Table 2. The low-melting-point metal material layer 133B may not be formed on a portion where the spacer 31 is to be fixed in the second panel effective field (part of the effective field of the cathode panel CP or the anode panel AP). In this case, there are obtained a constitution corresponding to "Case 3" in Table 1 and a constitution corresponding to "Case 53" in Table 2. Further, when the cathode panel CP or the anode panel AP is read as a second panel, and when the anode panel AP or the cathode panel CP is read as a first panel, there is obtained a constitution corresponding to "Case 13" in Table 1.

Example 6

Example 6 is also a variant of Example 4. More specifically, it is directed to the flat-type display according to the first constitution ("Case 1" in Table 1), and it is also directed to the method for manufacturing a flat-type display, provided according to the second aspect of the present invention (Case 51 in Table 2).

In Example 6, the low-melting-point metal material layer 133A is formed in that portion of the fist panel (anode panel AP) which is opposed to one surface 31A of the spacer 31, but the low-melting-point metal material layer 133B is not formed on that portion of the second panel (cathode panel CP) which is opposed to the other surface 31B of the spacer 31. In Example 6, further, the partition walls and the spacer holders for temporarily holding the spacer are not formed in the first panel (anode panel AP). Except for these points, the structure of the display of Example 6 can be the same as the structure of the display of Example 4, so that detailed explanations thereof will be omitted. Further, the method for manufacturing the anode panel AP can be the same as the method for manufacturing the anode panel AP explained in Example 1 except that the partition walls and the spacer holders are not formed, so that detailed explanations thereof will be omitted.

In Example 6, in a step similar to [Step-420A] of Example 4, first, the spacer 31 is caused to stand in a predetermined position of the first panel (anode panel AP) by means of a positioning unit such as a microscope and a robot, a vacuum adsorption apparatus, or the like. In a state where the spacer 31 is held with the robot, vacuum adsorption apparatus, or the like, the low-melting-point metal material layer 133A formed in the first panel effective field is melted by a heating method using a laser, a lump, a hot air heater, or the like, to fix the spacer 31 to the anode electrode 24 formed in the anode panel AP. This operation may be carried out one by one or altogether simultaneously with regard to all of the spacers. Then, steps similar to [Step-420B] and [Step-430] of Example 4 are carried out, whereby a display can be obtained.

When the cathode panel CP is read as a first panel and when the anode panel AP is read as a second panel, there is obtained a constitution corresponding to "Case 11" in Table 1.

The low-melting-point metal material layers 133A and 133B may be formed in portions where the spacer 31 is to be fixed in the first panel effective field and the second panel effective field. In this case, there are obtained a constitution corresponding to "Case 21" in Table 1 and a constitution corresponding to "Case 61" in Table 2.

The anode panel AP (having no spacer holders) explained in Example 6 is employed as a first panel, the cathode panel CP (having the spacer holders) explained in Example 5 is employed as a second panel, the low-melting-point metal material layer 133A is formed beforehand in a portion where the spacer 31 is to be fixed in the first panel effective field, and the low-melting-point metal material layer 133B is not formed in a portion where the spacer is to be fixed in the second panel effective field. In this case, there are obtained a constitution corresponding to "Case 4" in Table 1 and a constitution corresponding to "Case 54" in Table 2.

The cathode panel CP (having no spacer holders) explained in Example 4 is used as a first panel, the anode panel AP (having spacer holders) explained in Example 4 is used as a second panel, the low-melting-point metal material layer 133A is formed beforehand in a portion where the spacer is to be fixed in the first panel effective field, and the low-melting-point metal material layer 133B is not formed in a portion where the spacer is to be fixed in the second panel effective field. In this case, there are obtained a constitution corresponding to "Case 4" in Table 1 and a constitution corresponding to "Case 54" in Table 2.

On the other hand, the cathode panel CP (having spacer holders) explained in Example 5 is used as a first panel, the anode panel AP (having no spacer holders) explained in Example 6 is used as a second panel, the low-melting-point metal material layer is not formed in a portion where the spacer 31 is to be fixed in the first panel effective field, and the low-melting-point metal material layer 133B is formed in a portion where the spacer 31 is to be fixed in the second panel effective field. In this case, there is obtained a constitution corresponding to "Case 12" in Table 1.

Further, the anode panel AP (having spacer holders) explained in Example 4 is used as a first panel, the cathode panel CP (having no spacer holders) explained in Example 4 is used as a second panel, the low-melting-point metal material layer is not formed in a portion where the spacer 31 is to be formed in the first panel effective field, and the low-melting-point metal material layer 133B is formed in a portion where the spacer 31 is to be fixed in the second panel effective field. In this case, there is obtained a constitution corresponding to "Case 12" in Table 1.

Example 7

In Example 7, various variants of the spacer and the spacer holders will be explained.

Figure 11A:
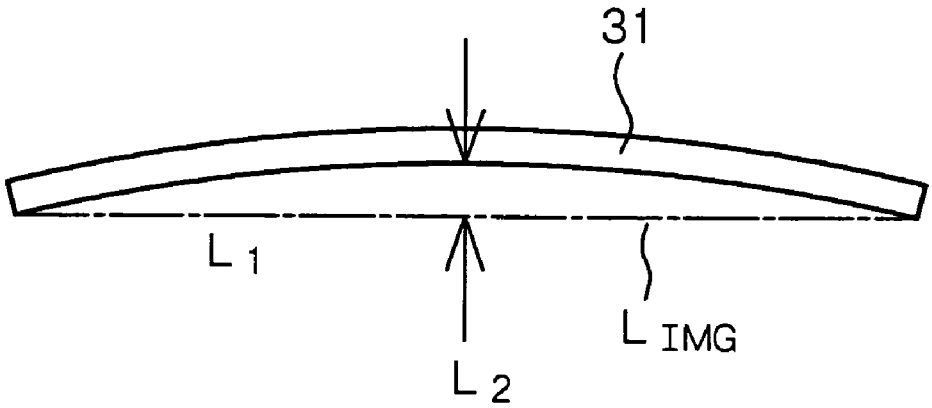
FIGS. 11(A), 11(B) and 11(C) are a schematic drawing obtained by viewing a spacer from the side of a top surface, a schematic drawing of layout of spacer holders, and a drawing schematically showing a state where the spacer is held with the spacer holders in Example 7.
Figure 11B:
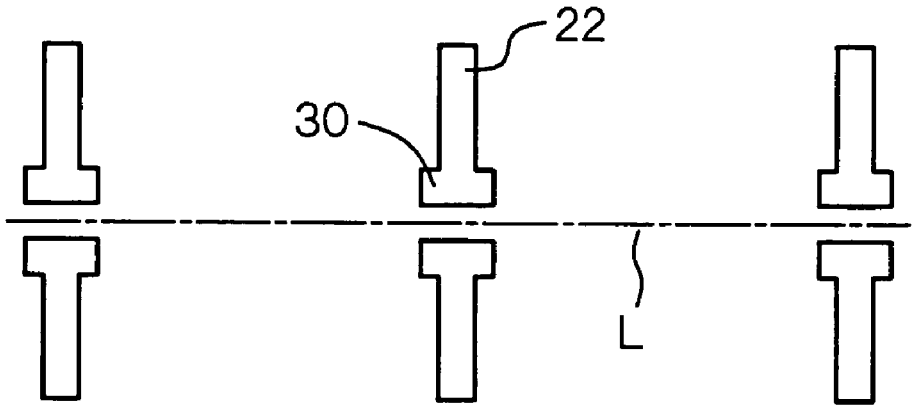
Figure 11C:
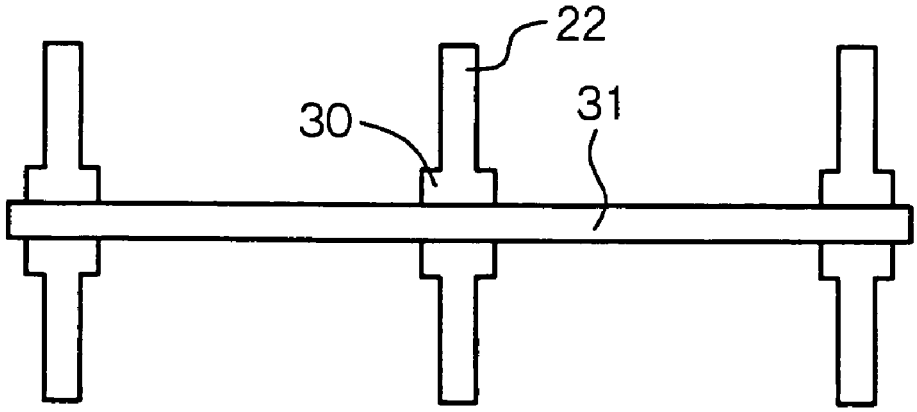

In an example having a schematic drawing of FIG. 11(A) obtained by viewing the spacer 31 from its top surface side, having a schematic drawing of FIG. 11(B) showing the layout of the spacer holders 30 and having a schematic drawing of FIG. 11(C) showing a state where the spacer 31 is held with the spacer holders 30, a plurality of the spacer holders 30 constituting each group of the spacer holders are positioned on a straight line L (see FIG. 11(B)). Further, the spacer 31 held with a plurality of the spacer holders 30 in the group of spacer holders is arranged between the second panel effective field and the first panel effective field which work as a display portion. Specifically, the bottom portion (top surface) of the spacer 31 is inserted between spacer holder 30 and spacer holder 30. And, as shown in FIG. 11(A), the spacer 31 is curbed along its longitudinal direction before it is arranged between the first panel effective field and the second panel effective field. In the example shown in FIGS. 11(B) and 11(C), there is shown a state where the group of spacer holders is constituted of three spacer holders 30, and the spacer 31 is held with the three spacer holder 30. However, the number of the spacer holders 30 for holding the spacer 31 (or the number of the spacer holders constituting the group of spacer holders) is not limited to three.

In the spacer 31 before it was arranged between the first panel effective field and the second panel effective field, the distance $L_2$ from an imaginary line $L_{IMG}$ connecting both ends of the spacer 31 to the central portion of the spacer 31 was determined to be 0.3 mm. Further, in the spacer before it was arranged between the first panel effective field and the second panel effective field, it was determined that $5\times 10^{-4}L_1=L_2$ in which $L_1$ was a distance between both ends of the spacer and $L_2$ was a distance from an imaginary line connecting both ends of the spacer to the central portion of the spacer. Further, the spacer 31 had a length of 100 mm, a thickness of 50 μm and a height of 1 mm. When the spacer 31 is cut with an imaginary plane at right angles with its longitudinal direction, the spacer 31 has a cross-sectional form of a long and narrow rectangle.

The spacer 31 is constituted of ceramics made of alumina. The spacer 31 can be produced by forming a so-called green sheet, firing the green sheet and cutting the resultant green sheet fired product. Before or after the green sheet fired product is cut, both surfaces of the green sheet fired product are polished to make the surface roughness of one side surface of the spacer 31 different from the surface roughness of the other side surface, whereby a curved state can be obtained. Alternatively, a strain-generating layer made, for example, of $Si_3N_4$ may be formed on one surface of the green sheet fired product before or after it is cut. The method of forming the strain-generating layer includes a known PVD method and CVD method.

Figure 12A:
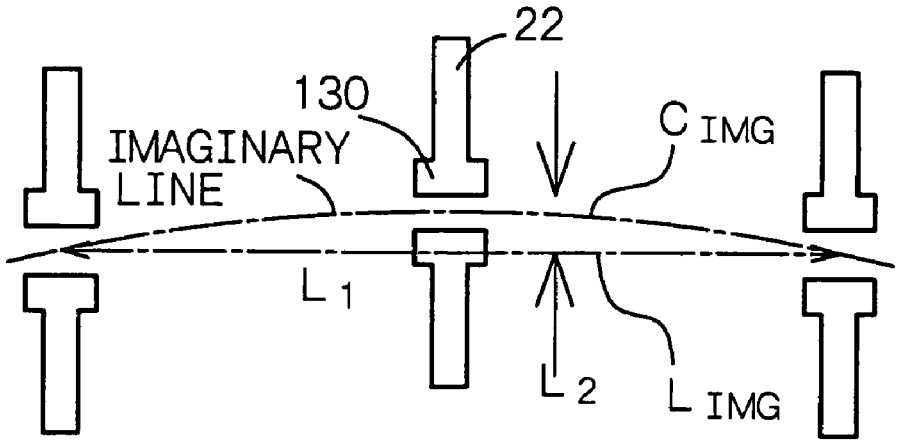
FIG. 12(A) and 12(B) are a drawing schematically showing a layout of spacer holders and a drawing schematically showing a state where a spacer is held with the spacer holders in a variant of Example 7.
Figure 12B:
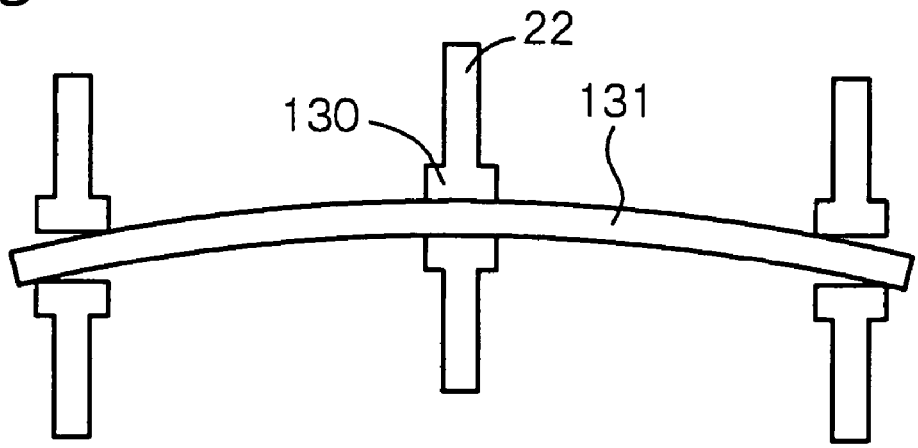

FIGS. 12(A) and 12(B) show another variant example of the spacer and spacer holders. FIG. 12(A) schematically shows the layout of spacer holders 130, and FIG. 12(B) schematically shows a state where the spacer 131 is held with the spacer holders 130. In FIGS. 12(A) and 12(B), a group of the spacer holders is constituted of three spacer holders 130, and the spacer 131 is held with these three spacer holders 130. However, the number of the spacer holders 130 for holding the spacer 131 (or the number of the spacer holders constituting the group of spacer holders) is not limited to three. In this example, a plurality of the spacer holders 130 constituting each group of spacer holders are not positioned on a straight line, as is shown in FIG. 12(A).

The spacer 131 held with the plurality of the spacer holders 130 in the group of spacer holders are arranged between the second panel effective field and the first panel effective field which work as a display portion. Specifically, the bottom portion of the spacer 131 is inserted between spacer holder 130 and spacer holder 130. Before the spacer 131 is arranged between the first panel effective field and the second panel effective field, the spacer 131 may be curved along its longitudinal direction (see FIG. 11(A)), or may not be curved.

End portions of some of partition walls 22 have the form of a letter "T", and the horizontal bar portion of the letter "T" corresponds to spacer holder 130. The spacer holders 130 were provided at intervals of 1 mm along an imaginary line $L_{IMG}$. Further, the distance between each pair of the spacer holders 130 was 55 μm, and the spacer holders 130 had a height of approximately 50 μm. There may be employed a constitution in which some of the partition walls 22 are provided with projection portions, and the spacer holders are constituted from these projection portions. Further, the spacer holders 130 may be formed separately from the partition walls 22. The distance $L_2$ from the imaginary line $L_{IMG}$ connecting spacer holders positioned at one end of the group of the spacer holders and spacer holders positioned at the other end of the group of the spacer holder to the central portion of an imaginary line (first imaginary line) $C_{IMG}$ connecting a plurality of the spacer holders constituting the above group of the spacer holders was determined to be 50 μm.

The spacer 131 is constituted of ceramics made of alumina. The spacer 131 can be produced by forming a so-called green sheet, firing the green sheet and cutting the resultant green sheet fired product. Before or after the green sheet fired product is cut, both surfaces of the green sheet fired product may be polished to make the surface roughness of one side surface of the spacer 31 different from the surface roughness of the other side surface, to obtain a curved state. Alternatively, a strain-generating layer made, for example, of $Si_3N_4$ may be formed on one surface of the green sheet fired product before or after it is cut. The method of forming the strain-generating layer includes a known PVD method and CVD method. In these cases, however, the spacer before held with the group of spacer holders is required to have a curved state that is directionally opposite to the curved state of the first imaginary line $C_{IMG}$ connecting a plurality of the spacer holders constituting the group of spacer holders formed in the first panel effective field. Alternatively, the spacer before held with a group of the spacer holders may have the form of a straight line along its longitudinal direction.

The spacer 131 was determined to have a length of 100 mm, a thickness of 50 μm and a height of 1 mm. When the spacer 131 was cut with an imaginary plane at right angles with its longitudinal direction, the spacer 131 had the cross-sectional form of a long and narrow rectangle. In the spacer 131 that was arranged between the first panel effective field and the second panel effective field, the distance from the imaginary line connecting both ends of the spacer 131 to the central portion of the spacer 131 was 50 μm. Alternatively, In the spacer 131 that was arranged between the first panel effective field and the second panel effective field, $L_2=5\times10^{-4}L_1$ in which $L_1$ was a distance between both ends of the spacer 131 and $L_2$ was a distance from the imaginary line connecting both end of the spacer 131 to the central portion of the spacer 131.

Example 8

In Example 8, various field emission devices and methods for manufacturing them will be explained.

A field emission device constituting a so-called three-electrodes-type cold cathode field emission display can be specifically classified, for example, into the following two categories depending upon the structure of the electron-emitting portion. That is, a field emission device having a first structure comprises;

(A) a stripe-shaped cathode electrode which is formed on a supporting member and extends in a first direction, (B) an insulating layer formed on the supporting member and the cathode electrode, (C) a stripe-shaped gate electrode which is formed on the insulating layer and extends in a second direction different from the first direction, (D) a first opening portion formed in the gate electrode and a second opening portion formed in the insulating layer and communicating with the first opening portion, and (E) an electron-emitting portion formed on the cathode electrode positioned in the bottom portion of the second opening portion, and said field emission device has a structure in which the electron-emitting portion exposed in the bottom portion of the second opening portion is for emitting electrons.

The field emission device having the above first structure includes the above-mentioned Spindt-type field emission device (field emission device having a conical electron-emitting portion formed on the cathode electrode positioned in the bottom portion of the second opening portion), and a plane-type field emission device (field emission device having a nearly flat electron-emitting portion formed on the cathode electrode positioned in the bottom portion of the second opening portion).

A field emission device having a second structure comprises;

(A) a stripe-shaped cathode electrode which is formed on a supporting member and extends in a first direction, (B) an insulating layer formed on the supporting member and the cathode electrode, (C) a stripe-shaped gate electrode which is formed on the insulating layer and extends in a second direction different from the first direction, and (D) a first opening portion formed in the gate electrode and a second opening portion formed in the insulating layer and communicating with the first opening portion, and said field emission device has a structure in which a portion of the cathode electrode, which portion is exposed in the bottom portion of the second opening portion, corresponds to the electron-emitting portion and the portion of the cathode electrode, which portion is exposed in the bottom portion of the second opening portion, and is for emitting electrons.

The field emission device having the above second structure includes a flat-type field emission device which emits electrons from the flat surface of the cathode electrode.

In the Spindt-type field emission device, the material for constituting an electron-emitting portion may include at least one material selected from the group consisting of tungsten, a tungsten alloy, molybdenum, a molybdenum alloy, titanium, a titanium alloy, niobium, a niobium alloy, tantalum, a tantalum alloy, chromium, a chromium alloy and impurity-containing silicon (polysilicon or amorphous silicon). The electron-emitting portion of the Spindt-type field emission device can be formed by, for example, a vacuum vapor deposition method, a sputtering method and a CVD method.

In the plane-type field emission device, preferably, the electron-emitting portion is made of a material having a smaller work function Φ than a material for constituting a cathode electrode. The material for constituting an electron-emitting portion can be selected on the basis of the work function of a material for constituting a cathode electrode, a potential difference between the gate electrode and the cathode electrode, a required current density of emitted electrons, and the like. Typical examples of the material for constituting a cathode electrode of the field emission device include tungsten (Φ=4.55 eV), niobium (Φ=4.02-4.87 eV), molybdenum (Φ=4.53-4.95 eV), aluminum (Φ=4.28 eV), copper (Φ=4.6 eV), tantalum (Φ=4.3 eV), chromium (Φ=4.5 eV) and silicon (Φ=4.9 eV). The material for constituting an electron-emitting portion preferably has a smaller work function Φ than these materials, and the value of the work function thereof is preferably approximately 3 eV or smaller. Examples of such a material include carbon (Φ<1 eV), cesium (Φ=2.14 eV), $LaB_6$ (Φ=2.66-2.76 eV), BaO (Φ=1.6-2.7 eV), SrO (Φ=1.25-1.6 eV), $Y_2O_3$ (Φ=2.0 eV), CaO (Φ=1.6-1.86 eV), BaS (Φ=2.05 eV), TiN (Φ=2.92 eV) and ZrN (Φ=2.92 eV). More preferably, the electron-emitting portion is made of a material having a work function Φ of 2 eV or smaller. The material for constituting an electron-emitting portion is not necessarily required to have electric conductivity.

Otherwise, in the plane-type field emission device, the material for constituting an electron-emitting portion can be selected from materials having a secondary electron gain δ greater than the secondary electron gain δ of the electrically conductive material for constituting a cathode electrode. That is, the above material can be properly selected from metals such as silver (Ag), aluminum (Al), gold (Au), cobalt (Co), copper (Cu), molybdenum (Mo), niobium (Nb), nickel (Ni), platinum (Pt), tantalum (Ta), tungsten (W) and zirconium (Zr); semiconductors such as silicon (Si) and germanium (Ge); inorganic simple substances such as carbon and diamond; and compounds such as aluminum oxide ($Al_2O_3$), barium oxide (BaO), beryllium oxide (BeO), calcium oxide (CaO), magnesium oxide (MgO), tin oxide ($SnO_2$), barium fluoride ($BaF_2$) and calcium fluoride ($CaF_2$). The material for constituting an electron-emitting portion is not necessarily required to have electric conductivity.

In the plane-type field emission device, as a material for constituting an electron-emitting portion, particularly, carbon is preferred. More specifically, diamond, graphite and a carbon nano-tube structure are preferred. When the electron-emitting portion is made of diamond, graphite or a carbon nano-tube structure, an emitted-electron current density necessary for the display can be obtained at an electric field intensity of $5\times10^7$ V/m or lower. Further, since diamond is an electric resister, emitted-electron currents obtained from the electron-emitting portions can be brought into uniform currents, and the fluctuation of luminescence efficiency can be suppressed when such field emission devices are incorporated into the display. Further, since the above materials exhibit remarkably high durability against sputtering by ions of residual gas in the display, field emission devices having a longer lifetime can be attained.

Specifically, the carbon nano-tube structure includes a carbon nano-tube and a carbon nano-fiber. More specifically, the electron-emitting portion may be constituted of a carbon nano-tube, it may be constituted of a carbon nano-fiber, or it may be constituted of a mixture of a carbon nano-tube with a carbon nano-fiber. Macroscopically, the carbon nano-tube and carbon nano-fiber may have the form of a powder or a thin film. The carbon nano-tube structure may have the form of a cone in some cases. The carbon nano-tube and carbon nano-fiber can be produced or formed by a known PVD method such as an arc discharge method and a laser abrasion method; and any one of various CVD methods such as a plasma CVD method, a laser CVD method, a thermal CVD method, a gaseous phase synthetic method and a gaseous phase growth method.

The plane-type field emission device can be produced by a method in which a dispersion of a carbon nano-tube structure in a binder material is, for example, applied onto a desired region of the cathode electrode and the binder material is fired or cured (more specifically, a method in which the carbon nano-tube structure is dispersed in an organic binder material such as an epoxy resin or an acrylic resin or an inorganic binder material such as water glass, the dispersion is, for example, applied onto a desired region of the cathode electrode, then, the solvent is removed and the binder material is fired and cured). The above method will be referred to as "first forming method of a carbon nano-tube structure". The application method includes, for example, a screen printing method.

Alternatively, the plane-type field emission device can be produced by a method in which a dispersion of the carbon nano-tube structure in a metal compound solution is applied onto the cathode electrode and then, the metal compound is fired, whereby the carbon nano-tube structure is fixed to the surface of the cathode electrode with a matrix containing metal atoms constituting the metal compound. The above method will be referred to as "second forming method of a carbon nano-tube structure". The matrix is preferably constituted of an electrically conductive metal oxide. More specifically, it is preferably constituted of tin oxide, indium oxide, indium-tin oxide, zinc oxide, antimony oxide or antimony-tin oxide. After the firing, there can be obtained a state where part of each nano-tube structure is embedded in the matrix, or there can be obtained a state where the entire portion of each carbon nano-tube is embedded in the matrix. The matrix preferably has a volume resistivity of $1\times10^{-9}$ Ω·m to $5\times10^{-6}$Ω·m.

The metal compound for constituting the metal compound solution includes, for example, an organometal compound, an organic acid metal compound and metal salts (for example, chloride, nitrate and acetate). The organic acid metal compound solution is, for example, a solution prepared by dissolving an organic tin compound, an organic indium compound, an organic zinc compound or an organic antimony compound in an acid (for example, hydrochloric acid, nitric acid or sulfuric acid) and diluting the resultant solution with an organic solvent (for example, toluene, butyl acetate or isopropyl alcohol). Further, the organic metal compound solution is, for example, a solution prepared by dissolving an organic tin compound, an organic indium compound, an organic zinc compound or an organic antimony compound in an organic solvent (for example, toluene, butyl acetate or isopropyl alcohol). When the amount of the solution is 100 parts by weight, the solution preferably has a composition containing 0.001 to 20 parts by weight of the carbon nano-tube structure and 0.1 to 10 parts by weight of the metal compound. The solution may contain a dispersing agent and a surfactant. From the viewpoint of increasing the thickness of the matrix, an additive such as carbon black or the like may be added to the metal compound solution. In some cases, the organic solvent may be replaced with water.

The method for applying, onto the cathode electrode, the metal compound solution in which the carbon nano-tube structure is dispersed includes a spray method, a spin coating method, a dipping method, a die quarter method and a screen printing method. Of these, a spray method is preferred in view of easiness in application.

There may be employed a constitution in which the metal compound solution in which the carbon nano-tube structure is dispersed is applied onto the cathode electrode, the metal compound solution is dried to form a metal compound layer, then, an unnecessary portion of the metal compound layer on the cathode electrode is removed, and then the metal compound is fired. Otherwise, an unnecessary portion of the metal compound layer on the cathode electrode may be removed after the metal compound is fired. Otherwise, the metal compound solution may be applied only onto a desired region of the cathode electrode.

The temperature for firing the metal compound is preferably, for example, a temperature at which the metal salt is oxidized to form a metal oxide having electric conductivity, or a temperature at which the organometal compound or an organic acid metal compound is decomposed to form a matrix (for example, a metal oxide having electric conductivity) containing metal atoms constituting the organometal compound or the organic acid metal compound. For example, the above temperature is preferably at least 300° C. The upper limit of the firing temperature can be a temperature at which elements constituting the field emission device or the cathode panel do not suffer any thermal damage and the like.

In the first forming method or the second forming method of a carbon nano-tube structure, it is preferred to carry out a kind of an activation treatment (washing treatment) of the surface of the electron-emitting portion, since the efficiency of emission of electrons from the electron-emitting portion is further improved. The above activation treatment includes a plasma treatment in an atmosphere containing a gas such as hydrogen gas, ammonia gas, helium gas, argon gas, neon gas, methane gas, ethylene gas, acetylene gas or nitrogen gas.

In the first forming method or the second forming method of a carbon nano-tube structure, the electron-emitting portion may be formed in that portion of the cathode electrode which is positioned in a bottom portion of the second opening portion, or the electron-emitting portion may be also formed so as to extend from that portion of the cathode electrode which is positioned in a bottom portion of the second opening portion to a surface of that portion of the cathode electrode which is different from the cathode electrode portion in the bottom portion of the second opening portion. Further, the electron-emitting portion may be formed on the entire surface or part of the surface of that portion of the cathode electrode that is positioned in the bottom portion of the second opening portion.

In the various field emission device, the material for constituting a cathode electrode can be selected from metals such as tungsten (W), niobium (Nb), tantalum (Ta), titanium (Ti), molybdenum (Mo), chromium (Cr), aluminum (Al) and copper (Cu), gold (Au), silver (Ag) and the like; alloys and compounds containing these metal elements (for example, nitrides such as TiN and silicides such as $WSi_2$, $MoSi_2$, $TiSi_2$ and $TaSi_2$); semiconductors such as silicon (Si); carbon thin film such as diamond; and indium-tin oxide (ITO). Although not specially limited, the thickness of the cathode electrode is approximately 0.05 to 0.5 μm, preferably 0.1 to 0.3 μm.

In the various field emission devices, the conductive material for constituting the gate electrode includes at least one metal selected from the group consisting of tungsten (W), niobium (Nb), tantalum (Ta), titanium (Ti), molybdenum (Mo), chromium (Cr), aluminum (Al), copper (Cu), gold (Au), silver (Ag), nickel (Ni), cobalt (Co), zirconium (Zr), iron (Fe), platinum (Pt) and zinc (Zn); alloys or compounds containing these metal elements (for example, nitrides such as TiN and silicides such as $WSi_2$, $MoSi_2$, $TiSi_2$ and $TaSi_2$); semiconductors such as silicon (Si); and electrically conductive metal oxides such as indium-tin oxide (ITO), indium oxide and zinc oxide. In addition, the electrically conductive layer may be constituted of the same material as the material for constituting the gate electrode.

The method for forming the cathode electrode and the gate electrode and the electrically conductive layer includes deposition methods such as an electron beam deposition method and a hot filament deposition method, a sputtering method, a combination of a CVD method or an ion plating method with an etching method, a screen-printing method, a plating method and a lift-off method. When a screen-printing method or a plating method is employed, the cathode electrodes in the form of stripes can be directly formed.

In the field emission device having the first or second structure, depending upon the structure of field emission device, one electron-emitting portion may exist in one first opening portion formed in the gate electrode and one second opening portion formed in the insulating layer, or a plurality of electron-emitting portions may exist in one first opening portion formed in the gate electrode and one second opening portion formed in the insulating layer, or one electron-emitting portion or a plurality of electron-emitting portions may exist in a plurality of first opening portions formed in the gate electrode and one second opening portion which is formed in the insulating layer and communicates with such first opening portions.

The plane form of the first or second opening portion (form obtained by cutting the first or second opening portion with an imaginary plane in parallel with the supporting member surface) may be any form such as a circle, an oval, a rectangle, a polygon, a rounded rectangle or a rounded polygon. The first opening portion can be formed, for example, by isotropic etching or by a combination of anisotropic etching and isotropic etching. The first opening portion can be directly formed depending upon the forming method of the gate electrode. The second opening portion can also be formed, for example, by isotropic etching or by a combination of anisotropic etching and isotropic etching.

In the field emission device having the first structure, a resistance layer may be formed between the cathode electrode and the electron-emitting portion. Otherwise, when the surface of the cathode electrode corresponds to the electron-emitting portion (that is, in the field emission device having the second structure), the cathode electrode may have a three-layered structure constituted of an electrically conductive material layer, a resistance layer and an electron-emitting layer corresponding to the electron-emitting portion. The resistance layer can stabilize performances of the field emission device and can attain uniform electron-emitting properties. The material for constituting a resistance layer includes carbon-containing materials such as silicon carbide (SiC) and SiCN; SiN; semiconductor materials such as amorphous silicon and the like; and refractory metal oxides such as ruthenium oxide ($RuO_2$), tantalum oxide and tantalum nitride. The resistance layer can be formed by a sputtering method, a CVD method or a screen-printing method. The resistance value of the resistance layer is approximately $1\times10^5$ to $1\times10^7\Omega$, preferably several MΩ.

As a material for constituting an insulating layer, $SiO_2$-containing material such as $SiO_2$, BPSG, PSG, BSG, AsSG, PbSG, SiN, SiON and spin on glass (SOG), low melting-point glass and a glass paste, SiN, an insulating resin such as polyimide and the like can be used alone or in combination. The insulating layer can be formed by a known method such as a CVD method, an application method, a sputtering method or a screen printing method.

[Spindt-Type Field Emission Device]

The Spindt-type field emission device comprises:

(a) a stripe-shaped cathode electrode 11 being formed on a supporting member 10 and extending in a first direction, (b) an insulating layer 12 formed on the supporting member 10 and the cathode electrode 11, (c) a stripe-shaped gate electrode 13 being formed on the insulating layer 12 and extending in a second direction different from the first direction, (d) a first opening portion 14A formed through the gate electrode 13 and a second opening portion 14B being formed through the insulating layer 12 and communicating with the first opening portion 14A, and (e) an electron-emitting portion 15 formed on a cathode electrode 11 positioned in the bottom portion of the second opening portion 14B, and has a structure in which electrons are emitted from the conical electron-emitting portion 15 exposed in the bottom portion of the second opening portion 14B.

The method of manufacturing the Spindt-type field emission device will be explained below with reference to FIGS. 13(A), 13(B), 14(A) and 14(B) which are schematic partial end views of the supporting member 10, etc., constituting a cathode panel.

The above Spindt-type field emission device can be obtained basically by a method in which the conical electron-emitting portion 15 is formed by vertical vapor deposition of a metal material. That is, while deposition particles perpendicularly enter the first opening portion 14A formed through the gate electrode 13, the amount of deposition particles reaching the bottom portion of the second opening portion 14B is gradually decreased by utilizing a masking effect produced by an overhanging deposit formed around the edge of the opening of the first opening portion 14A, and the electron-emitting portion 15, which is a conical deposit, is formed in a self-alignment manner. There will be explained below a method in which a peeling-off layer 17A is formed on the gate electrode 13 and the insulating layer 12 beforehand for making it easy to remove an unnecessary overhanging deposit. In the FIGS. 13 to 18, one electron-emitting portion alone is shown.

[Step-A0]

A conductive material layer composed, for example, of polysilicon for a cathode electrode is formed on a supporting member 10 made, for example, of a glass substrate by a plasma-enhanced CVD method. Then, the conductive material layer for a cathode electrode is patterned by a lithograph method and a dry etching method, to form the cathode electrode 11 having a stripe form. Thereafter, the insulating layer 12 composed of $SiO_2$ is formed on the entire surface by a CVD method.

[Step-A1]

Then, the conductive material layer (for example, TiN layer) for a gate electrode is formed on the insulating layer 12 by a sputtering method. Then, the conductive material layer for a gate electrode is patterned by a lithograph method and a dry etching method, to form the stripe-shaped gate electrode 13. The cathode electrode 11 in the form of a stripe extends in a direction rightward and leftward to the paper surface of the drawing and the gate electrode 13 in the form of a stripe extends in a direction perpendicular to the paper surface of the drawing.

The gate electrode 13 can be formed by a known thin film forming method such as a PVD method including a vacuum vapor deposition method and the like, a CVD method, a plating method including an electroplating method and an electroless plating method, a screen printing method, a laser abrasion method, a sol-gel method, a lift-off method and the like, or a combination of one of them with an etching method as required. For example, a stripe-shaped gate electrode can be directly formed when a screen-printing method or a plating method is employed.

[Step-A2]

Then, a resist layer is formed again, and the first opening portion 14A is formed through the gate electrode 13 by etching, and further, the second opening portion 14B is formed through the insulating layer by etching. The cathode electrode 11 is exposed in the bottom portion of the second opening portion 14B, and then, the resist layer is removed. In the above manner, a structure shown in FIG. 13(A) can be obtained.

[Step-A3]

Figure 13A:
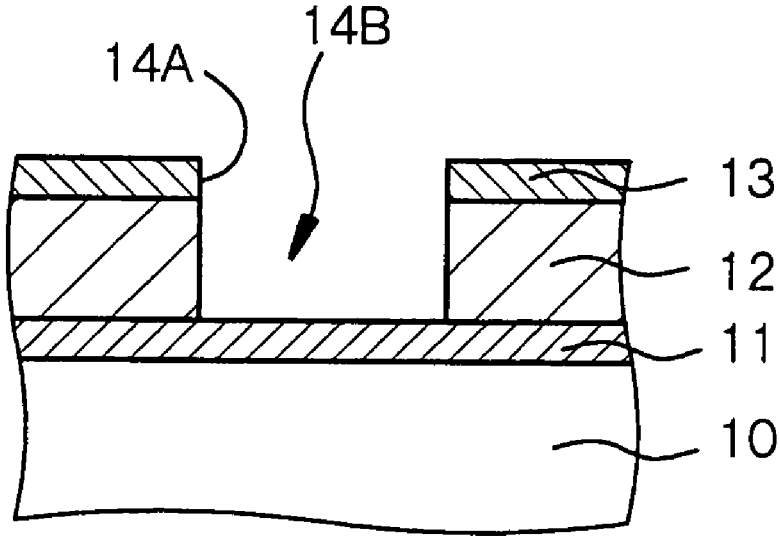
FIGS. 13(A) and 13(B) are schematic partial end views of a supporting member, etc., for explaining a method for manufacturing a Spindt type cold cathode field emission device.
Figure 13B:
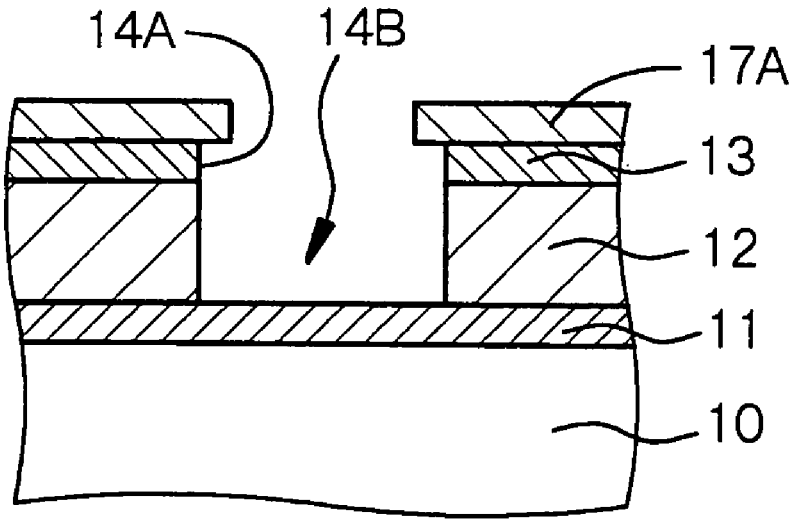

As shown in FIG. 13(B), a peeling-off layer 17A is then formed on the insulating layer 12 and the gate electrode 13 by oblique vapor deposition of nickel (Ni) while the supporting member 10 is turned. In this case, the incidence angle of vaporized particles relative to the normal of the supporting member 10 is set at a sufficiently large angle (for example, an incidence angle of 65° to 85°), whereby the peeling-off layer 17A can be formed on the gate electrode 13 and the insulating layer 12 almost without depositing any nickel in the bottom portion of the second opening portion 14B. The peeling-off layer 17A extends from the opening edge portion of the first opening portion 14A like eaves, whereby the diameter of the first opening portion 14A is substantially decreased.

[Step-A4]

Figure 14A:
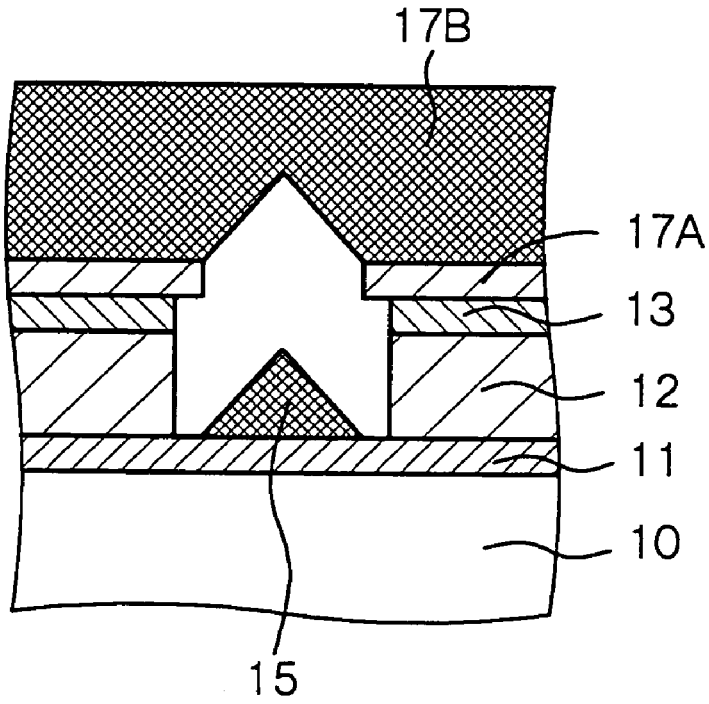
Figure 14B:
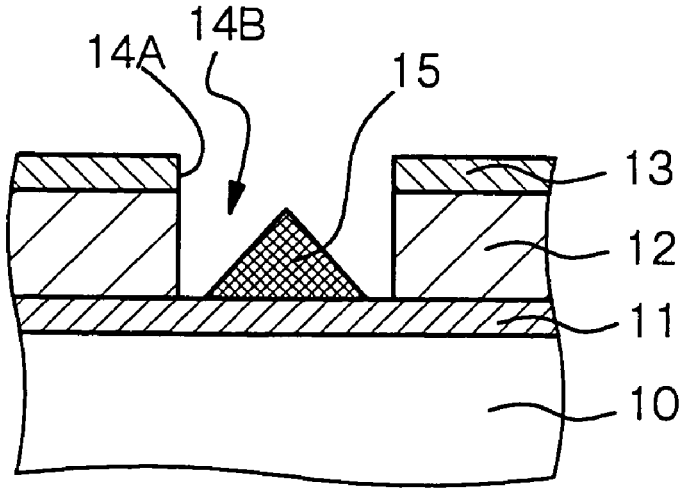

Then, an electrically conductive material such as molybdenum (Mo) is deposited on the entire surface by vertical vapor deposition (incidence angle 3° to 10°). During the above vapor deposition, as shown in FIG. 14(A), as the conductive material layer 17B having an overhanging form grows on the peeling-off layer 17A, the substantial diameter of the first opening portion 14A is gradually decreased, and the vaporized particles which contribute to the deposition in the bottom portion of the second opening portion 14B gradually come to be limited to particles which pass the central region of the first opening portion 14A. As a result, a circular-cone-shaped deposit is formed on the bottom portion of the second opening portion 14B, and the circular-cone-shaped deposit constitutes the electron-emitting portion 15.

[Step-A5]

Then, the peeling-off layer 17A is peeled off from the surfaces of the gate electrode 13 and the insulating layer 12 by a lift-off method, and the conductive material layer 17B above the gate electrode 13 and the insulating layer 12 are selectively removed. In this manner, the cathode panel having a plurality of the Spindt-type field emission devices can be obtained.

[Plane-Type Field Emission Device (No. 1)]

The plane-type field emission device comprises:

(a) cathode electrode 11 being formed on a supporting member 10 and extending in first direction, (b) an insulating layer 12 formed on the supporting member 10 and the cathode electrode 11, (c) a gate electrode 13 being formed on the insulating layer 12 and extending in a second direction different from the first direction, (d) a first opening portion 14A formed through the gate electrode 13 and a second opening portion 14B being formed through the insulating layer 12 and communicating with the first opening portion 14A, (e) a flat electron-emitting portion 15A formed on the cathode electrode 11 positioned in the bottom portion of the second opening portion 14B, and has a structure in which electrons are emitted from the electron-emitting portion 15A exposed in the bottom portion of the second opening portion 14B.

An electron-emitting portion 15A comprises a matrix 18 and a carbon-nanotube structure (specifically, a carbon-nanotube 19) embedded in the matrix 18 in a state where the top portion of the carbon-nanotube structure is projected, and the matrix 18 is formed from an electrically conductive metal oxide (specifically, indium-tin oxide, ITO).

The production method of the field emission device will be explained with reference to FIGS. 15(A), 15(B), 16(A) and 16(B), hereinafter.

[Step-B0]

First, a stripe-shaped cathode electrode 11 made of an approximately 0.2 μm thick chromium (Cr) layer is formed on a supporting member 10 made, for example, of a glass substrate, for example, by a sputtering method and an etching technique.

[Step-B1]

Then, a metal compound solution, consisting of an organic acid metal compound, in which the carbon-nanotube structure is dispersed is applied onto the cathode electrode 11, for example, by a spray method. Specifically, a metal compound solution shown in Table 3 is used. In the metal compound solution, the organic tin compound and the organic indium compound are in a state where they are dissolved in an acid (for example, hydrochloric acid, nitric acid or sulfuric acid). The carbon-nanotube is produced by an arc discharge method and has an average diameter of 30 nm and an average length of 1 μm. In the application, the supporting member 10 is heated to 70-150° C. Atmospheric atmosphere is employed as an application atmosphere. After the application, the supporting member is heated for 5 to 30 minutes to fully evaporate butyl acetate off. When the supporting member is heated during the application as described above, the applied solution begins to dry before the carbon-nanotube is self-leveled toward the horizontal direction of the surface of the cathode electrode. As a result, the carbon-nanotube can be arranged on the surface of the cathode electrode in a state where the carbon-nanotube is not in a level position. That is, the carbon-nanotube can be aligned in the direction in which the top portion of the carbon-nanotube faces the anode electrode, in other words, the carbon-nanotube comes close to the normal direction of the supporting member. The metal compound solution having a composition shown in Table 3 may be prepared beforehand, or a metal compound solution containing no carbon-nanotube may be prepared beforehand and the carbon-nanotube and the metal compound solution may be mixed before the application. For improving dispersibility of the carbon-nanotube, ultrasonic waves may be applied when the metal compound solution is prepared.

TABLE 3

| | |
|---|---|
| Organic tin compound and organic indium compound | 0.1-10 parts by weight |
| Dispersing agent (sodium dodecylsulfate) | 0.1-5 parts by weight |
| Carbon-nanotube | 0.1-20 parts by weight |
| Butyl acetate | Balance |

When a solution of an organic tin compound dissolved in an acid is used as an organic acid metal compound solution, tin oxide is obtained as a matrix. When a solution of an organic indium compound dissolved in an acid is used, indium oxide is obtained as a matrix. When a solution of an organic zinc compound dissolved in an acid is used, zinc oxide is obtained as a matrix. When a solution of an organic antimony compound dissolved in an acid is used, antimony oxide is obtained as a matrix. When a solution of an organic antimony compound and an organic tin compound dissolved in an acid is used, antimony-tin oxide is obtained as a matrix. Further, when an organic tin compound is used as an organic metal compound solution, tin oxide is obtained as a matrix. When an organic indium compound is used, indium oxide is obtained as a matrix. When an organic zinc compound is used, zinc oxide is obtained as a matrix. When an organic antimony compound is used, antimony oxide is obtained as a matrix. When an organic antimony compound and an organic tin compound are used, antimony-tin oxide is obtained as a matrix. Alternatively, a solution of metal chloride (for example, tin chloride or indium chloride) may be used.

After the metal compound solution is dried, salient convexo-concave shapes may be formed in the surface of the metal compound layer in some cases. In such cases, it is desirable to apply the metal compound solution again on the metal compound layer without heating the supporting member.

[Step-B2]

Then, the metal compound composed of the organic acid metal compound is fired, to give an electron-emitting portion 15A having the carbon-nanotubes 19 fixed onto the surface of the cathode electrode 11 with the matrix 18 (which is specifically a metal oxide, and more specifically, ITO) containing metal atoms (specifically, In and Sn) derived from the organic acid metal compound. The firing is carried out in an atmospheric atmosphere at 350° C. for 20 minutes. The thus-obtained matrix 18 had a volume resistivity of $5\times10^{-7}\Omega\cdot m$. When the organic acid metal compound is used as a starting material, the matrix 18 made of ITO can be formed at a low firing temperature of as low as 350° C. The organic acid metal compound solution may be replaced with an organic metal compound solution. When a solution of metal chloride (for example, tin chloride and indium chloride) is used, the matrix 18 made of ITO is formed while the tin chloride and indium chloride are oxidized by the firing.

[Step-B3]

Then, a resist layer is formed on the entire surface, and the circular resist layer having a diameter, for example, of 10 μm is retained above a desired region of the cathode electrode 11. The matrix 18 is etched with hydrochloric acid having a temperature of 10 to 60° C. for 1 to 30 minutes, to remove an unnecessary portion of the electron-emitting portion. Further, when the carbon-nanotubes still remain in a region different from the desired region, the carbon-nanotubes are etched by an oxygen plasma etching treatment under a condition shown in Table 4. A bias power may be 0 W, i.e., direct current, while it is desirable to apply the bias power. The supporting member may be heated, for example, to approximately 80° C.

TABLE 4

| | |
|---|---|
| Apparatus to be used | RIE apparatus |
| Gas to be introduced | Gas containing oxygen |
| Plasma exciting power | 500 W |
| Bias power | 0-150 W |
| Treatment time period | at least 10 seconds |

Alternatively, the carbon-nanotubes can be etched by a wet etching treatment under a condition shown in Table 5.

TABLE 5

| | |
|---|---|
| Solution to be used | $KMnO_4$ |
| Temperature | 20-120 (C. |
| Treatment time period | 10 seconds-20 minutes |

Figure 15A:
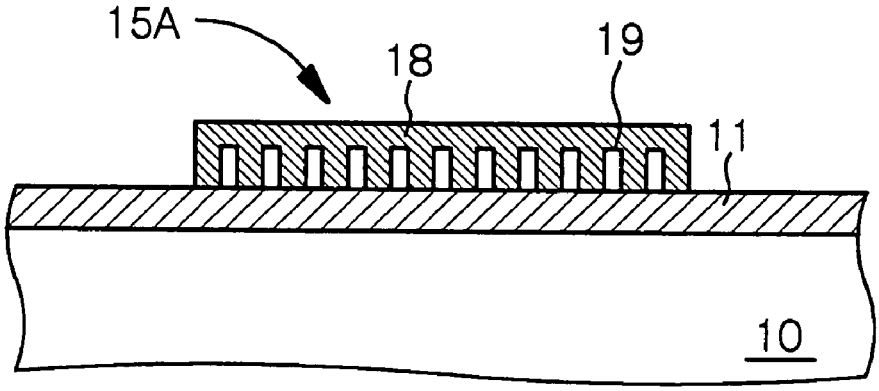
FIGS. 15(A) and 15(B) are schematic partial end views of a supporting member, etc., for explaining a method for manufacturing a plane type cold cathode field emission device (No. 1).
Figure 15B:
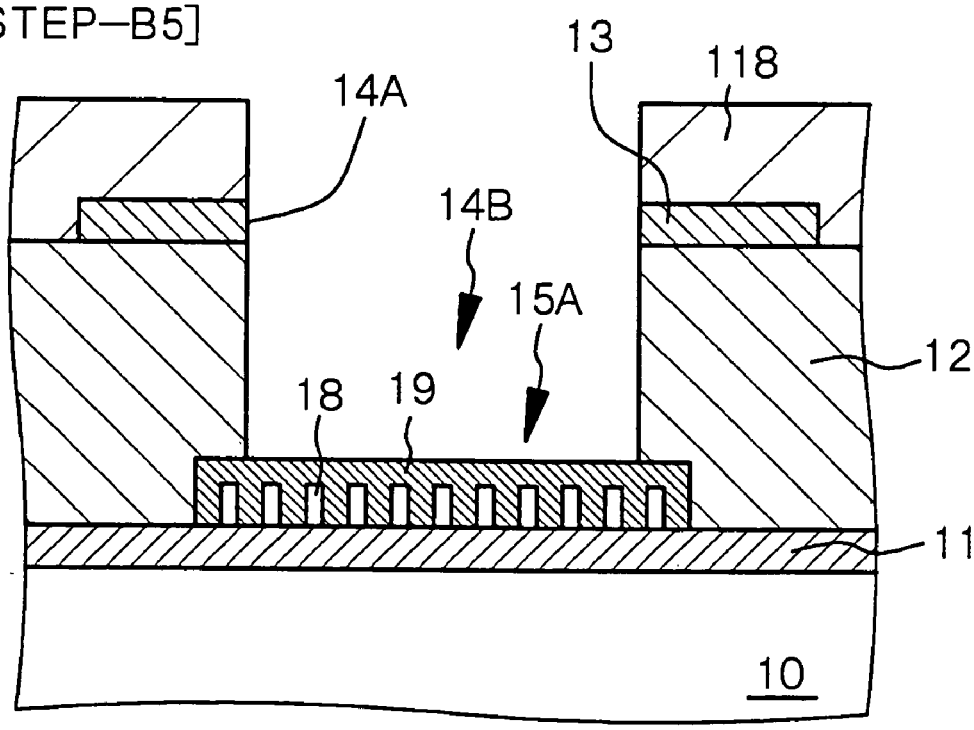

Then, the resist layer is removed, whereby a structure shown in FIG. 15(A) can be obtained. It is not necessarily required to retain a circular electron-emitting portion 15A having a diameter of 10 μm. For example, the electron-emitting portion may be retained on the cathode electrode 11.

The process may be carried out in the order of [Step-B1], [Step-B3] and [Step-B2].

[Step-B4]

An insulating layer 12 is formed on the electron-emitting portion 15A, the supporting member 10 and the cathode electrode 11. Specifically, an approximately 1 μm thick insulating layer 12 is formed on the entire surface by a CVD method using, for example, tetraethoxysilane (TEOS) as a source gas.

[Step-B5]

Then, a stripe-shaped gate electrode 13 is formed on the insulating layer 12. Further, a mask layer 118 is formed on the insulating layer 12 and the gate electrode 13, then, a first opening portion 14A is formed through the gate electrode 13, a second opening portion 14B communicating with the first opening portion 14A formed through the gate electrode 13 is formed through the insulating layer 12 (see FIG. 15(B)). When the matrix 18 is made of a metal oxide, for example, ITO, the insulating layer 12 can be etched without etching the matrix 18. That is, the etching selective ratio between the insulating layer 12 and the matrix 18 is approximately infinite. The carbon-nanotubes 19 are therefore not damaged when the insulating layer 12 is etched.

[Step-B6]

Then, preferably, part of the matrix 18 is removed under a condition shown in Table 6, to obtain the carbon-nanotubes 19 in a state where top portions thereof are projected from the matrix 18. In this manner, the electron-emitting portion 15A having a structure shown in FIG. 16(A) can be obtained.

TABLE 6

| | |
|---|---|
| Etching solution | Hydrochloric acid |
| Etching time period | 10 seconds-30 seconds |
| Etching temperature | 10-60° C. |

Some or all of the carbon-nanotubes 19 may change in their surface state due to the etching of the matrix 18 (for example, oxygen atoms or oxygen molecules or fluorine atoms are adsorbed to their surfaces), and the carbon-nanotubes 19 are deactivated with respect of electric field emission in some cases. Therefore, it is preferred to subject the electron-emitting portion 15A to a plasma treatment in a hydrogen gas atmosphere. By the plasma treatment, the electron-emitting portion 15A is activated, and the efficiency of emission of electrons from the electron-emitting portion 15A is further improved. Table 7 shows an example of a plasma treatment condition.

TABLE 7

| | |
|---|---|
| Gas to be used | $H_2$ = 100 sccm |
| Source power | 1000 W |
| Power to be applied to supporting member | 50 V |
| Reaction pressure | 0.1 Pa |
| Supporting member temperature | 300° C. |

Then, for releasing gas from the carbon-nanotubes 19, a heating treatment or various plasma treatments may be carried out. For allowing a substance to be adsorbed to the surfaces of the carbon-nanotubes 19, the carbon-nanotubes 19 may be exposed to a gas containing the substance whose adsorption is desirable. For purifying the carbon-nanotubes 19, an oxygen plasma treatment or a fluorine plasma treatment may be carried out.

[Step-B7]

Figure 16A:
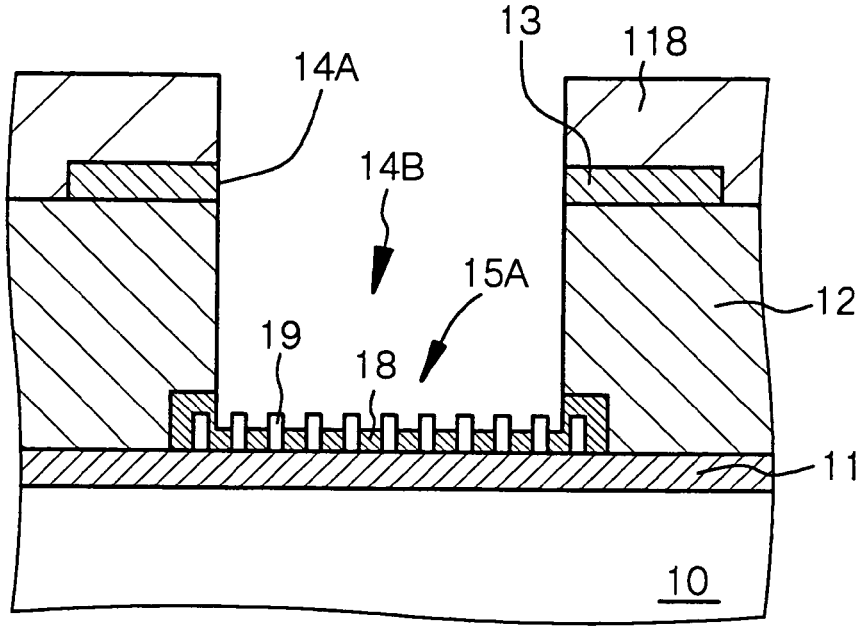
Figure 16B:
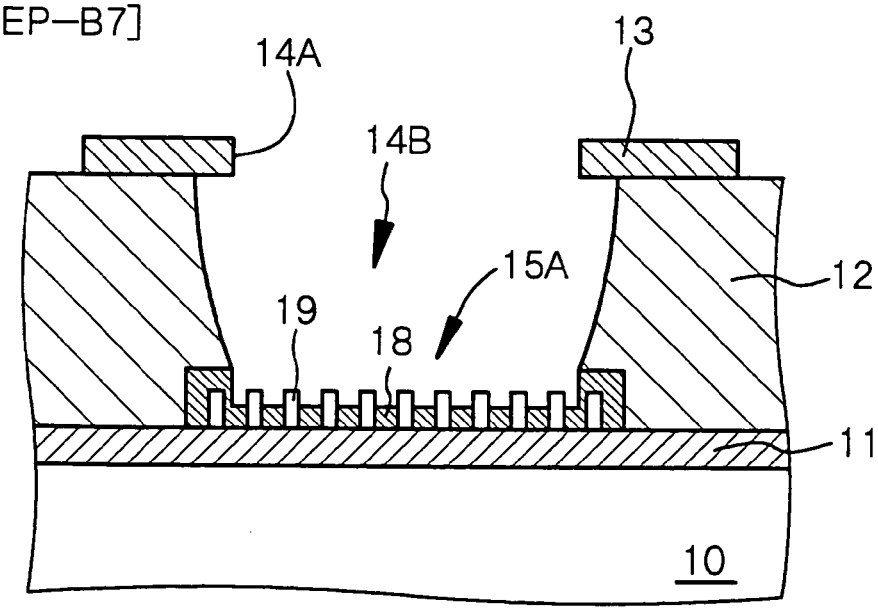

Then, the side wall surfaces of the second opening portion 14B formed through the insulating layer 12 are allowed to recede by isotropic etching, which is preferred from the viewpoint of exposing the opening end portion of the gate electrode 13. The isotropic etching can be carried out by dry etching using radicals as main etching species like chemical dry etching, or by wet etching using an etching solution. As an etching solution, for example, a mixture containing a 49% hydrofluoric acid aqueous solution and pure water in a hydrofluoric acid aqueous solution: pure water volume ratio of 1:100 can be used. Then, the mask layer 118 is removed, whereby a field emission device shown in FIG. 16(B) is completed.

The above process can be carried out in the order of [Step-B5], [Step-B7] and [Step-B6].

[Plane-Type Field Emission Device (No. 2)]

Figure 17A:
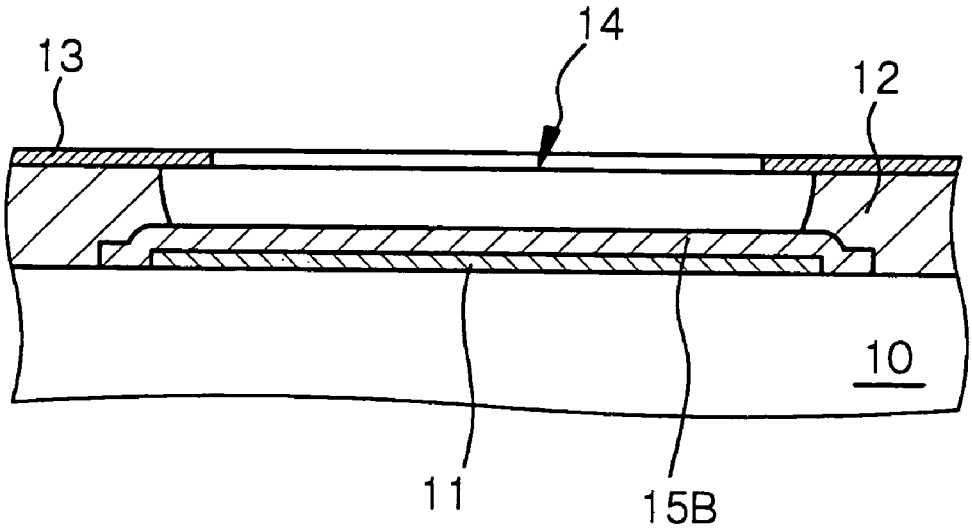
FIGS. 17(A) and 17(B) are a schematic partial cross-sectional view of a plane type cold cathode field emission device (No. 2) and a schematic partial cross-sectional view of a flat type cold cathode field emission device.

FIG. 17(A) shows a schematic partial cross-sectional view of a plane-type field emission device. The plane-type field emission device comprises a cathode electrode 11 formed on a supporting member 10 made, for example, of glass, an insulating layer 12 formed on the supporting member 10 and the cathode electrode 11, a gate electrode 13 formed on the insulating layer 12, an opening portion 14 formed through the gate electrode 13 and the insulating layer 12 (a first opening portion formed through the gate electrode 13 and a second opening portion being formed through the insulating layer 12 and communicating with the first opening portion), and a flat electron-emitting portion (electron-emitting layer 15B) formed on that portion of the cathode electrode 11 which is positioned in the bottom portion of the opening portion 14. The electron-emitting layer 15B is formed on the stripe-shaped cathode electrode 11 extending in the direction perpendicular to the paper surface of the drawing. Further, the gate electrode 13 is extending leftward and rightward on the paper surface of the drawing. The cathode electrode 11 and the gate electrode 13 are made of chromium. Specifically, the electron-emitting layer 15B is constituted of a thin layer made of a graphite powder. In the plane-type field emission device shown in FIG. 17(A), the electron-emitting layer 15B is formed on the entire region of the surface of the cathode electrode 11, while the plane-type field emission device shall not be limited to such a structure, and the point is that the electron-emitting layer 15B is formed at least in the bottom portion of the opening portion 14.

[Flat-Type Field Emission Device]

Figure 17B:
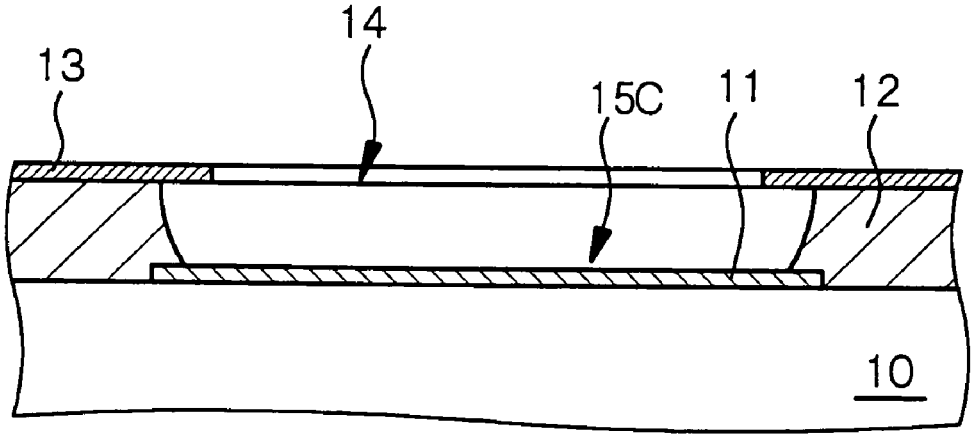

FIG. 17(B) shows a schematic partial cross-sectional view of a flat-type field emission device. The flat-type field emission device comprises a stripe-shaped cathode electrode 11 formed on a supporting member 10 made, for example, of glass, an insulating layer 12 formed on the supporting member 10 and the cathode electrode 11, a stripe-shaped gate electrode 13 formed on the insulating layer 12, and first and second opening portions (opening portion 14) formed through the gate electrode 13 and the insulating layer 12. The cathode electrode 11 is exposed in the bottom portion of the opening portion 14. The cathode electrode 11 is extending in the direction perpendicular to the paper surface of the drawing, and the gate electrode 13 is extending leftward and rightward on the paper surface of the drawing. The cathode electrode 11 and the gate electrode 13 are made of chromium (Cr), and the insulating layer 12 is made of $SiO_2$. That portion of the above cathode electrode 11 which is exposed in the bottom portion of the opening portion 14 corresponds to an electron-emitting portion 15C.

While the present invention has been explained on the basis of preferred Examples, the present invention shall not be limited thereto. The constitutions and structures explained with regard to the anode panel, the cathode panels, the displays and the field emission devices in Examples are given as examples and may be modified as required. The manufacturing method explained with regard to the anode panel, the cathode panels, the displays and the field emission devices are given as examples and may be modified as required. Further, the various materials used in the manufacture of the anode panel and the cathode panels are also given as examples and may be modified as required. With regard to the display, color displays are explained as examples, while the display may be a monochromatic display.

The anode electrode may be an anode electrode having a form in which the effective field is covered with one sheet-shaped electrically conductive material or may be an anode electrode having a form in which anode electrode units each of which corresponds to one or a plurality of electron-emitting portions or one or a plurality of pixels are gathered. When the anode electrode has the former constitution, the anode electrode can be connected to the anode-electrode control circuit. When the anode electrode has the latter constitution, for example, each anode electrode unit can be connected to the anode-electrode control circuit.

In the field emission device, there have been mostly explained embodiments in which one electron-emitting portion corresponds to one opening portion, while there may be employed an embodiment in which a plurality of electron-emitting portions correspond to one opening portion or one electron-emitting portion corresponds to a plurality of opening portions, depending upon the structure of the field emission device. Alternatively, there may be also employed an embodiment in which a plurality of first opening portions are formed through a gate electrode, a plurality of second opening portions communicating with a plurality of the first opening portion are formed through an insulating layer, and one or a plurality of electron-emitting portions are formed.

The gate electrode can be formed so as to have a form in which the effective field is covered with one sheet of an electrically conductive material (having a first opening portion). In this case, a positive voltage (e.g., 160V) is applied to the gate electrode. And, a switching element constituted, for example, of TFT is provided between the cathode electrode constituting a pixel and the cathode-electrode control circuit, and the voltage application state to the electron-emitting portion constituting the pixel is controlled by the operation of the above switching element, to control the light emission state of the pixel.

Alternatively, the cathode electrode can be formed so as to have a form in which the effective filed is covered with one sheet of an electrically conductive material. In this case, a voltage (e.g., 0V) is applied to the cathode electrode. And, a switching element constituted, for example, of TFT is provided between the electron-emitting portion constituting a pixel and the gate-electrode control circuit, and the voltage application state to the gate electrode constituting the pixel is controlled by the operation of the switching element, to control the light emission state of the pixel.

Figure 18:
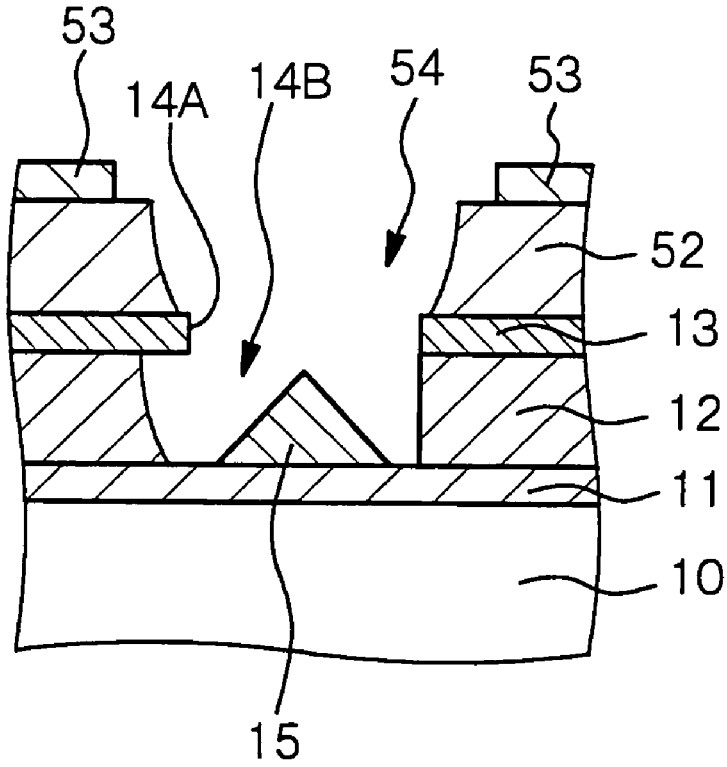
FIG. 18 is a schematic partial end view of a Spindt type cold cathode field emission device having a focus electrode.

The field emission device in the present invention may have a constitution in which a second insulating layer 52 is further formed on the gate electrode 13 and the insulating layer 12, and a focus electrode 53 is formed on the second insulating layer 52. FIG. 18 shows a schematic partial end view of the thus-constituted field emission device. The second insulating layer 52 has a third opening portion 54 communicating with the first opening portion 14A. The focus electrode 53 may be formed as follows. For example, in [Step-A2], the gate electrode 13 in the form of a stripe is formed on the insulating layer 12; the second insulating layer 52 is formed; a patterned focus electrode 53 is formed on the second insulating layer 52; the third opening portion 54 is formed in the focus electrode 53 and the second insulating layer 52; and further, the first opening portion 14A is formed in the gate electrode 13. The focus electrode may be a focus electrode having a form in which focus electrode units, each of which corresponds to one or a plurality of electron-emitting portions or one or a plurality of pixels, are gathered, or may be a focus electrode having a form in which the effective field is covered with a sheet of an electrically conductive material, depending upon the patterning of the focus electrode. FIG. 18 shows a Spindt-type field emission device, however, the focus electrode can be also applied to another type of the field emission device.

The focus electrode may be replaced with a focus electrode which will be explained hereinafter. That is, one example of the focus electrode can be formed by forming an insulation film made, for example, of $SiO_2$ on each surface of a metal sheet made, for example, of 42% Ni—Fe alloy having a thickness of several tens micrometers, and then forming opening portions in regions corresponding to pixels by punching or etching. And, the cathode panel, the metal sheet and the anode panel are stacked, a frame is arranged in their circumferential portions of the two panels, and a heat treatment is carried out to bond the insulation film formed on one surface of the metal sheet and the insulating layer 12 and to bond the insulation layer formed on the other surface of the metal sheet and the anode panel, whereby these members are integrated, followed by evacuating and sealing. In this manner, the display can be also completed.

Further, the electron-emitting region can be also constituted of devices generally called surface-conduction-type field emission devices. The surface-conduction-type field emission device comprises a supporting member made of, for example, glass and pairs of electrodes formed on the supporting member in the form of a matrix, the electrodes being made of an electrically conductive material such as tin oxide ($SnO_2$), gold (Au), indium oxide ($In_2O_3$)/tin oxide ($SnO_2$), carbon or palladium oxide (PdO) and having a fine area and a pair of the electrodes being arranged at constant intervals (gaps). A carbon thin film is formed on each electrode. A row-direction wiring is connected to one electrode of a pair of the electrodes, and a column-direction wiring is connected to the other electrode of a pair of the electrodes. When a voltage is applied to a pair of the electrodes, an electric field is applied to the carbon thin films opposed to each other through the gap, and electrons are emitted from the carbon thin film. Such electrons are allowed to collide with a phosphor layer on an anode panel to excite the phosphor layer, whereby a desired image can be obtained.

Figure 19:
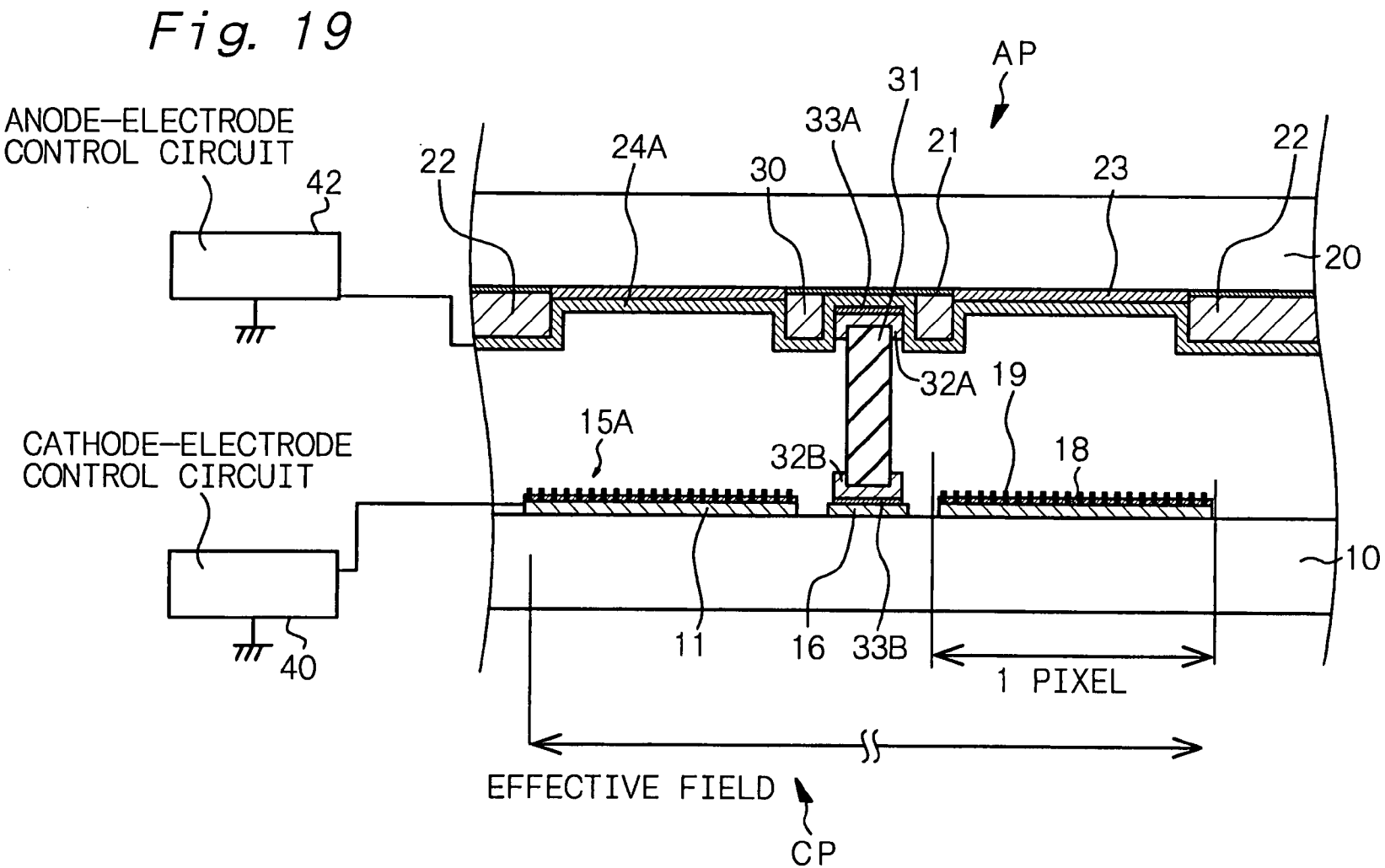
FIG. 19 is a schematic partial end view of another variant of the cold cathode field emission display that is the flat-type display in Example 3.
Figure 20:
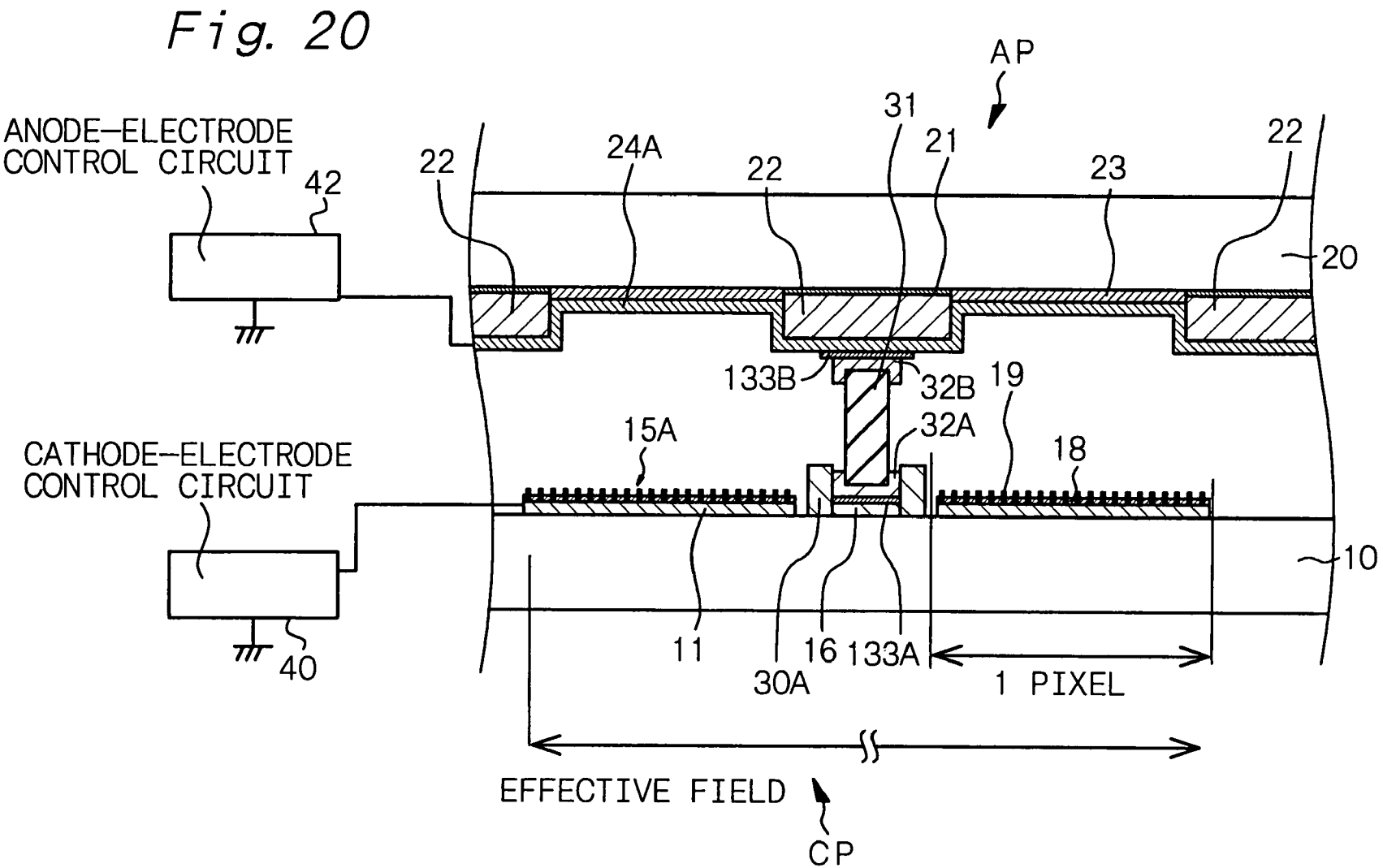
FIG. 20 is a schematic partial end view of still another variant of the cold cathode field emission display that is the flat-type display in Example 3.

In Examples, the displays are so-called three-electrode type displays, while the display can be a so-called two-electrode type display. FIGS. 19 and 20 show schematic partial end views of two-electrode type displays. FIGS. 19 and 20 correspond to end views taken along arrows A-A in FIG. 3. Spacer holders 30 and 30A have substantially the same structures and constitutions as those in Examples 1 to 6, and they can be formed substantially in the same manner as in Examples 1 to 6. The example shown in FIG. 19 is a variant of the display explained in Example 1, and the example shown in FIG. 20 is a variant of the display explained in Example 2.

The field emission device in the above cold cathode field emission display comprises a cathode electrode 11 formed on a supporting member 10 and an electron-emitting portion 15A constituted of carbon nano-tubes 19 formed on the cathode electrode 11. An anode electrode 24A constituting the anode panel AP has the form of a stripe. The projection image of the stripe-shaped cathode electrode 11 and the projection image of the stripe-shaped anode electrode 24A cross each other at right angles. Specifically, the cathode electrode 11 extends in the direction perpendicular to the paper surface of the FIGS. 19 and 20, and the anode electrode 24A extends leftward and rightward on the paper surface of the FIGS. 19 and 20. In a cathode panel CP in the above display, a number of electron emitting regions EA, each of which is constituted of a plurality of the above field emission devices, are formed on the effective field in the form of a two-dimensional matrix.

One (each) pixel is constituted of a cathode electrode 11 having the form of a stripe on the cathode panel side, an electron emitting portion 15A formed thereon and phosphor layers 23 that are aligned in the effective field of an anode panel so as to be opposed to the electron emitting portion 15A. In the effective field, such pixels are arranged in the order of hundreds of thousand to several millions.

A spacer 31 held with spacer holders 30 and 30A is arranged between the cathode panel CP and the anode panel AP for maintaining a constant distance between these two panels.

In the above display, electrons are emitted from the electron-emitting portion 15A on the basis of a quantum tunnel effect under an electric field formed with the anode electrode 24A, and the electrons are attracted toward the anode electrode 24A to collide with the luminescent layer 23. That is, the cold cathode field emission display is driven by a so-called simple matrix method in which electrons are emitted from the electron-emitting portion 15A positioned in a region where the projection image of the anode electrode 24A and the projection image of the cathode electrode 11 overlap each other (anode electrode/cathode electrode overlap region). Specifically, a relatively negative voltage is applied to the cathode electrode 11 from the cathode-electrode driving circuit 40 and a relatively positive voltage is applied to the anode electrode 24A from the anode-electrode driving circuit 42. As a result, electrons are selectively released into a vacuum space from the carbon nano-tubes 19 constituting the electron-emitting portion 15A positioned in the anode electrode/cathode electrode overlap region of a cathode electrode 11 selected as a column and an anode electrode 24A selected as a row (or a row-selected cathode electrode 11 selected as a row and an anode electrode 24A selected as a column), and the electrons are attracted toward the anode electrode 24A to collide with the luminescent layer 23 constituting the anode panel AP. The electrons excite the luminescent layer 23 to emit light.

The structures of the displays explained in Examples 3 to 6 can be applied to the above two-electrode type display.

Figure 21A:
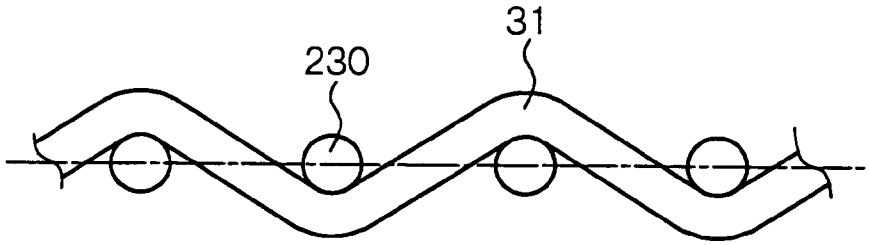
FIGS. 21(A) to (D) are schematic partial plan views showing variants of layout of spacer holders.
Figure 21B:
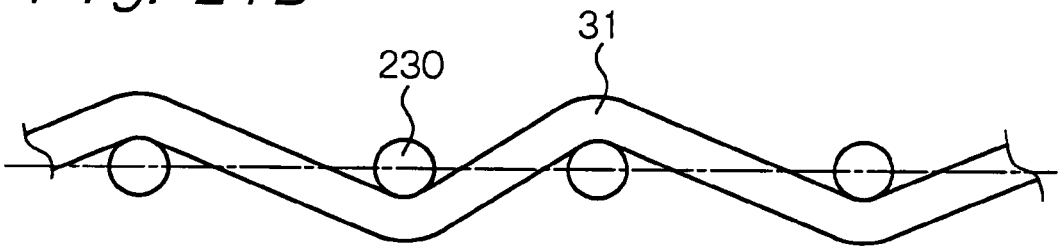
Figure 21C:
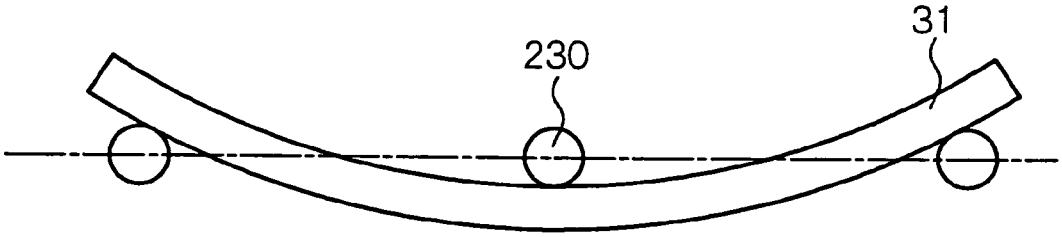
Figure 21D:
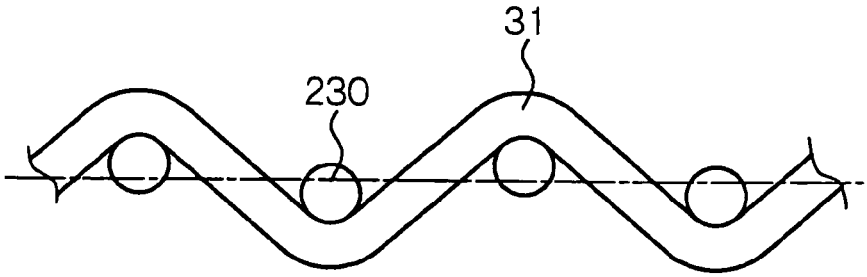
Figure 22:
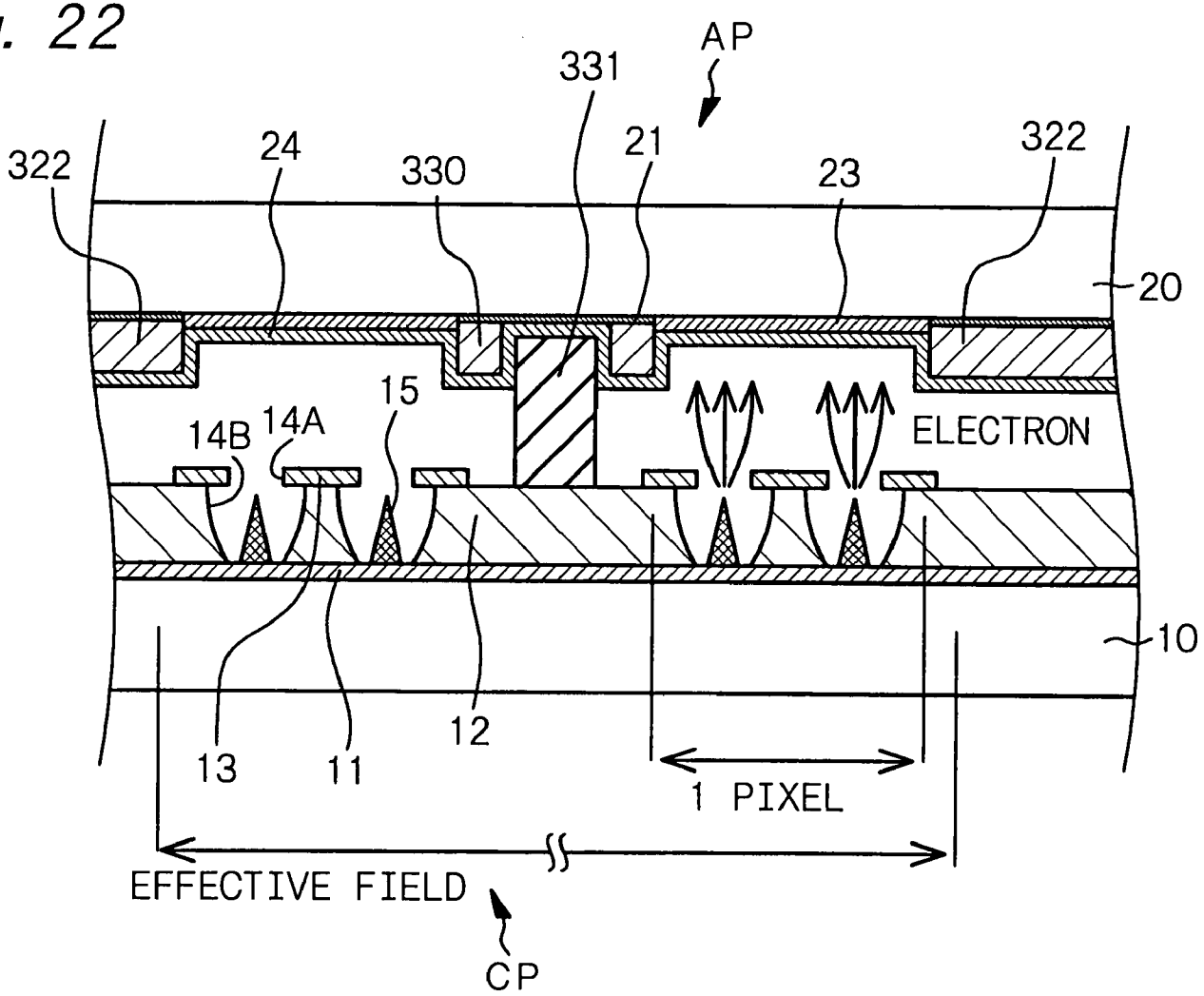
FIG. 22 is a schematic partial end view of a cold cathode field emission display that is a conventional flat-type display.

It is not necessarily required to insert the spacer between a pair of spacer holders, and for example, the spacer holders may be arranged in the form of a straight line or in the form of a cross-stitch. FIGS. 21(A) to 21(C) show schematic partial plan views of examples in which a plurality of projected spacer holders 230 are arranged on a straight line, and FIG. 21(D) shows a schematic partial plan view of an example in which a plurality of projected spacer holders 230 are arranged in the form of a cross-stitch (specifically, a plurality of the spacer holders 230 are arranged such that they are shifted in the direction at right angles with the extending direction of the spacer). Concerning dimensions of the spacer holders 230, the spacer holders 230 have, for example, a diameter of 10 to 100 μm and a height of 30 to 100 μm although they are dependent upon the height and thickness of the spacer and the width of the light-absorbing layer. The spacer holders 230 can be formed, for example, by printing a photosensitive polyimide resin according to a screen printing method and then carrying out exposure and development. When the spacer is temporarily held with the thus-structured spacer holders 230, the spacer is temporarily held with the spacer in a state in which it meanders. The spacer holders 230 may be formed at equal intervals as shown in FIG. 21(A) or 21(D), the spacer holders 230 may be formed at different intervals as shown in FIG. 21(B), or the spacer 31 may be temporarily held with three spacer holders 230 as shown in FIG. 21(C). While cylindrical spacer holders 230 are shown in the drawings, the outer form of the spacer holders 230 shall not be limited thereto, and the spacer holders 230 may have the outer form of a prism or a rivet (form of a cylinder with a step).

In the present invention, the spacer is fixed to the first panel effective field and/or the second panel effective field with the low-melting-point metal material layer, so that the tilting or falling of the spacer can be reliably prevented in the process of manufacturing a flat-type display. Further, the present invention is free from such problems wherein a gas is released from a material fixing the spacer, or where a material fixing the spacer is thermally deteriorated, in various heat-treatment steps of the process of manufacturing a flat-type display, so that there can be easily manufactured flat-type displays having a pressure tight structure and having an easy and simple structure. As a result, the yield of assembly of flat-type displays can be improved, and further, the cost for manufacturing flat-type displays can be decreased. Furthermore, the form accuracy and processing accuracy of spacers can be decreased, or the tolerance of thickness of the spacers can be increased, so that the cost for producing the spacers can be decreased. Moreover, the flat-type displays can be easily assembled and manufactured, so that the time period for manufacturing flat-type displays can be decreased, and a part of each spacer can be grounded simultaneously with fixing the spacers to the first panel effective field and/or the second panel effective field.

Further, the space holders for temporarily holding the spacer are formed, so that the spacer can be reliably and perpendicularly held and temporarily held with the spacer holders. Further, when the first panel and the second panel are bonded to each other in their circumferential portions with the bonding layer made from the low-melting-point metal materials, the vacuum degree of the vacuum space can be improved, and the high vacuum degree can be maintained for a long period of time, so that flat-type displays are improved in reliability.

The invention claimed is:

1. A flat-type display, comprising:

a first panel and a second panel which are bonded to each other in their circumferential portions and having a space between the first panel and the second panel, the space being in a vacuum state;

a spacer extending, as viewed in cross-section, longitudinally in the space between the first panel and the second panel to terminate in a first end spacer surface and an opposite second end spacer surface and laterally between a pair of spaced-apart spacer side walls to define a thickness therebetween;

a first electrode member fabricated as a unitary construction from an electrically-conductive material and extending across and connected to one of the first panel and the second panel, the first electrode member, as viewed in cross-section, formed with a recess having a pair of facially-opposing recess side walls and a recess bottom wall interconnecting the pair of recess side walls;

a second electrode member fabricated from an electrically-conductive material, extending across and connected to a remaining one of the first panel and the second panel;

a first low-melting-point metal layer and a second low-melting-point metal layer, each one of the first and second low-melting-point metal layers being fabricated from an electrically-conductive material having a low melting point; and a first conductive material layer and a second conductive material layer, each one of the first and second conductive material layers being fabricated from an electrically-conductive material, wherein the spacer electrically connects the first and second electrodes, wherein the first end spacer surface, the first conductive material layer and the first low-melting-point metal layer are disposed in the recess with the first conductive material layer disposed between and in contact with the first end spacer surface and the first low-melting-point metal layer and the first low-melting-point metal layer being in contact with and disposed between the first conductive material layer and the recess bottom wall and wherein each one of the pair of recess side walls is in contact with the first conductive material layer and the first low-melting-point metal layer while the pair of spacer side walls at a first end portion of the spacer positioned inside the recess is spaced apart from the pair of recess side walls.

2. The flat-type display according to claim 1, in which the spacer is formed of ceramics or glass.

3. The flat-type display according to claim 1, in which the first panel and the second panel are bonded to each other in their circumferential portions through a bonding layer made of frit glass.

4. The flat-type display according to claim 1, in which the first panel and the second panel are bonded to each other in their circumferential portions through a bonding layer made of a low-melting-point metal material.

5. The flat-type display according to claim 1, in which the flat-type display is a cold cathode field emission display, the first panel is an anode panel in which an anode electrode and a phosphor layer are formed, and, the second panel is a cathode panel in which a plurality of cold cathode field emission devices are formed.

6. The flat-type display according to claim 1, in which a plurality of recesses for receiving the first end portion of the spacer are formed in the first panel and/or the second panel.

7. The flat-type display according to claim 6, in which the spacer is formed of ceramics or glass.

8. The flat-type display according to claim 6, in which the first panel and the second panel are bonded to each other in their circumferential portions through a bonding layer made of frit glass.

9. The flat-type display according to claim 6, in which the first panel and the second panel are bonded to each other in their circumferential portions through a bonding layer made of a low-melting-point metal material.

10. The flat-type display according to claim 6, in which the flat-type display is a cold cathode field emission display, the first panel is an anode panel in which an anode electrode and a phosphor layer are formed, and, the second panel is a cathode panel in which a plurality of cold cathode field emission devices are formed.

11. The flat-type display according to claim 1, wherein the first panel comprises a substratum, a partition wall formed on the substratum between one phosphor layer and another phosphor layer, and a light absorbing layer formed between the substratum and the partition wall.

12. The flat-type display according to claim 1, wherein the melting point of the low-melting-point metal material is 120° C. to 400° C.

13. The flat-type display according to claim 1, wherein the melting point of the low-melting-point metal material is 120° C. to 300° C.

14. A method for manufacturing a flat-type display, said flat-type display comprising a first panel and a second panel bonded to each other in their circumferential portions and having a space between the first panel and the second panel, the space being in a vacuum state, a spacer extending, as viewed in cross-section, longitudinally in the space between the first panel and the second panel to terminate in a first end spacer surface and an opposite second end spacer surface and laterally between a pair of spaced-apart spacer side walls to define a thickness therebetween, a first electrode member fabricated as a unitary construction from an electrically-conductive material and extending across and connected to one of the first panel and the second panel with the first electrode member, as viewed in cross-section, formed with a recess having a pair of facially-opposing recess side walls and a recess bottom wall interconnecting the pair of recess side walls, a second electrode member fabricated from an electrically-conductive material, extending across and connected to a remaining one of the first panel and the second panel, a first low-melting-point metal layer and a second low-melting-point metal layer with each one of the first and second low-melting-point metal layers being fabricated from an electrically-conductive material having a low melting point and a first conductive material layer and a second conductive material layers with each one of the first and second conductive material layers being fabricated from an electrically-conductive material, with the spacer electrically connecting the first and second electrodes, the method comprising the steps of:

positioning the first end spacer surface, the first conductive material layer and the first low-melting-point metal layer in the recess with the first conductive material layer disposed between and in contact with the first end spacer surface and the first low-melting-point metal layer and the first low-melting-point metal layer being in contact with and disposed between the first conductive material layer and the recess bottom wall and each one of the pair of recess side walls being in contact with the first conductive material layer and the first low-melting-point metal layer while the pair of spacer side walls at a first end portion of the spacer positioned inside the recess is spaced apart from the pair of recess side walls;

positioning the second conductive material layer on the second end spacer surface; and positioning the second low-melting-point metal layer in contact with and between the second conductive material layer and second electrode member.

15. The method for manufacturing a flat-type display according to claim 14, in which the spacer is formed of ceramics or glass.

16. The method for manufacturing a flat-type display according to claim 14, in which the first panel and the second panel are bonded to each other in their circumferential portions through a bonding layer made of fit glass.

17. The method for manufacturing a flat-type display according to claim 14, in which the first panel and the second panel are bonded to each other in their circumferential portions through a bonding layer made of a low-melting-point metal material.

18. The method for manufacturing a flat-type display according to claim 14, in which the flat-type display is a cold cathode field emission display, the first panel is an anode panel in which an anode electrode and a phosphor layer are formed, and, the second panel is a cathode panel in which a plurality of cold cathode field emission devices are formed.

19. The method for manufacturing a flat-type display according to claim 14, in which the flat-type display is a cold cathode field emission display, the first panel is a cathode panel in which a plurality of cold cathode field emission devices are formed, and, the second panel is an anode panel in which an anode electrode and a phosphor layer are formed.

20. The method for manufacturing a flat-type display according to claim 14, in which a plurality of recesses for receiving the first end portion of the spacer are formed in the first panel and/or the second panel.

21. The method for manufacturing a flat-type display according to claim 20, in which the spacer is formed of ceramics or glass.

22. The method for manufacturing a flat-type display according to claim 20, in which the first panel and the second panel are bonded to each other in their circumferential portions through a bonding layer made of frit glass.

23. The method for manufacturing a flat-type display according to claim 20, in which the first panel and the second panel are bonded to each other in their circumferential portions through a bonding layer made of a low-melting-point metal material.

24. The method for manufacturing a flat-type display according to claim 20, in which the flat-type display is a cold cathode field emission display, the first panel is an anode panel in which an anode electrode and a phosphor layer are formed, and, the second panel is a cathode panel in which a plurality of cold cathode field emission devices are formed.

25. The method for manufacturing a flat-type display according to claim 20, in which the flat-type display is a cold cathode field emission display, the first panel is a cathode panel in which a plurality of cold cathode field emission devices are formed, and, the second panel is an anode panel in which an anode electrode and a phosphor layer are formed.

26. The method for manufacturing a flat-type display according to claim 14, in which the melting point of the low-melting-point metal material is 120° C. to 400° C.

27. The method for manufacturing a flat-type display according to claim 14, in which the melting point of the low-melting-point metal material is 120° C. to 300° C.

28. The flat-type display according to claim 1, wherein the second conductive material layer is disposed on the second end spacer surface and the second low-melting-point metal layer is in contact with and disposed between the second conductive material layer and second electrode member.

* * * * *